US005684259A

United States Patent [19]

Horii

[11] Patent Number: 5,684,259

[45] Date of Patent: Nov. 4, 1997

[54] METHOD OF COMPUTER MELODY SYNTHESIS RESPONSIVE TO MOTION OF DISPLAYED FIGURES

[75] Inventor: Youichi Horii, Hachiouji, Japan

[73] Assignees: Hitachi, Ltd.; Nippon Columbia Co., Ltd., both of Tokyo, Japan

[21] Appl. No.: 302,441

[22] Filed: Sep. 9, 1994

[30] Foreign Application Priority Data

Jun. 17, 1994 [JP] Japan ..... 6-135369

[51] Int. Cl.[6] ..... G10H 7/00

[52] U.S. Cl. ..... 84/600; 84/626; 84/662

[58] Field of Search ..... 84/600, 626, 662, 84/611, 635, 651, 667

[56] References Cited

U.S. PATENT DOCUMENTS 5,027,689 7/1991 Fujimori ..... 84/622
5,048,390 9/1991 Adachi et al. ..... 84/626 X
5,159,140 10/1992 Kimpara et al. ..... 84/600
5,453,568 9/1995 Tajima et al. ..... 84/626

*Primary Examiner*—William M. Shoop, Jr.
*Assistant Examiner*—Jeffrey W. Donels
*Attorney, Agent, or Firm*—Antonelli, Terry, Stout & Kraus, LLP.

[57] ABSTRACT

A system and method for synthesizing musical melodies on a computer displays a plurality of figures on a display device, one or more of which can be selected by a user for conversion into a series of sounds to create a melody to be played through an electronic musical instrument. In operation, various sub-routines stored within a system processor are used to manipulate attributes such as position, shape, color, and size of the displayed figures to generate corresponding sounds having a desired pitch, intensity, timbre, and sound length. The displayed figures are then made to move in accordance with user-selected rules, or with melodies played on an electronic musical instrument. An octave filter or wide range filter may be employed to change other attributes of the individual sounds comprising the melody, or of the entire melody itself.

54 Claims, 46 Drawing Sheets

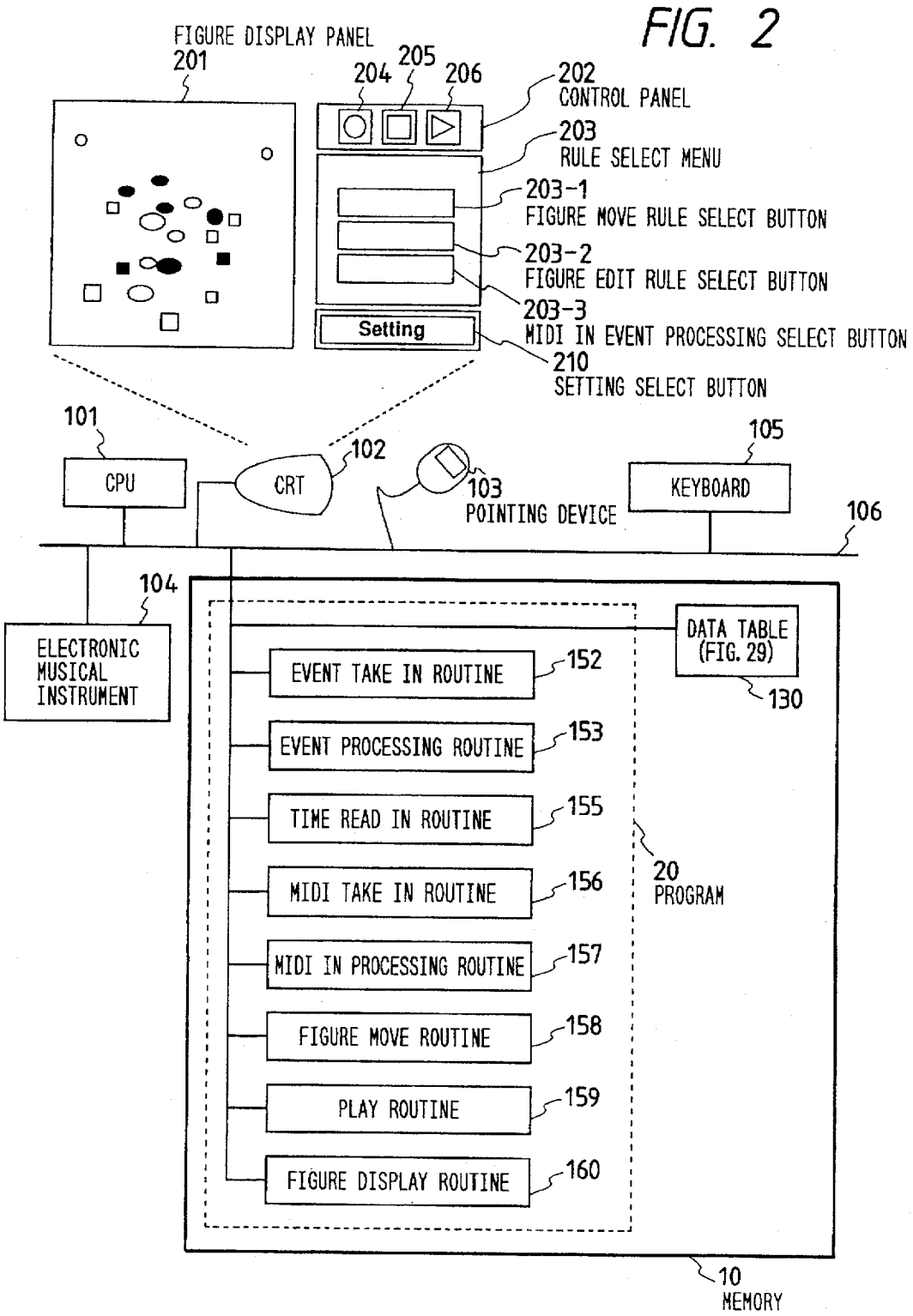
FIG. 2
FIGURE DISPLAY PANEL
201
204
205
206
202
CONTROL PANEL
203
RULE SELECT MENU
203-1
FIGURE MOVE RULE SELECT BUTTON
203-2
FIGURE EDIT RULE SELECT BUTTON
203-3
MIDI IN EVENT PROCESSING SELECT BUTTON
Setting
210
SETTING SELECT BUTTON
101
CPU
CRT
102
103
POINTING DEVICE
105
KEYBOARD
106
104
ELECTRONIC MUSICAL INSTRUMENT
DATA TABLE (FIG. 29)
130
EVENT TAKE IN ROUTINE
152
EVENT PROCESSING ROUTINE
153
TIME READ IN ROUTINE
155
MIDI TAKE IN ROUTINE
156
MIDI IN PROCESSING ROUTINE
157
FIGURE MOVE ROUTINE
158
PLAY ROUTINE
159
FIGURE DISPLAY ROUTINE
160
20
PROGRAM
10
MEMORY

| |
|---|
| RANDOM WALK |
| CONVERGENCE |
| DIVERGENCE |
| FLOW |
| BOUNCE |
| ROTATE CLOCKWISE |
| ROTATE COUNTER-CLOCKWISE |
| VIBRATE |
| LIFE |

| |
|---|
| SWEEP |
| MOVE |
| LINE |
| ROTATE |
| RANDOM RECT |
| CIRCLE |
| PRECISE FOLLOW |
| RANDOM FOLLOW |

| | |
|---|---|
| 1 | RANDOM RECT |
| 2 | CIRCLE |

| |
|---|
| OBJECT DISPLAY |
| RHYTHM PATTERN |
| TIMBRE |
| FILTER |
| AXIS |

FIG. 27(a)
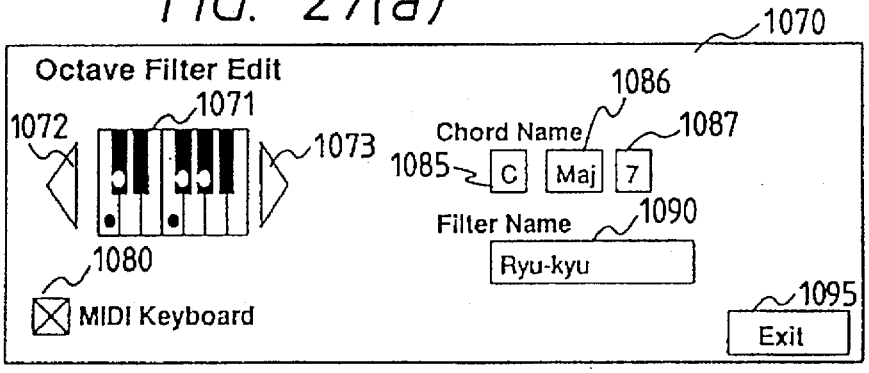
FIG. 27(b)
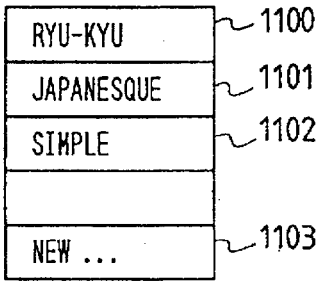
FIG. 27(c)
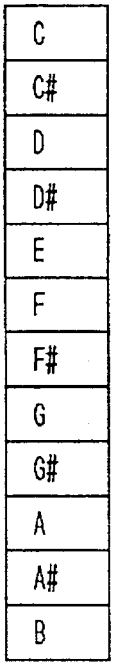
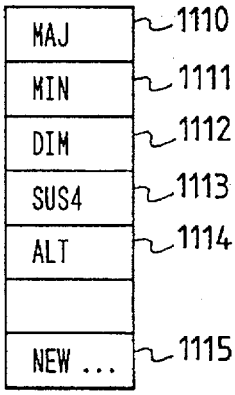
FIG. 27(d)
FIG. 27(e)
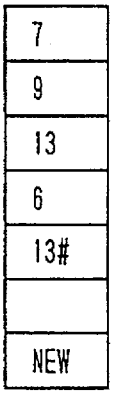
FIG. 27(f)
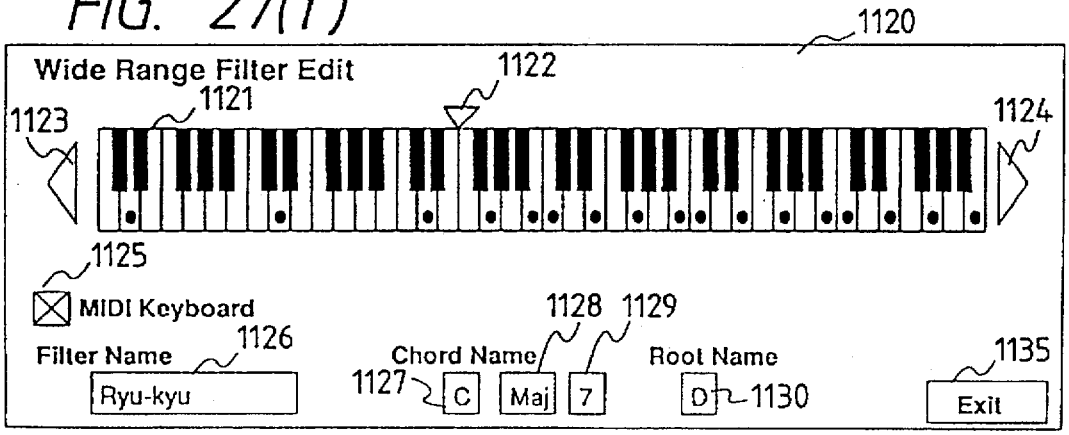

METHOD OF COMPUTER MELODY SYNTHESIS RESPONSIVE TO MOTION OF DISPLAYED FIGURES

BACKGROUND OF THE INVENTION

The present invention relates to a system and method for synthesizing a melody using a computer.

FIG. 1 is a schematic diagram showing the display screen of a prior art melody synthesizer. In this figure, a plurality of figures (for example, rectangles) are displayed on a figure display panel 1380. A play button 1381 initiates playing of a melody, a stop button 1382 stops the playing of the melody, an initialization button 1383 initializes the figure display panel 1380, and a filter button 1384 designates sounds to be outputted in an octave. "Computer Today", No. 34, (Nov., 1989), pp 13 to 18, presents a software program for performing melody synthesis called Midi Draw, sold by Intelligent Music, Ltd. In operation, when the play button 1381 is selected, the conventional method of melody synthesis, as represented by Midi Draw, scans figures displayed on the figure display panel 1380 in the order that they were drawn, determines the pitch and intensity of a sound from the horizontal and the vertical coordinate, respectively, of each figure, and outputs corresponding sounds. When the initialization button 1383 is selected, the figure display panel 1380 is cleared, and a user can draw a new group of figures on it and play new music from it.

It is also known in the prior art to instruct whether or not to output each sound in an octave by selecting sounds by the filter button 1384. When the sound pitch represented by the figure, which is selected to be played, is designated as a sound which should not be outputted, the sound is inhibited from being outputted, or shifted to the closest outputtable sound before being outputted.

The aforementioned prior art system have the following disadvantages.

(1) When the displayed group of figures has been played through, the same processing for the same group of figures is repeated, and accordingly the same melody is repeated. As a result, only repetitive, monotonous melodies are synthesized.

(2) A group of figures which has been displayed cannot be changed in part, and it is necessary to initialize the display panel and to redraw figures from the beginning.

(3) The filter which is set for an octave is applied to all the pitch range and it is impossible to set different filters for different pitch ranges. Therefore, for example, a low pitch range and a high pitch range cannot be played in different tonalities.

(4) The same filter is applied until the setting is changed by means of a mouse or other input devices. Therefore, the filters of the prior art are not suitable for transposed adlib playing.

(5) An animation cannot be produced in response to external playing.

(6) Figures can be moved only two-dimensionally, accordingly both the display screen in terms of available options and the melody synthetic capability is substantially limited.

SUMMARY OF THE INVENTION

An objective of the present invention is to provide a system and method for synthesizing a melody, which method includes as a step automatically moving, while playing, at least part of figures which have been displayed, and to thereby synthesize melodies which are always changing.

Another objective of the present invention is to provide a system and method for synthesizing a melody, which method includes as a step editing, while playing, at least part of figures which have been displayed in response to an operation of a pointing device by a user, and to thereby change the melody partially.

Another objective of the present invention is to provide a system and method for synthesizing a melody, which system uses a filter to assign different tonalities for different pitch ranges.

Another objective of the present invention is to provide a system and method for synthesizing a melody, which system includes a filter that can be modified at any time in response to external play information.

Another objective of the present invention is to provide a method for synthesizing a melody which includes as a step moving figures in response to external play information.

Still another objective of the present invention is to provide a method for synthesizing a melody which includes as a step generating figures which move three-dimensionally.

The aforementioned method of the present invention includes as steps displaying a plurality of figures designated by a user on the screen of a display unit, selecting each of the figures sequentially, determining attributes such as pitch, timbre, intensity, and length of the sound corresponding to each selected figure based on attributes such as position, shape, color, and size of each figure according to a sound information conversion rule designated by a user, and outputting the sound for each figure in accordance with the aforementioned attributes to create a melody. When the desired melody is played, the position of each figure automatically moves according to a figure movement rule designated by the user, and the position after the movement determines the attributes of the sound to be outputted. For example, the user can designate one figure motion selectively among various figure motions which have been prepared beforehand, such as random walk, convergent movement to a certain point, divergent movement therefrom, flowing movement in a certain direction, linear movement and bounce, rotation around a certain point, and vibration. Complicated melodies corresponding to combinations of various figure motions can then be synthesized accordingly.

The user can also designate, during playing, positions on the display screen by using a pointing device such as a mouse, and change the position of a figure according to the designated position and a designated figure edit rule. For example, the user can designate one figure motion selectively from among various figure motions, such as following up the cursor designated by the pointing device, arrangement on a circumference designated by the pointing device, movement in a direction designated by the pointing device, arrangement on a line segment designated by the pointing device, rotation in a direction designated by the pointing device, and arrangement in a rectangle designated by the pointing device. As a result of such designations, complicated melodies corresponding to combinations of various figure motions can be synthesized.

Furthermore, the method of the present invention allows different tonalities to be set for different pitch ranges through the use of a filter, which can, at any time, be adapted to cover any desired all pitch range in response to play information entered from a source external to the system.

The method of the present invention also permits figures to be moved in response to play information entered from a source external to the system.

Furthermore, the method of the present invention includes steps for processing three-dimensional figure movement, projecting the result of the processing onto the two-dimensional screen, and generating a sound for output which corresponds to the three-dimensional figure movement.

BRIEF DESCRIPTION OF THE DRAWINGS

FIG. 2 is a schematic block diagram showing an embodiment of the system for synthesizing a melody in accordance with the present invention;

FIG. 8(*b*) shows a pop-up menu listing figure move rules available for selection in accordance with the method of the present invention;

FIG. 8(*c*) shows a pop-menu listing figure edit rules available for selection in accordance with the method of the present invention; and FIG. 8(*d*) shows a pop-up menu listing MIDI-In event processing rules available for selection in accordance with the method of the present invention;

FIG. 9(*b*) is a pop-up menu displayed during the Setting routine of FIG. 9(*a*) executed in accordance with the method of the present invention;

FIG. 21(*b*) is a graphical representation showing how a figure drawing process is performed when the figure shape is a circle or ellipse and there are color designations, in accordance with the method of the present invention;

FIG. 21(*c*) is a graphical representation showing how a figure drawing process is performed when the figure is a wire frame and the relevant shape is a rectangle, in accordance with the method of the present invention;

FIG. 21(*d*) is a graphical representation showing how a figure drawing process is performed when the shape is a rectangle and there are color designations, in accordance with the method of the present invention;

FIG. 22(*b*) is a graphical representation showing how a figure drawing process is performed when the figure is a two-dimensional polygon and a color is designated, in accordance with the method of the present invention;

FIG. 22(*c*) is a graphical representation showing how a figure drawing process is performed when the figure is a wire frame and the shape is a three-dimensional polyhedron, in accordance with the method of the present invention;

FIG. 22(*d*) is a graphical representation showing how a figure drawing process is performed when the figure shape is a three-dimensional polyhedron and a color is designated, in accordance with the method of the present invention;

FIG. 25(*b*) is a diagram showing a pop-up menu displayed when the shape-type of a figure to be displayed is designated, in accordance with the method of the present invention;

FIG. 25(*c*) is a diagram showing a pop-up menu generated when a mouse is used to select the color made of a figure to be displayed, in accordance with the method of the present invention;

FIG. 25(*d*) is a diagram showing a pop-up menu generated when a mouse is used to select the size of mode of a figure to be displayed, in accordance with the method of the present invention;

FIG. 26(*b*) is a diagram showing a pop-up menu generated by a filter-type setting button, in accordance with the method of the present invention;

FIG. 27(*a*) is a diagram showing a filter parameter setting screen generated in accordance with one embodiment of the method of the present invention;

FIG. 27(*b*) is a drawing of a pop-up menu generated by a button used to select a filter by name, in accordance with the method of the present invention;

FIG. 27(*c*) is a drawing of a pop-up menu generated to assist a user in selecting the root of a cord, in accordance with the method of the present invention;

FIG. 27(*d*) is a diagram of a pop-up menu generated to assist the user in selecting a type of chord, in accordance with the method of the present invention;

FIG. 27(*e*) is a diagram of a pop-up menu generated to assist a user in selecting ornamental information for a chord, in accordance with the method of the present invention;

FIG. 27(*f*) is a diagram showing a wide range filter setting screen generated in accordance with the method of the present invention;

FIG. 30(*b*) is a diagram showing how partial movement of various particles are effected during the Sweep routine shown in FIG. 30(*a*), in accordance with the method of the present invention;

FIG. 31(*b*) is a diagram showing how the position of particles are affected by the Move routine shown in FIG. 31(*a*), in accordance with present invention;

FIG. 32(*b*) is a diagram showing how the positioning of particles is affected by the Line routine shown in FIG. 32(*a*), accordance with the present invention;

FIG. 33(*b*) is a drawing showing how the position of particles are affected as a result of the Rotate routine shown in FIG. 33(*a*), in accordance with the present invention;

FIG. 34(*b*) is a drawing showing how the position of particles are affected after the Random Rect routine in FIG. 34(*a*) as performed, in accordance with the present invention;

FIG. 35(*b*) is a drawing showing how the position of particles is affected by the Circle routine shown in FIG. 35(*a*), in accordance with the present invention;

FIG. 36(*b*) is a diagram showing how the position of particles is affected by the Precise Follow routine shown in FIG. 36(*a*), in accordance with the present invention;

FIG. 37(*b*) is a diagram showing how the position of particles is affected by the Random Follow routine shown in FIG. 37(*a*), in accordance with the present invention;

FIG. 38(*b*) is a drawing showing how the position of particles is affected by the Random Walk routine shown in FIG. 38(*a*), in accordance with the present invention;

FIG. 39(*b*) is a drawing showing how the position of particles is affected by the Convergence routine shown in FIG. 39(*a*), in accordance with the present invention;

FIG. 40(*b*) is a drawing showing how the position of particles is affected by the Divergence routine shown in FIG. 40(*a*), in accordance with the present invention;

FIG. 41(*b*) is a diagram showing how the position of particles is affected by the Flow routine shown in FIG. 41(*a*), in accordance with the present invention;

FIG. 42A(*b*) is a graphical representation showing the manner in which particles are moved when a test 2610 is performed during the Bounce routine executed in accordance with the method of the present invention;

FIG. 42A(*c*) is a graphical representation showing the manner in which particles are moved when a test 2612 in the Bounce routine is performed in the method of the present invention;

FIG. 42A(*d*) is a graphical representation showing the manner in which particles are moved when a test 2614 is performed during the Bounce routine executed in accordance with the method of the present invention;

FIG. 42A(*e*) is a graphical representation showing the manner in which particles are moved when a test 2616 is performed during the Bounce routine executed in accordance with the method of the present invention;

FIG. 43(*b*) is a diagram showing the manner in which particles are moved when the Rotate routine of FIG. 43(*a*) is performed in accordance with the method of the present invention;

FIG. 44(*b*) is a diagram showing the manner in which particles are moved in accordance with the Vibrate routine performed in accordance with the method of the present invention;

FIG. 45(*b*) is a diagram showing the manner in which particles are moved in accordance with the Like routine performed in accordance with the method of the present invention;

FIG. 46(*b*) is a diagram showing the manner in which particles are moved in accordance with the MIDI-In Random Rect routine performed in accordance with the method of the present invention;

FIG. 47(*b*) is a diagram showing the manner in which particles are moved in accordance with the MIDI-In Circle routine of FIG. 47(*a*).

DETAILED DESCRIPTION OF THE PREFERRED EMBODIMENTS

Figure 1:
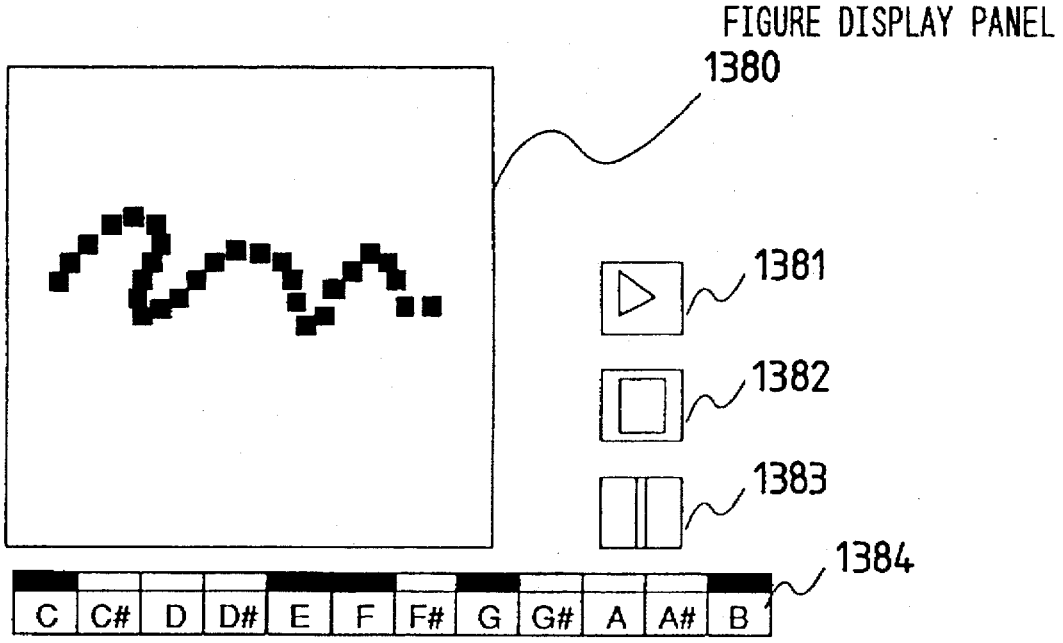
FIG. 1 PRIOR ART
FIG. 1 shows a display screen of a melody synthesizer of the prior art.
Figure 3:
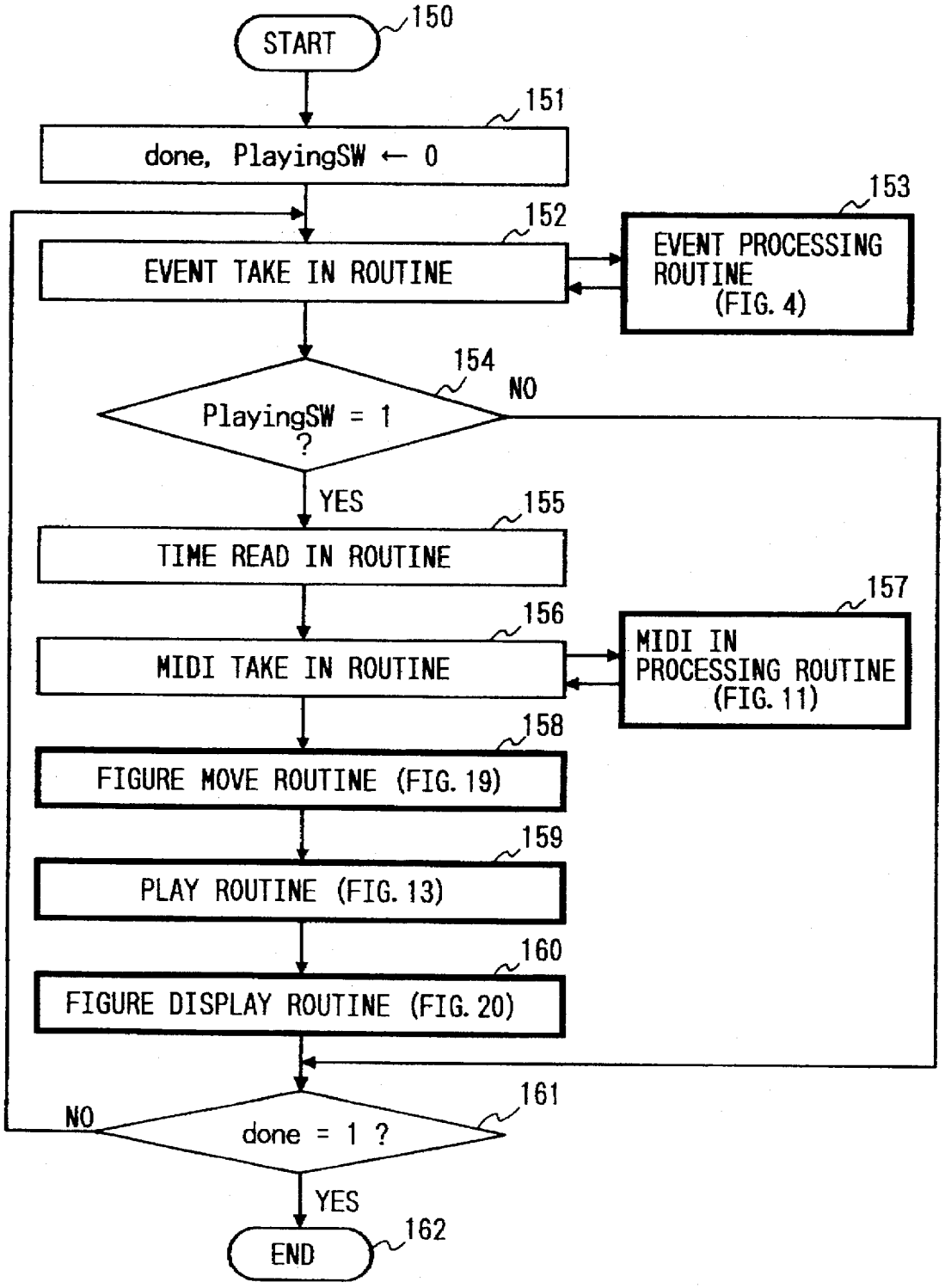
FIG. 3 is a flow chart showing steps included in an embodiment of the method of the present invention.

Firstly, an embodiment of the system and method of the present invention will be outlined respectively with reference to FIGS. 2 and 3.

With reference to FIG. 2 showing the outline of an embodiment of the present invention mainly with respect to the system configuration, a memory 10, a CPU 101, a display 102, a pointing device 103, an electronic musical instrument 104, and a keyboard 105 are connected to a bus 106. The display 102 in this embodiment is a CRT display. The pointing device 103, which has at least one control button, is a mouse in this embodiment. The memory 10 stores various program routines 152 to 160 for performing melody synthesis and figure processing and a data table 130 for retaining various constants and variables necessary to execute those routines. The screen of the display 102 contains a figure display panel 201 for displaying a plurality of figures, a control panel 202, a rule select menu 203, and a setting select button 210 for setting various parameters. The control panel 202 contains a recording button 204, a stop button 205, and a play button 206. The rule select menu 203 contains a figure move rule select button 203-1, a figure edit rule select button 203-2, and a MIDI-In event processing select button 203-3.

The user operates the mouse 103 and the keyboard 105 to set various items. Designation of the shape, color, and size of a plurality of figures to be displayed, assignment of the timbre and standard sound intensity to each figure, designation of the rhythm pattern, setting of the filter, and others are executed using setting menus and the figure move rule, figure edit rule, and/or MIDI In event processing rule are selected by using the rule select menu 203. When the designated figures are displayed in predetermined position and the play button 206 is operated, the displayed figures move according to the selected rules, and sounds having the sound pitch, sound intensity, timbre, and other attributes corresponding to the position, shape, color, size, and other attributes of the figures which are sequentially selected are outputted to the electronic musical instrument 104, and thus a musical composition corresponding to an animation or moving figures is played. The displayed figures may also be moved in response to playing on the electronic musical instrument 104 by a player.

In this embodiment, for the sake of simplicity of explanation, the playing sequence of figures is predetermined on the basis of the kind (type) of each figure, and the initial position of each figure is also predetermined as an initial state of the apparatus. However, they may be set arbitrarily by the user.

FIG. 3 roughly shows steps included in one embodiment of the method of melody synthesis of the present invention. At Step 151, "0" is substituted for variables "done" and "PlayingSW". Subsequently, Steps 152 to 160 are repeated until "done" is changed to "1". "done" and "PlayingSW" are changed to "1" in the Event Processing routine 153 in response to certain operations of the mouse and keyboard. The Event Take-In routine 152 takes in events such as ON and OFF of the mouse button, movement of the mouse, and keyboard input. When an event occurs, the Event Processing routine 153 is called and executes the processing according to the event. The Event Processing routine 153 includes a Figure Edit routine for changing the position of a displayed figure or figures in response to the mouse operation. When Test 154 detects that "PlayingSW" is "1", Steps 155 to 160 are executed. When "PlayingSW" is not "1", a jump to Step 161 is caused. The Time Read In routine 155 reads the current time measured from the start of playing, that is, the time when "PlayingSW" is changed to "1", and records it as "currentTime". The MIDI Take-In routine 156 reads play information in the MIDI signal format from the electronic music instrument 104 which is outside the computer. When the play information is inputted from the outside, the MIDI In Processing routine 157 is called and executes the processing according to the play information. The Figure Move routine 158 changes the position of a figure or figures displayed on the figure display panel 201 according to the rule which is designated beforehand. The Play routine 159 sends play information which is determined from the attributes of figures such as position to the electronic musical instrument 104. The figure display routine 160 draws figures on the figure display panel 201. When Test 161 detects that "done" is "1", all the processing ends (Step 162). When "done" is not "1", the processing returns to Step 152.

Figure 4:
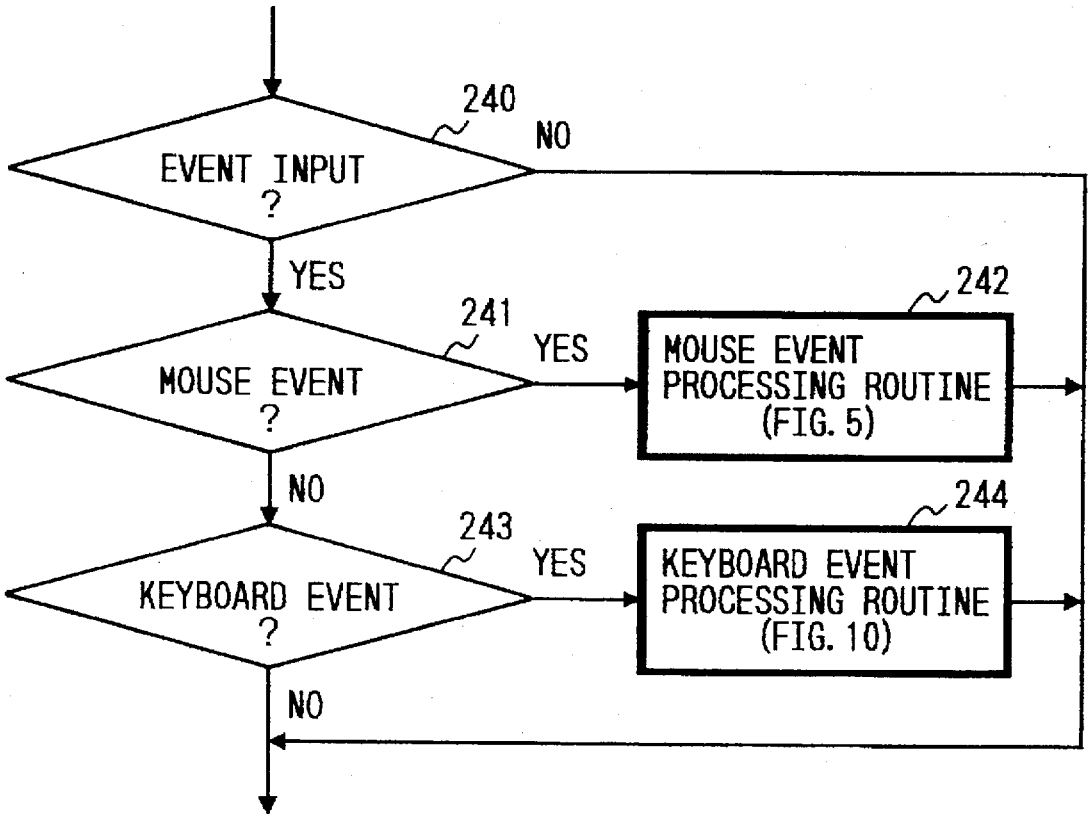
FIG. 4 is a flow chart of an Event Take In routine included in one embodiment of the method of the present invention.

FIG. 4 shows the outline of the Event Processing routine 153. The Event Processing routine executes necessary processing when the mouse or keyboard is operated. When Step 240 detects an event input from the mouse or keyboard, the processing at Step 241 and the subsequent steps are executed. When Step 240 detects no event input, processing ends. When Step 241 detects that the event is related to the mouse, a Mouse Event Processing routine 242 operates and executes processing according to the event. When Step 243 detects that the event is related to the keyboard, a Keyboard Event Processing routine 244 operates and performs processing according to the event.

Figure 5:
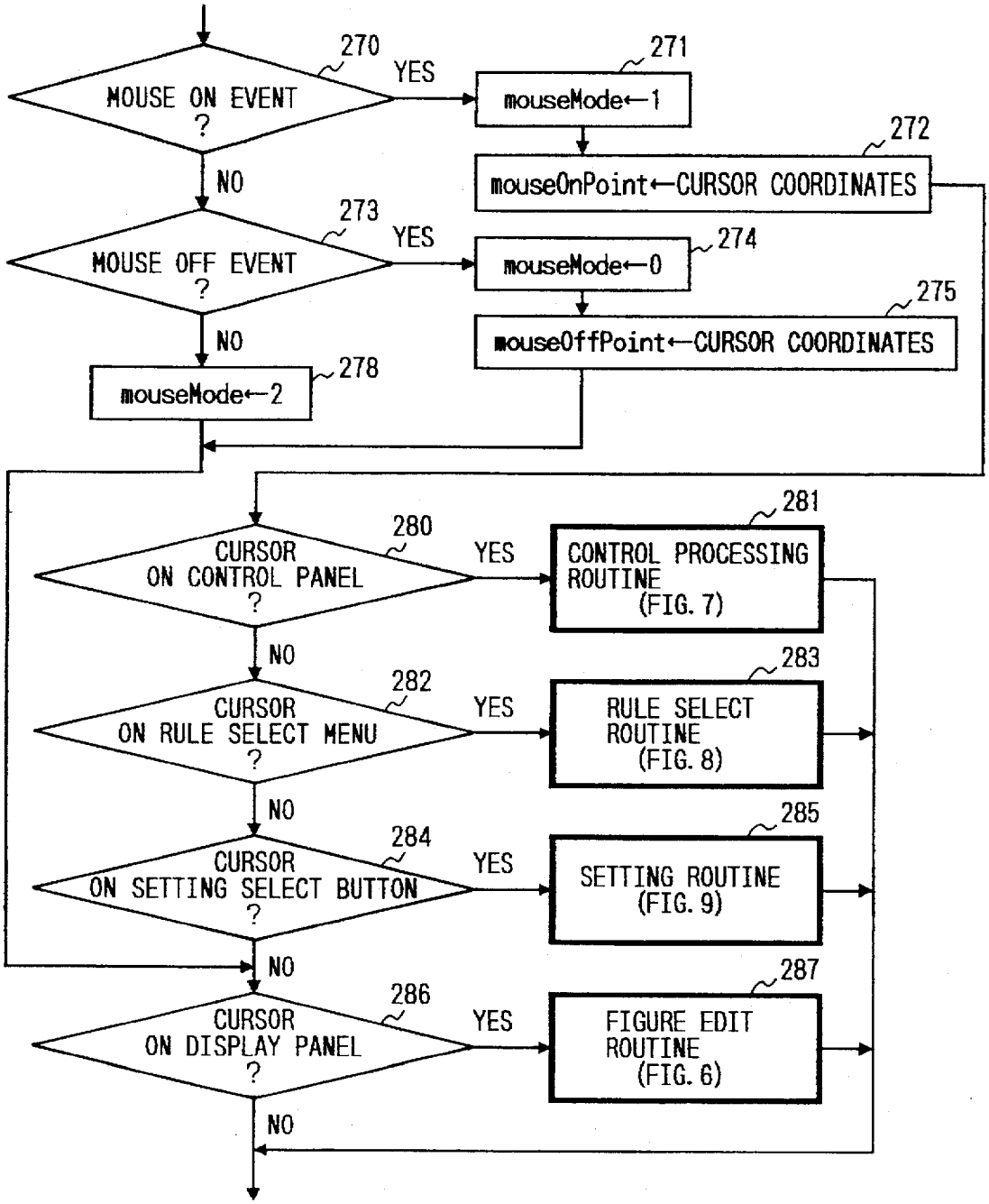
FIG. 5 is a flow chart of a Mouse Event Processing routine included in one embodiment of the method of the present invention.

FIG. 5 shows the Mouse Event Processing routine 242. The Mouse Event Processing routine executes processing according to an event on the mouse such as turning the mouse button 0N or OFF or movement of the mouse. When Step 270 detects a Mouse ON event, "1" is substituted for "mouseMode" (Step 271), and the coordinates of the cursor are substituted for "mouseOnPoint" (Step 272), and then the processing at Step 280 and the subsequent steps is executed. When Step 273 detects a Mouse OFF event, "0" is substituted for "mouseMode" (Step 274) and the coordinates of the cursor are substituted for "mouseOffPoint" (Step 275). When Step 273 detects no Mouse OFF event, "2" is substituted for "mouseMode" (Step 278). In the case where no Mouse ON event is detected, processing at Step 286 is executed immediately after the Step 275 or 278. When Step 280 detects that the cursor is on the control panel 202, a Control Processing routine 281 executes processing for play start or stop, or recording. When Step 282 detects that the cursor is on the rule select menu 203, a Rule Select routine 283 selects the designated rule from among the Figure Move rules, Figure Edit rules, and MIDI-In Event Processing rules. When Step 284 detects that the cursor is on the setting select button 210, a Setting routine 285 sets parameters and others. When Step 286 detects that the cursor is on the figure display panel 201, a Figure Edit routine 287 changes the position of a figure or figures according to the cursor.

Figure 6:
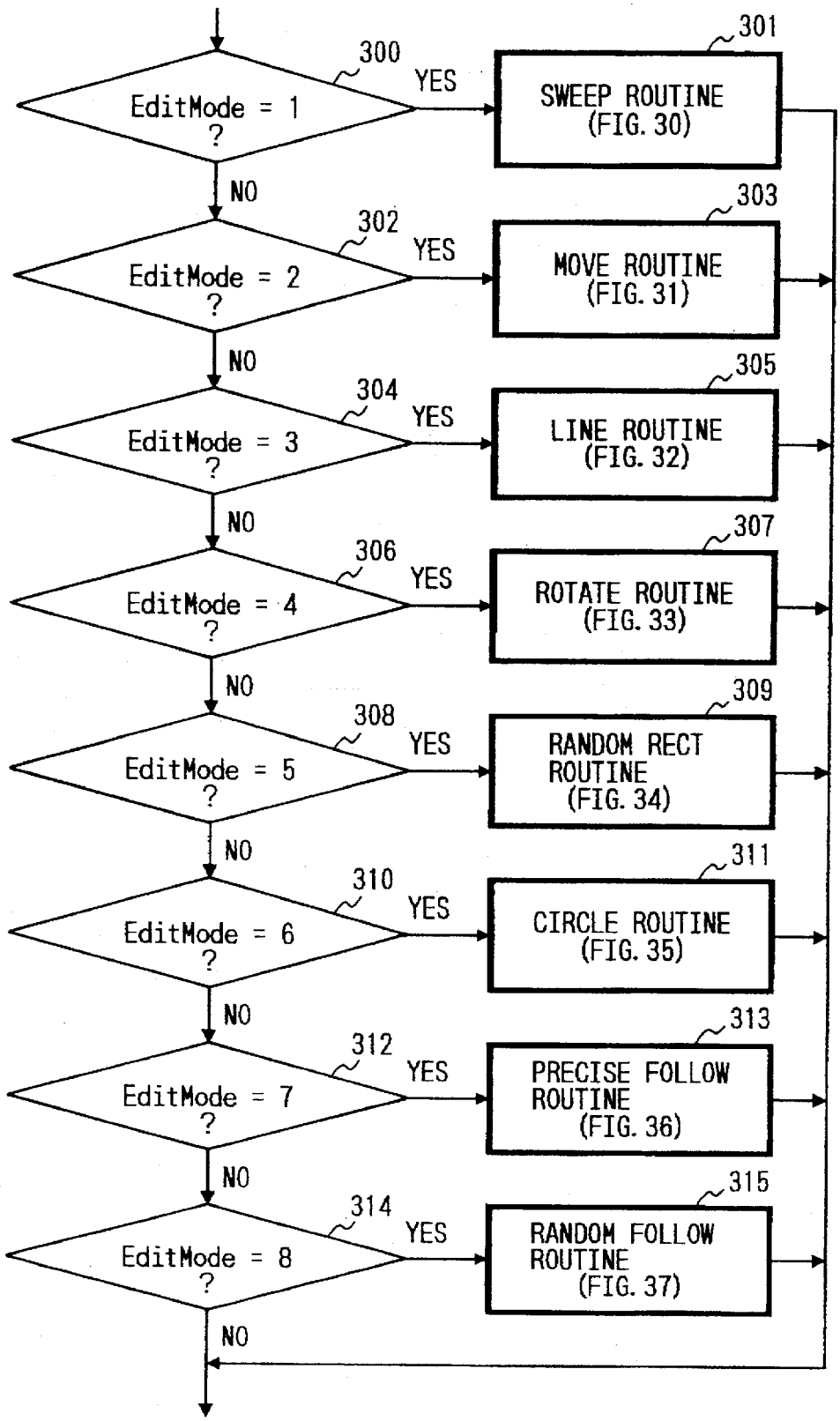
FIG. 6 is a flow chart of a Figure Edit routine included in one embodiment of the method of the present invention.

FIG. 6 shows the Figure Edit routine 287. The Figure Edit routine updates the position of a figure or figures displayed on the Figure Display panel according to the operation of the mouse. When Test 300 detects that "EditMode" is "1", a Sweep routine 301 updates the display positions of figures. When Test 302 detects that "EditMode" is "2", a Move routine 303 updates the display positions of figures. When Test 304 detects that "EditMode" is "3", a Line routine 305 updates the display positions of figures. When Test 306 detects that "EditMode" is "4", a Rotate routine 307 updates the display positions of figures. When Test 308 detects that "EditMode" is "5", a Random Rect routine 309 updates the display positions of figures. When Test 310 detects that "EditMode" is "6", a Circle routine 311 updates the display positions of figures. When Test 312 detects that "EditMode" is "7", a Precise Follow routine 313 updates the display position of a figure. When Test 314 detects that "EditMode" is "8", a Random Follow routine 315 updates the display position of a figure. The value of the aforementioned variable "EditMode" is set by the Rule Select routine 283 which will be described in detail later.

Figure 7:
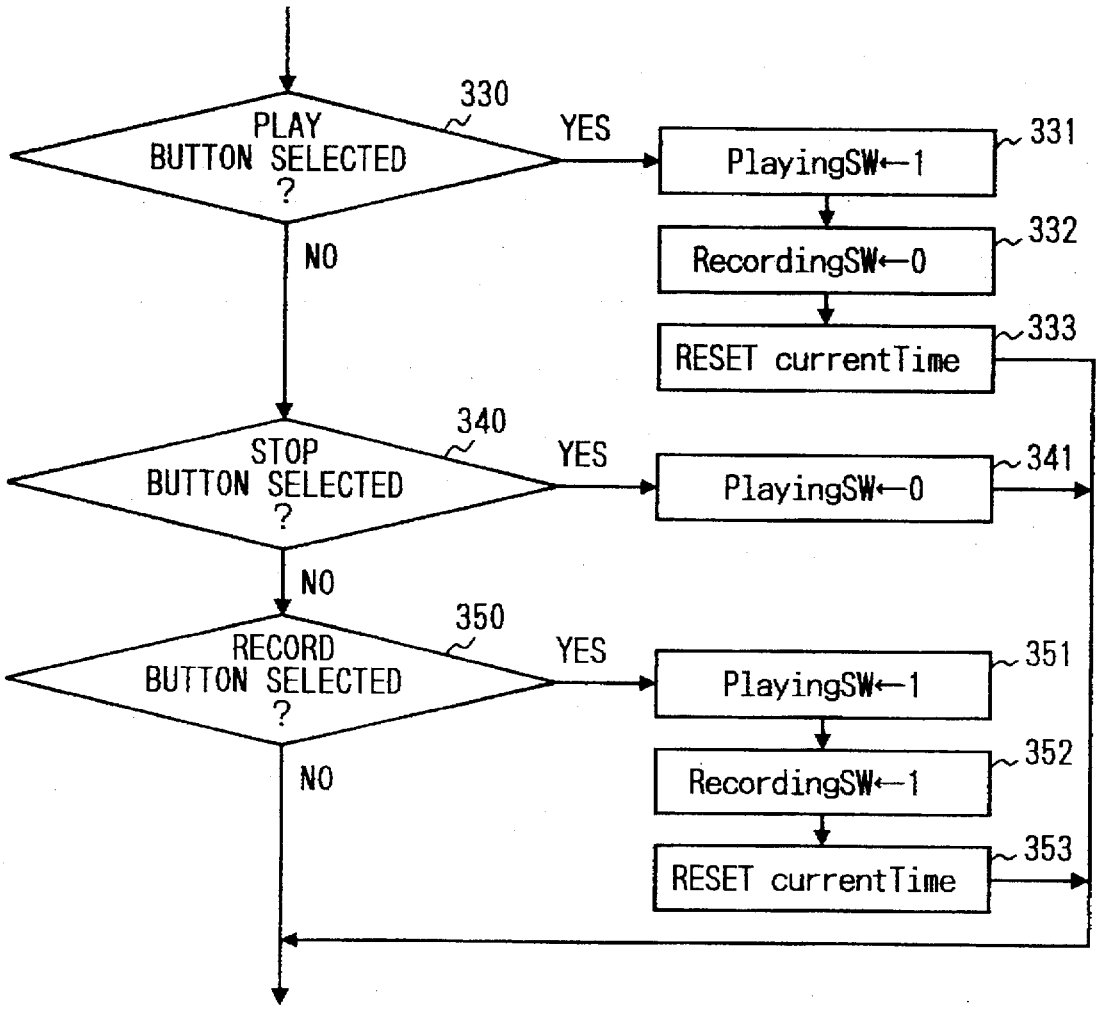
FIG. 7 is a flow chart of a Control Processing routine included an one embodiment of the method of the present invention.

FIG. 7 shows the Control Processing routine 281. The Control Processing routine executes processing for play start or stop, or recording. When Step 330 detects that the play button 206 is selected, Step 331 substitutes "1" for "PlayingSW", and Step 332 substitutes "0"0 for "RecordingSW", and Step 333 resets "currentTime". When Step 340 detects that the stop button 205 is selected, Step 341 substitutes "0" for "PlayingSW". When Step 350 detects that the recording button 204 is selected, Step 351 substitutes "1" for "PlayingSW", and Step 352 substitutes "1" for "RecordingSW", and Step 353 resets "currentTime".

Figures 8A, 8B, 8C, 8D:
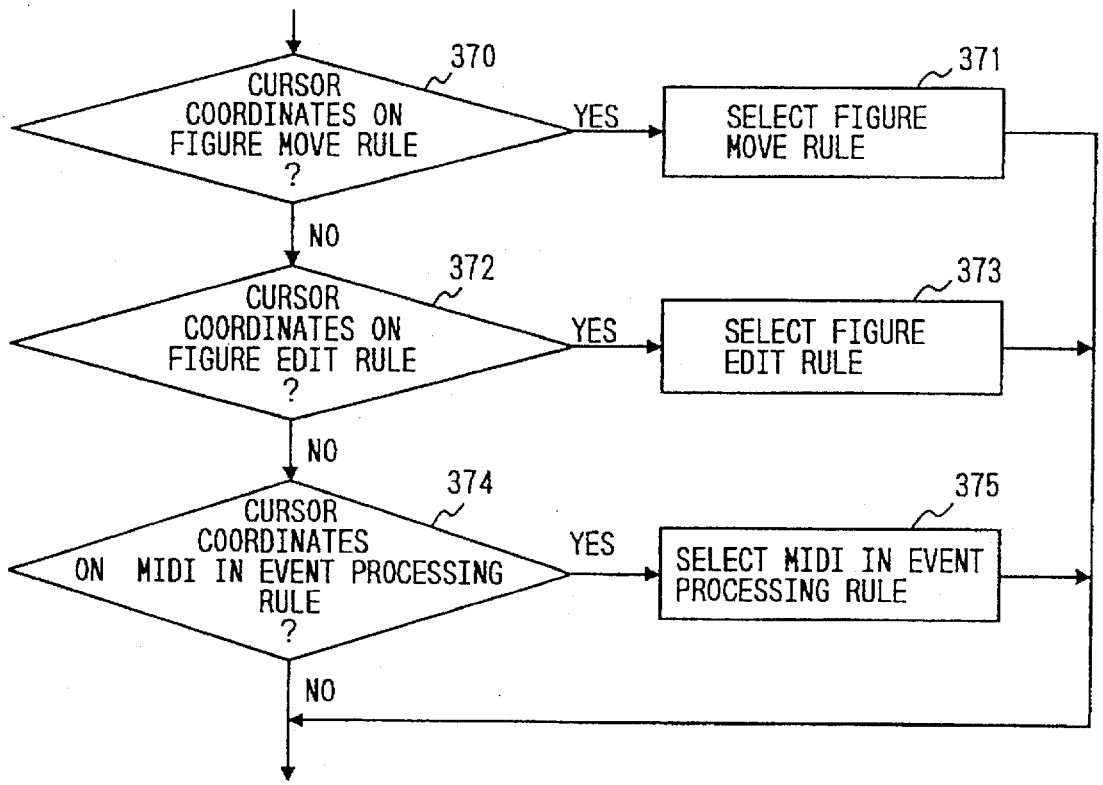
FIG. 8(*a*) is a flow chart of a Rule Select routine included in one embodiment of the method of the present invention.

FIG. 8(*a*) shows the Rule Select routine 283. The Rule Select routine selects the designated rule from among the Figure Move rules, Figure Edit rules, and MIDI-In Event Processing rules. As shown in FIG. 8(*a*), when Step 370 detects that the cursor is on the figure move rule button 203-1, a pop-up menu as shown in FIG. 8(*b*) is displayed, and the user selects one of these figure move rules at Step 371, and the identification number of the selected rule is recorded as "AnimMode". When Step 372 detects that the cursor is on the figure edit rule button 203-2, a pop-up menu as shown in FIG. 8(*c*) is displayed, and the user selects one of these figure edit rules at Step 373, and the identification number of the selected rule is recorded as "EditMode". When Step 374 detects that the cursor is on the MIDI In event processing Rule button 203-3, a pop-up menu as shown in FIG. 8(*d*) is displayed, and the user selects one of these MIDI-In event processing rules at Step 375, and the identification number of the selected rule is recorded as "MidiInMode".

Figures 9A, 9B:
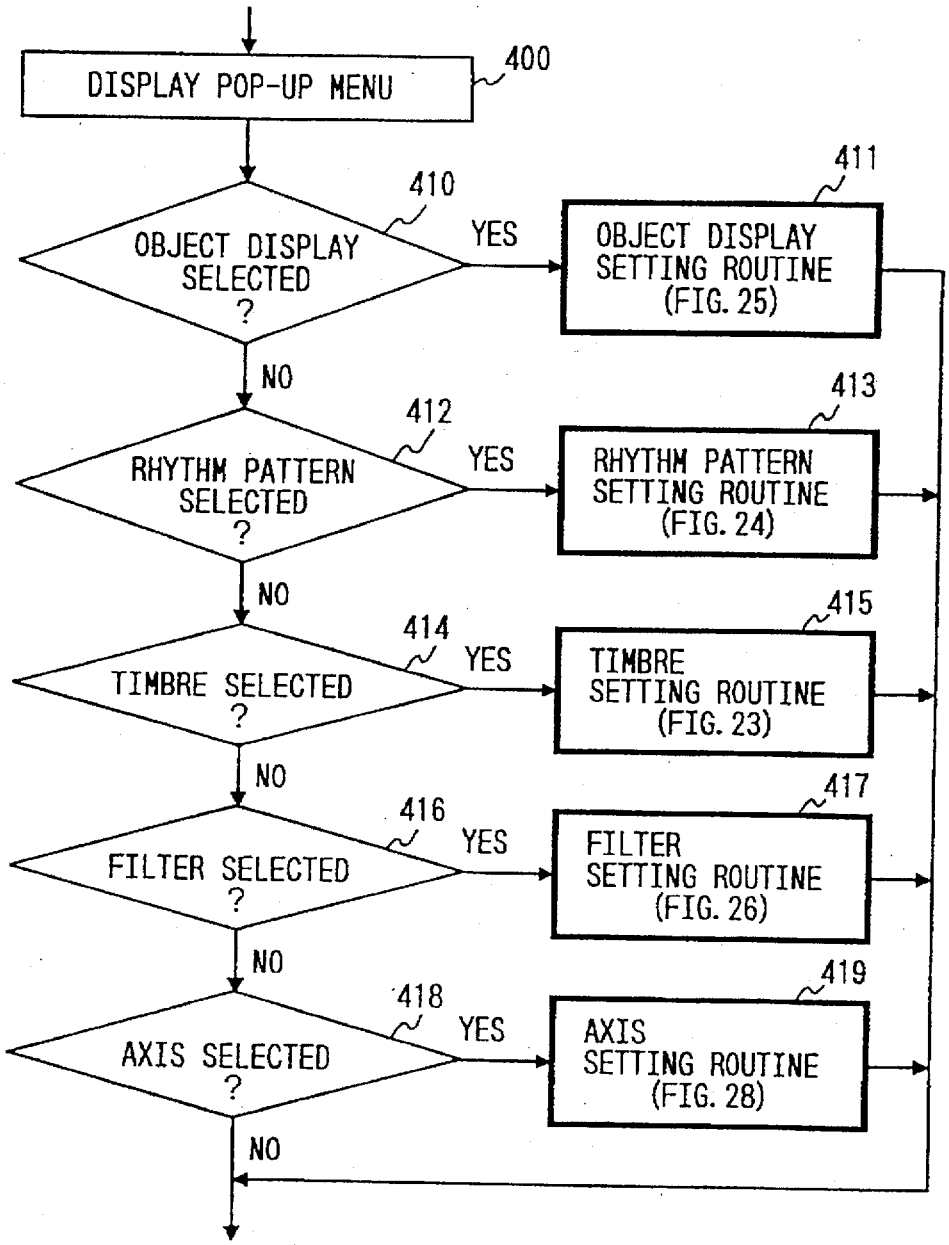
FIG. 9(*a*) is a flow chart of a Setting routine included in one embodiment of the method of the present invention.

FIG. 9(*a*) shows the Setting routine 285. The Setting routine sets various parameters relating to figures and playing. With reference to FIG. 9(*a*), step 400 displays a pop-up menu as shown in FIG. 9(*b*), and the user selects the parameter to be set. When Step 410 detects that "OBJECT DISPLAY" is selected, an Object Display Setting routine 411 operates and the user sets parameters relating to the figure to be displayed. When Step 412 detects that "RHYTHM PATTERN" is selected, a Rhythm Pattern Setting routine 413 operates and the user sets parameters relating to the rhythm pattern. When Step 414 detects that "TIMBRE" is selected, a Timbre Setting routine 415 operates and the user sets parameters relating to the timbre. When Step 418 detects that "AXIS" is selected, an Axis Setting routine 419 operates and the user sets the axes along which the sound pitch, sound intensity, and other sound attributes are represented.

Figure 10:
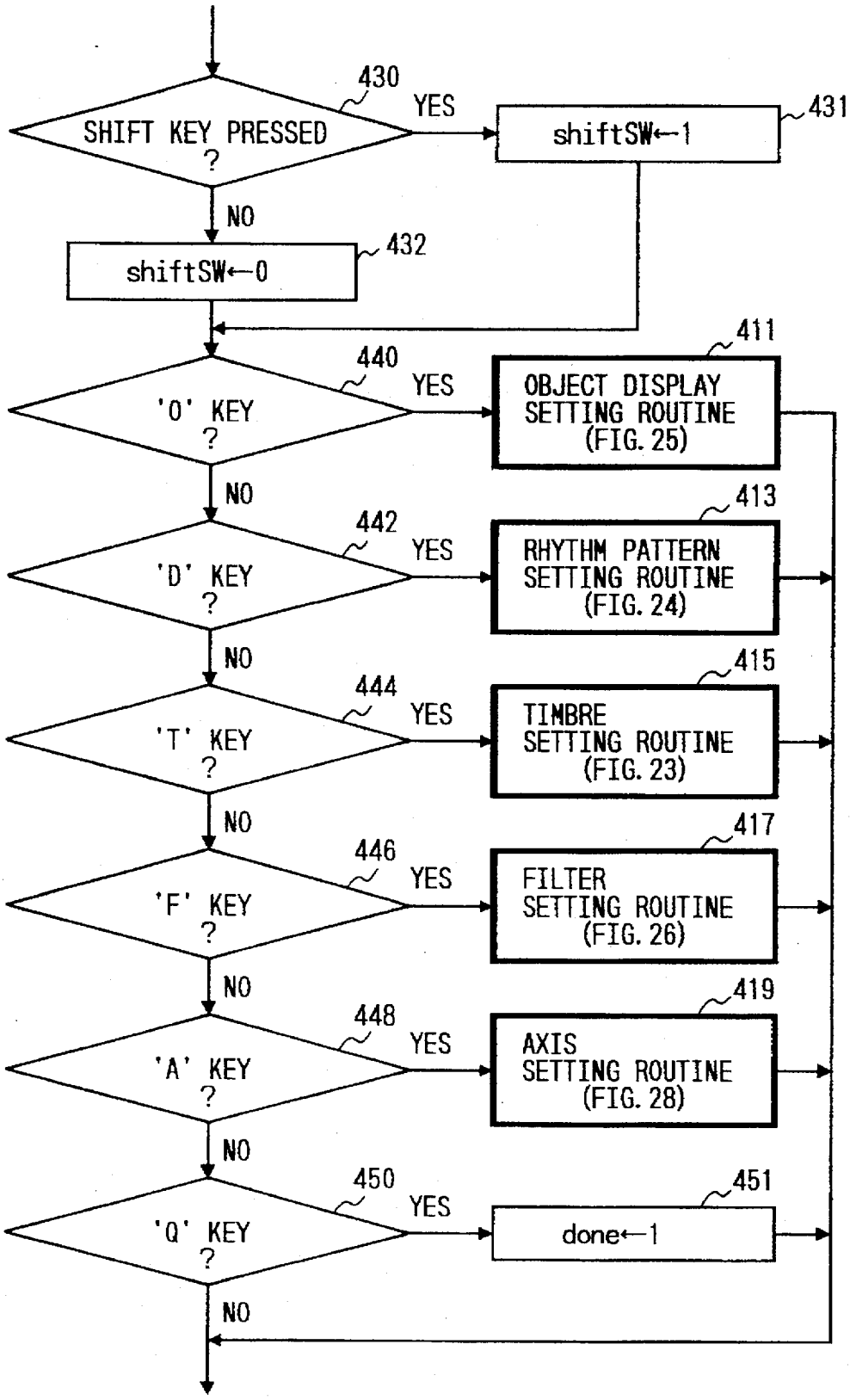
FIG. 10 is a flow chart of a Keyboard Event Processing routine included in one embodiment of the method of the present invention.

FIG. 10 shows the Keyboard Event Processing routine 244. The Keyboard Event Processing routine executes processing according to inputs from the keyboard. When Step 430 detects that a certain key and the shift key are pressed at the same time, Step 431 substitutes "1" for "shiftSW". When Step 430 fails to detect that the shift key is pressed, Step 432 substitutes "0" for "shiftSW". When Step 440 detects that the [O] key is pressed, the Object Display Setting routine 411 operates. When Step 442 detects that the [D] key is pressed, the Rhythm Pattern Setting routine 413 operates. When Step 444 detects that the [T] key is pressed, the Timbre Setting routine 415 operates. When Step 446 detects that the [F] key is pressed, the Filter Setting routine 417 operates. When Step 448 detects that the [A] key is pressed, the Axis Setting routine 419 operates. When Step 450 detects that the [Q] key is pressed, Step 451 substitutes "1" for "done". In this embodiment, the [Q] key is used as an end key.

Figure 11:
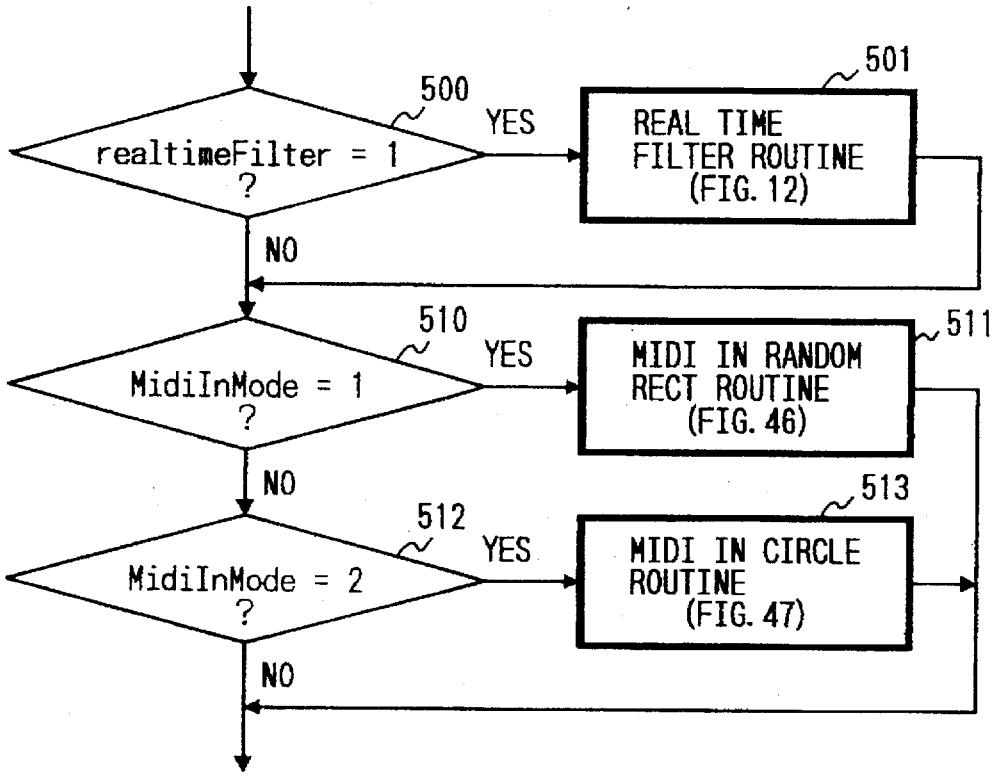
FIG. 11 is a flow chart of an MIDI-In Processing routine included in one embodiment of the method of the present invention.

FIG. 11 shows the MIDI-In Processing routine 157. The MIDI-In Processing routine executes processing according to the play information which is inputted from the electronic musical instrument 104 outside the computer. When Test 500 detects that "realtimeFilter" is "1", a Real-Time Filter routine 501 updates the filter for tonality or others. When Test 510 detects that "MidiInMode" is "1", a MIDI-In Random Rect routine 511 updates the position of a figure according to the Random Rect rule and displays the figure. When Test 512 detects that "MidiInMode" is "2", a MIDI-In Circle routine 513 updates the position of a figure according to the Circle rule and displays the figure.

Figure 12:
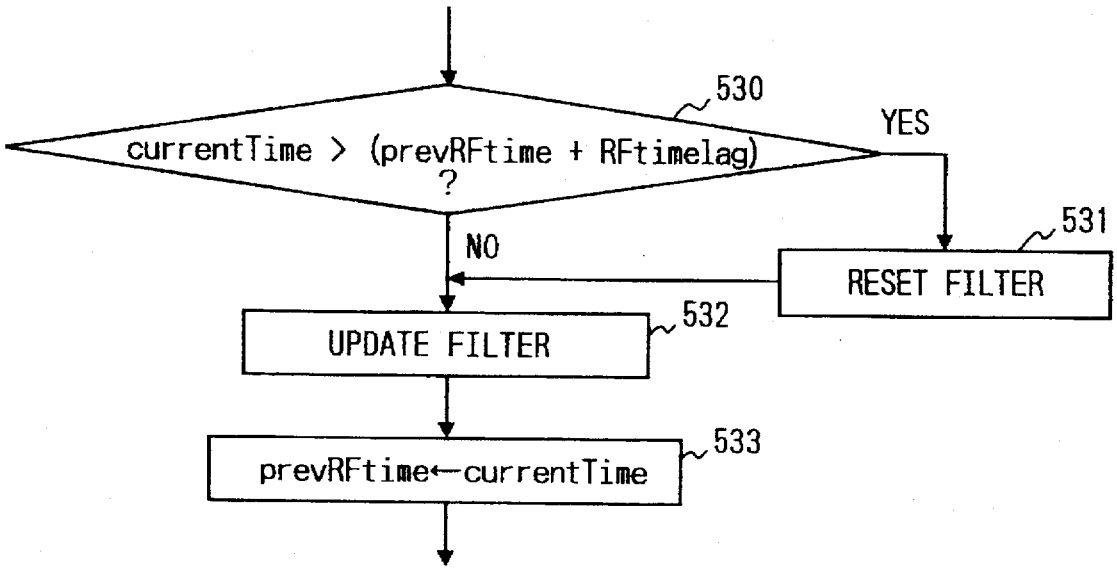
FIG. 12 is a flow chart of a Real-Time Filter routine included in one embodiment of the method of the present invention.

FIG. 12 shows the Real-Time Filter routine 501. The Real-Time Filter routine updates the wide range filter ("wFilter") and octave filter ("oFilter") sequentially according to the key number which is inputted from the external electronic musical instrument 104. When Test 530 detects that the current time "currentTime" which is measured from play start is larger than the sum of "prevRFtime" and "RFtimelag", Step 531 resets the filter. Regardless of the test result, Step 532 updates the filter according to the inputted key number. Step 533 substitutes "currentTime" for "prevRFtime".

Figure 13:
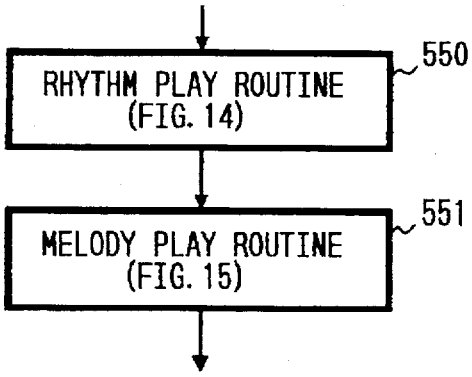
FIG. 13 is a flow chart of a Play routine included in one embodiment of the method of the present invention.

FIG. 13 shows the outline of the Play routine 159. The Play routine consists of a Rhythm Play routine 550 for outputting the rhythm pattern play information and a melody play routine 551 for outputting the melody play information.

Figure 14:
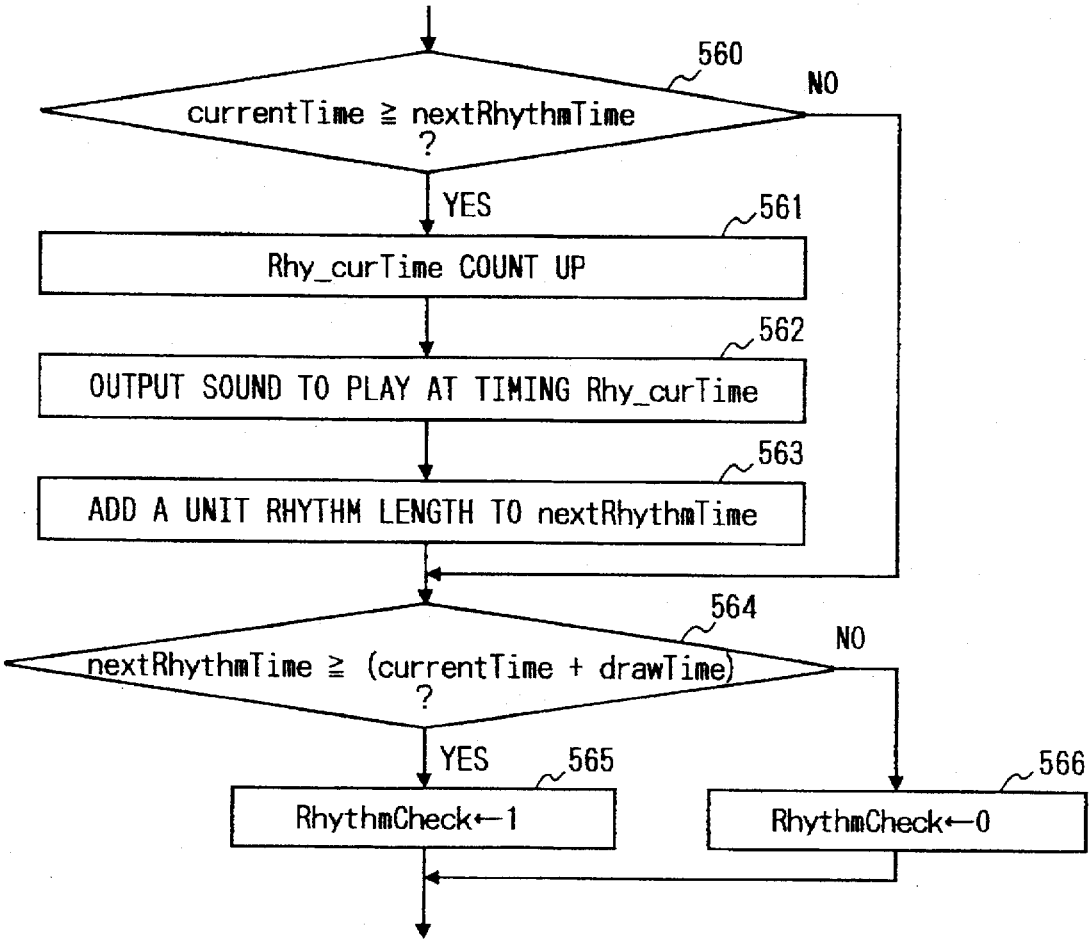
FIG. 14 is a flow chart of a Rhythm Play routine included in one embodiment of the method of the present invention.

The Rhythm Play routine 550 is shown in FIG. 14 in detail. The Rhythm Play routine sends the rhythm pattern play information by the percussion such as a drum to the external electronic musical instrument 104 via a MIDI (Musical Instrument Digital Interface). When Test 560 detects that the current time "currentTime" which is measured from play start is larger than "nextRhythmTime", the processing at Step 561 and the subsequent steps is executed. When the current time is not larger than "nextRhythmTime" a jump to Step 564 is caused. Step 561 counts up "Rhy_curTime". Step 562 sends the information of sounds in the rhythm pattern which is to be played in the timing of "Rhy_curTime" to the electronic musical instrument 104. Step 563 adds one unit length of rhythm to "nextRhythmTime". When Test 564 detects that "nextRhythmTime" is larger than the sum of "currentTime" and "drawTime" Step 565 substitutes "1" for "RhythmCheck". When "nextRhythmTime" is not larger than the sum, Step 566 substitutes "0" for "RhythmCheck".

Figure 15:
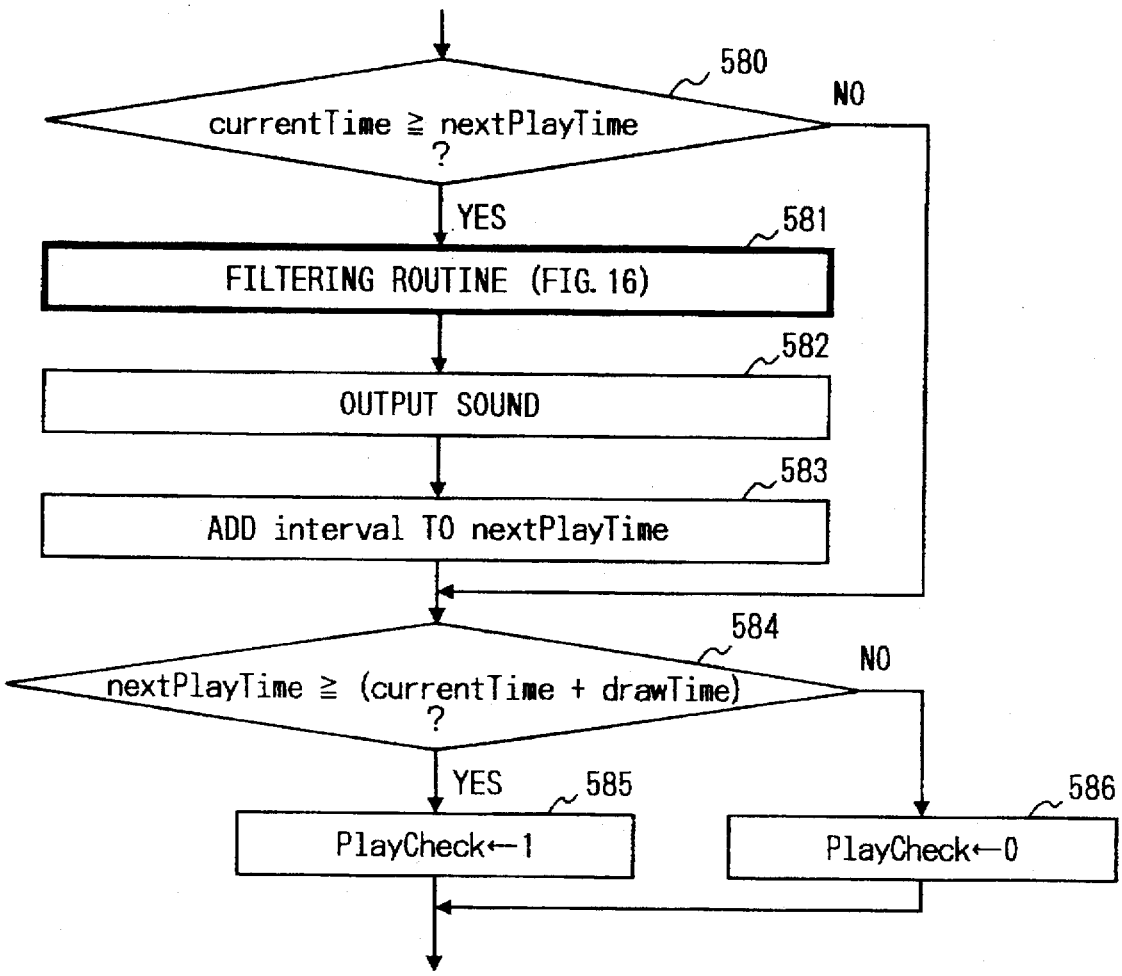
FIG. 15 is a flow chart of a Melody Play routine included in one embodiment of the method of the present invention.
Figure 16:
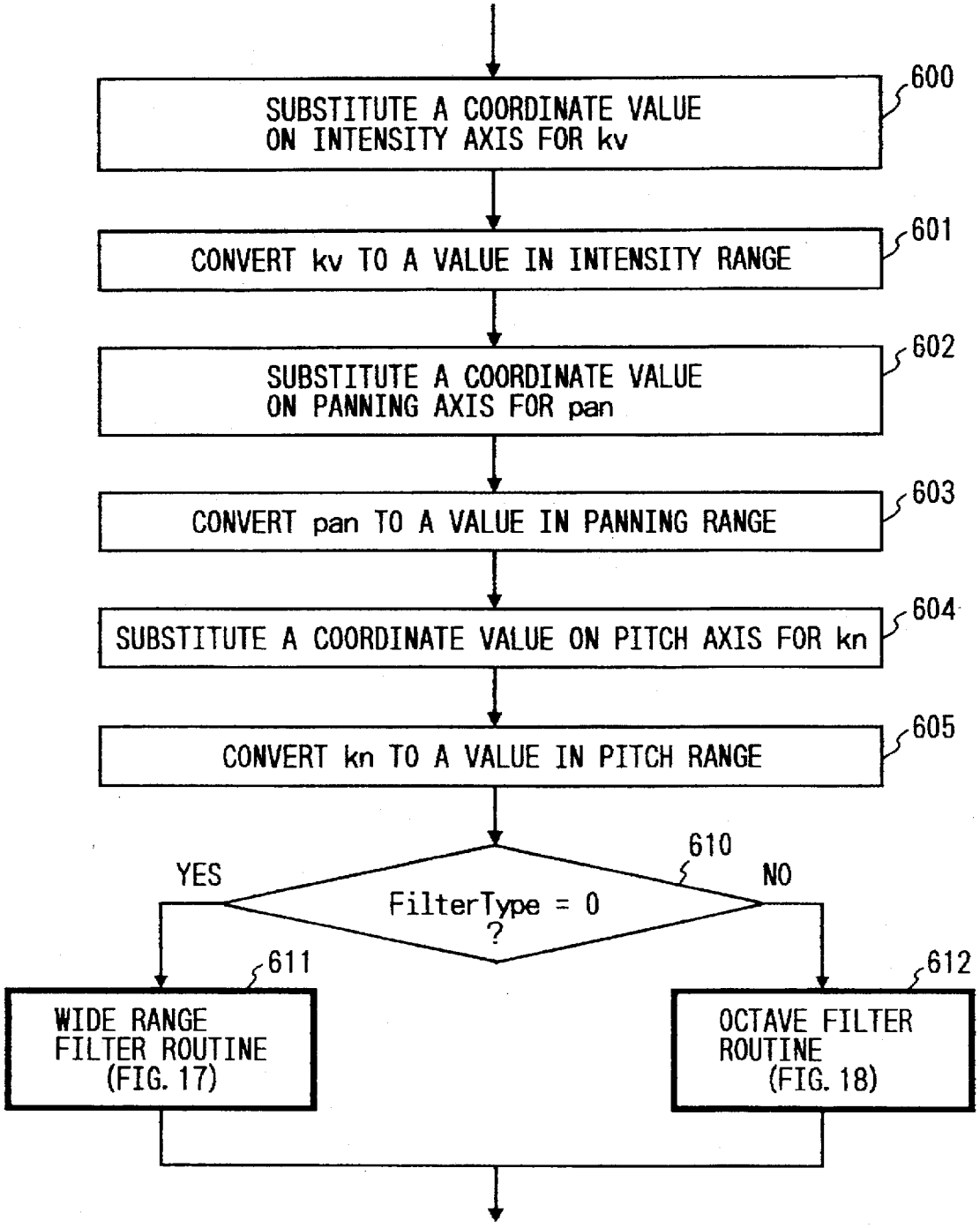
FIG. 16 is a flow chart of a Filtering routine included in one embodiment of the method of the present invention.

The Melody Play routine 551 is shown in FIG. 15 in detail. The Melody Play routine sends play information for the melody and others except the rhythm pattern to the external electronic musical instrument 104. When Test 580 detects that the current time "currentTime" which is measured from play start is larger than "nextPlayTime", the processing at Step 581 and the subsequent steps is executed. When the current time is not larger than "nextPlayTime", a jump to Step 584 is caused. The Filtering routine 581 filters the sound pitch which is determined from the figure display position so as to adjust the tonality. Step 582 sends a signal indicating the sound pitch which is settled by the above filtering, sound intensity, panning, and others to the electronic musical instrument 104. Step 583 adds "interval" which indicates an interval between a sound and a sound to "nextPlayTime". When Test 584 detects that "nextPlayTime" is larger than the sum of "currentTime" and "drawTime", Step 585 substitutes "1" for "PlayCheck". When "nextPlayTime" is not larger than the sum, Step 586 substitutes "0" for "PlayCheck". FIG. 16 shows the Filtering routine 581. The Filtering routine filters the sound pitch which is determined from the figure display position so as to adjust the tonality. Step 600 substitutes the coordinate on the sound intensity axis of the figure which is identified by "SelPartcile" for the sound intensity (key velocity) "kv". Step 601 converts the value of "kv" to a corresponding value in the sound intensity range. Step 602 substitutes the coordinate of the figure on the panning axis for the panning "pan". Step 603 converts the value of "pan" to a corresponding value in the panning range. Step 604 substitutes the coordinate of the figure on the sound pitch axis for the sound pitch (key number) "kn". Step 605 converts the value of "kn" to a corresponding value in the sound pitch range. Step 610 checks whether "FilterType" is "0" or not. When "FilterType" is "0", a Wide Range Filter routine 611 is activated. When "FilterType" is not "0", an Octave Filter routine 612 is activated.

Figure 17:
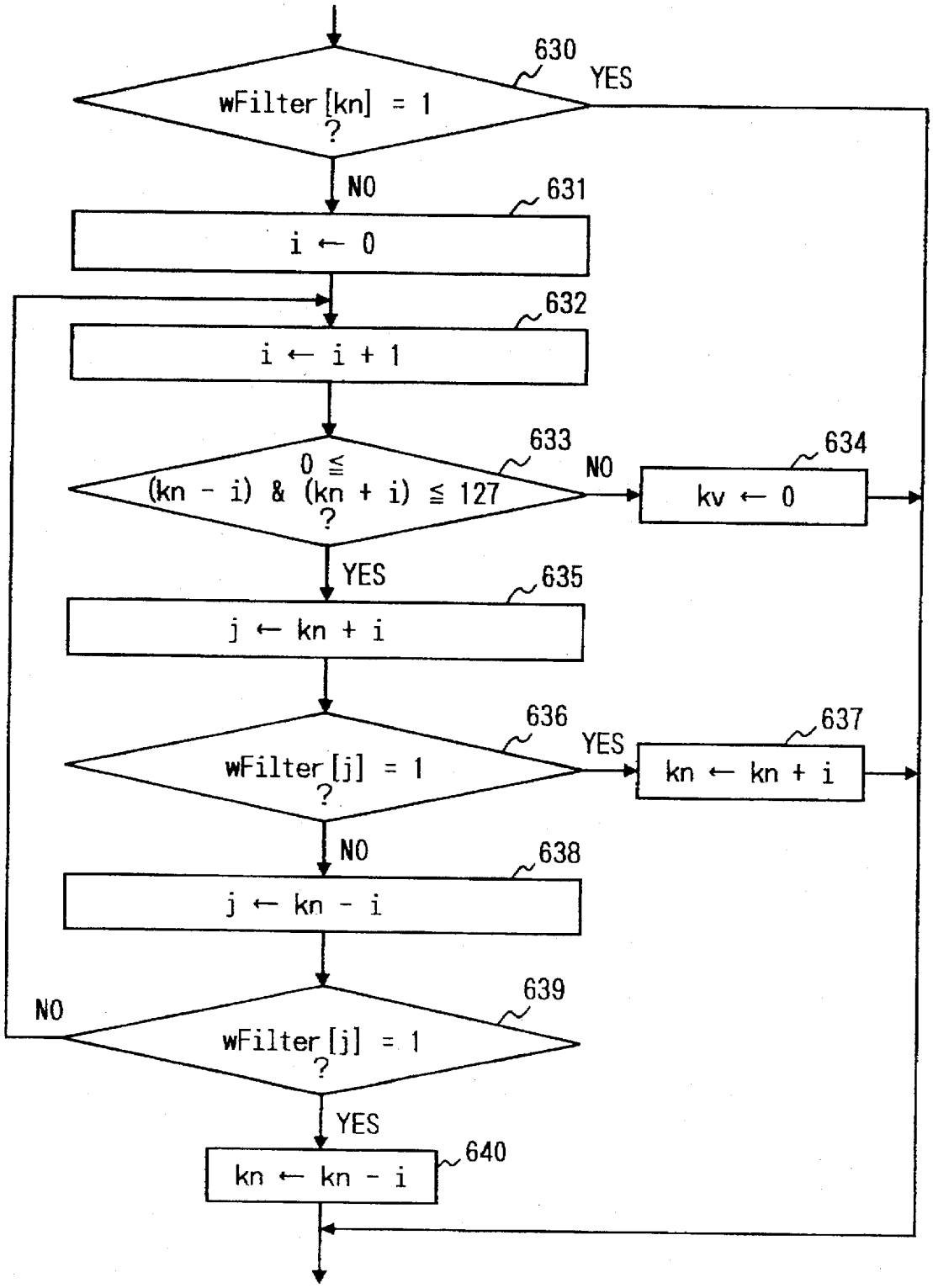
FIG. 17 is a flow chart of a Wide Range Filter routine included in one embodiment of the method of the present invention.

The Wide Range Filter routine 611 is shown in FIG. 17 in detail. The Wide Range Filter routine adjusts the tonality in the whole pitch range and determines the sound pitch "kn". Step 630 checks the "kn"th entry of the wide range filter set value "wFilter". When the entry value is "1", the processing ends. When the entry value is not "1", the processing at Step 631 and the subsequent steps is executed. Step 631 substitutes "0" for "i". Step 632 counts up "i". When Test 633 detects that "kn-i" is "0" or more and "kn+i" is "127" or less, the processing at Step 635 and the subsequent steps is executed. When the values are not as mentioned above, Step 634 substitutes "0" for the sound intensity "v", and the processing ends. Step 635 substitutes "ikn+i" for "j". When Step 636 detects that the "j"th entry of "wFilter" is "1", Step 637 substitutes "kn+i" for the sound pitch "kn", and the processing ends. On the other hand, if the "j"th entry is not "1", Step 638 substitutes "kn-i" for "j", and Step 639 checks the "j"th entry of "wFilter". When the entry value is "1", Step 640 substitutes "kn-i" for the sound pitch "kn", and the processing ends. When the entry value is not "1", the processing returns to Step 632.

Figure 18:
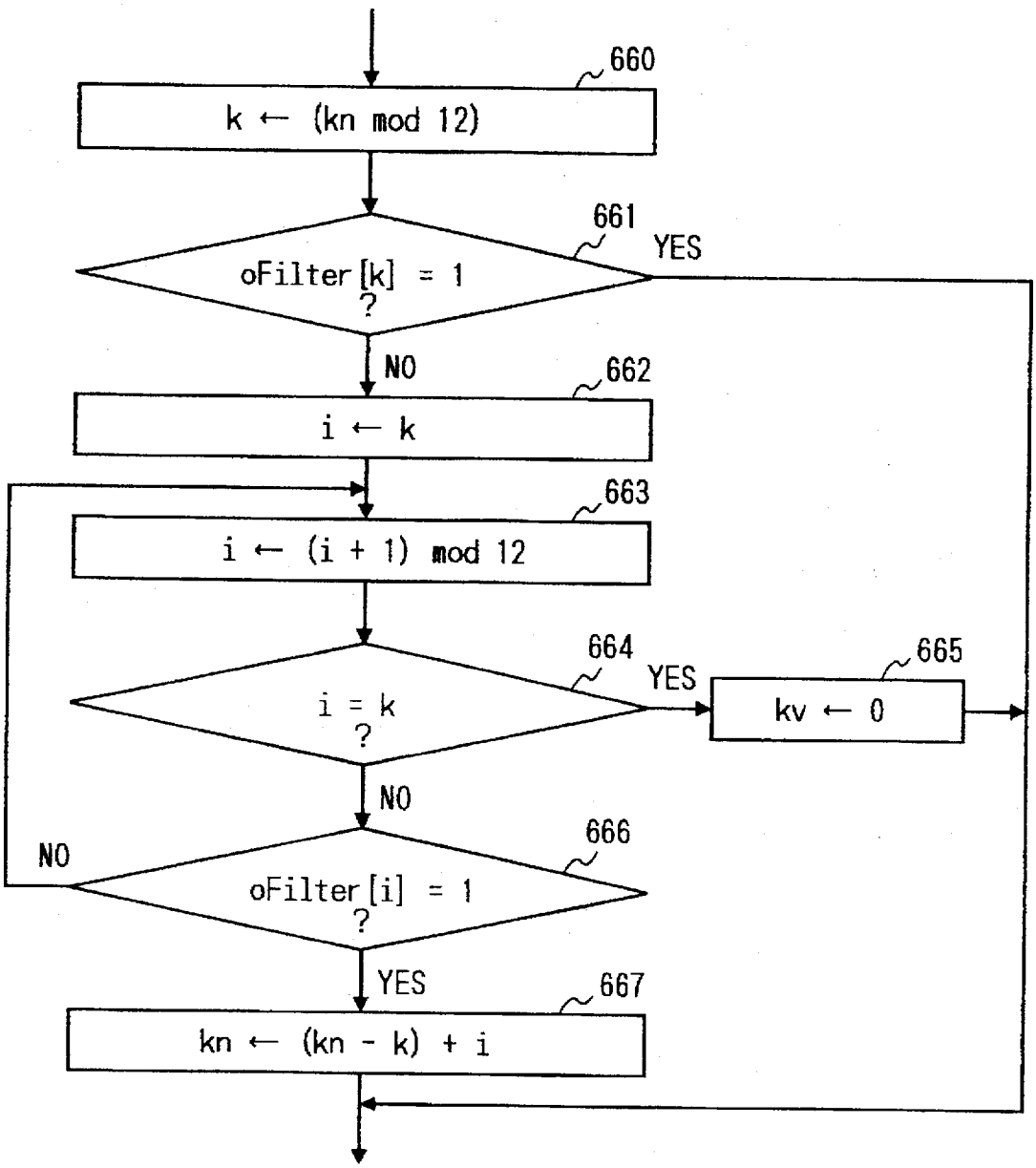
FIG. 18 is a flow chart of an Octave Filter routine included in one embodiment of the method of the present invention.

The Octave Filter routine 612 is shown in FIG. 18 in detail. The Octave Filter routine adjusts the tonality in the whole pitch range according to the filter characteristic which is designated for an octave, and determines the sound pitch "kn". Step 660 substitutes the remainder when "kn" is divided by "12" for "k". Step 661 checks the "k"th entry of the octave filter set value array "oFilter". When the entry value is "1", the processing ends. When the entry value is not "1", the processing at Step 662 and the subsequent steps is executed. Step 662 substitutes "k" for "i" Step 663 substitutes the remainder when "i+1" is divided by "12" for "i". When Step 664 detects that "i" is equal to "k", Step 665 substitutes "0" for the 5 sound intensity "kv", and the processing ends. When "i" is not equal to "k" and Step 666 detects that the "i"th entry of "oFilter" is "1", Step 667 substitutes "(kn-k)+i" for the sound pitch "kn", and the processing ends. When the "i"th entry is not "1", the processing at Step 663 and the subsequent steps is repeated.

Figure 19:
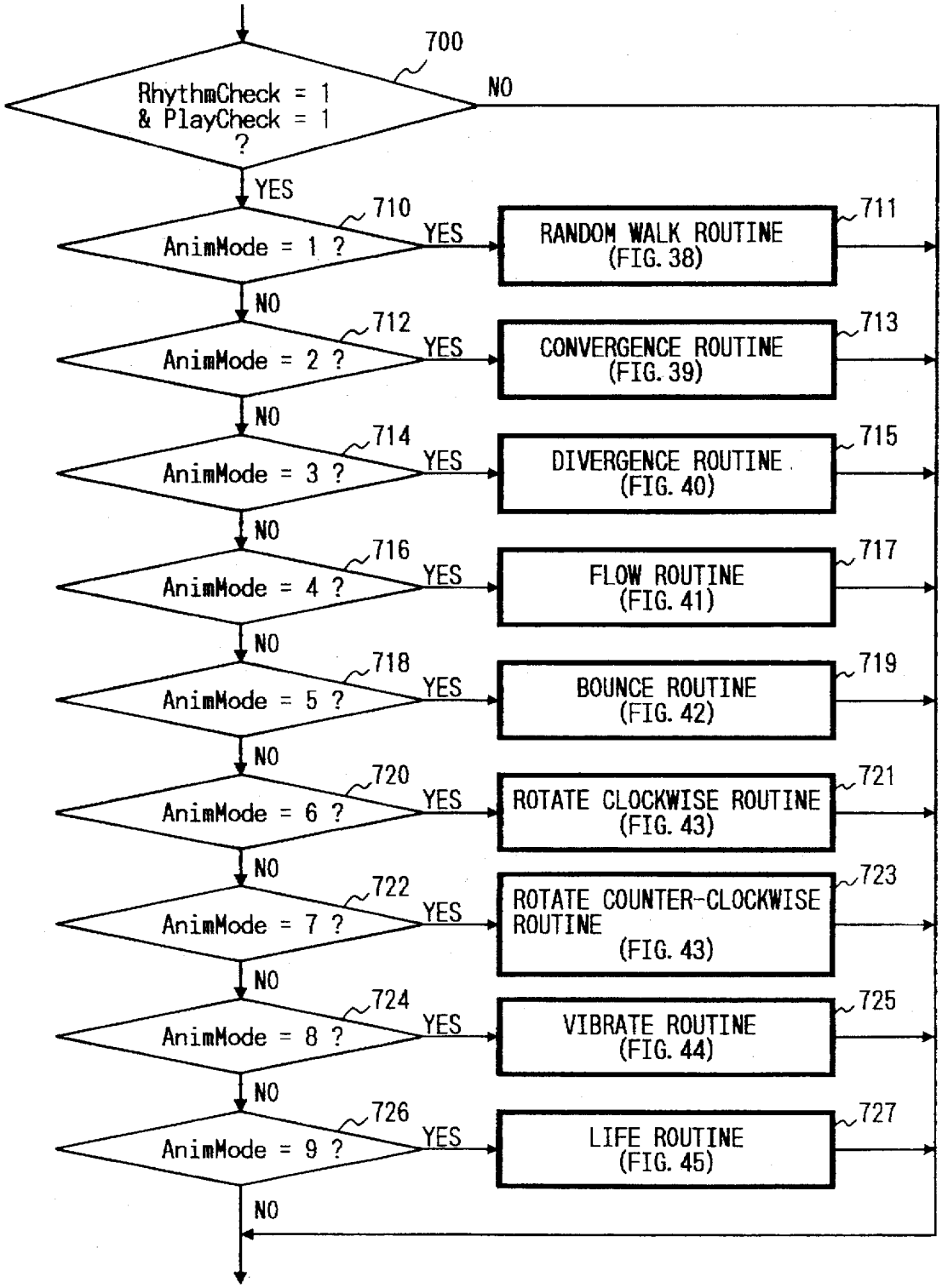
FIG. 19 is a flow chart of a Figure Move routine included in one embodiment of the method of the present invention.

FIG. 19 shows the Figure Move routine 158 in detail. The Figure Move routine changes the position of a displayed figure or figures so as to produce an animation. When Step 700 detects that both "RhythmCheck" and "PlayCheck" which are determined by the Rhythm Play routine and Melody Play routine are "1", the processing at Step 710 and the subsequent steps is executed. When both the values are not "1", the processing ends. When Test 710 detects that "AnimMode" is "1", a Random Walk routine 711 is executed. When Test 712 detects that "AnimMode" is "2", a Convergence routine 713 is executed. When Test 714 detects that "AnimMode" is "3", a Divergence routine 715 is executed. When Test 716 detects that "AnimMode" is "4", a Flow routine 717 is executed. When Test 718 detects that "AnimMode" is "5", a Bounce routine 719 is executed. When Test 720 detects that "AnimMode" is "6", a Rotate clockwise routine 721 is executed. When Test 722 detects that "AnimMode" is "7", a Rotate counter-clockwise routine 723 is executed. When Test 724 detects that "AnimMode" is "8", a Vibrate routine 725 is executed. When Test 726 detects that "AnimMode" is "9", a Life routine 727 is executed. The variable "AnimMode" is set in the Rule Select routine (FIG. 8).

Figure 20:
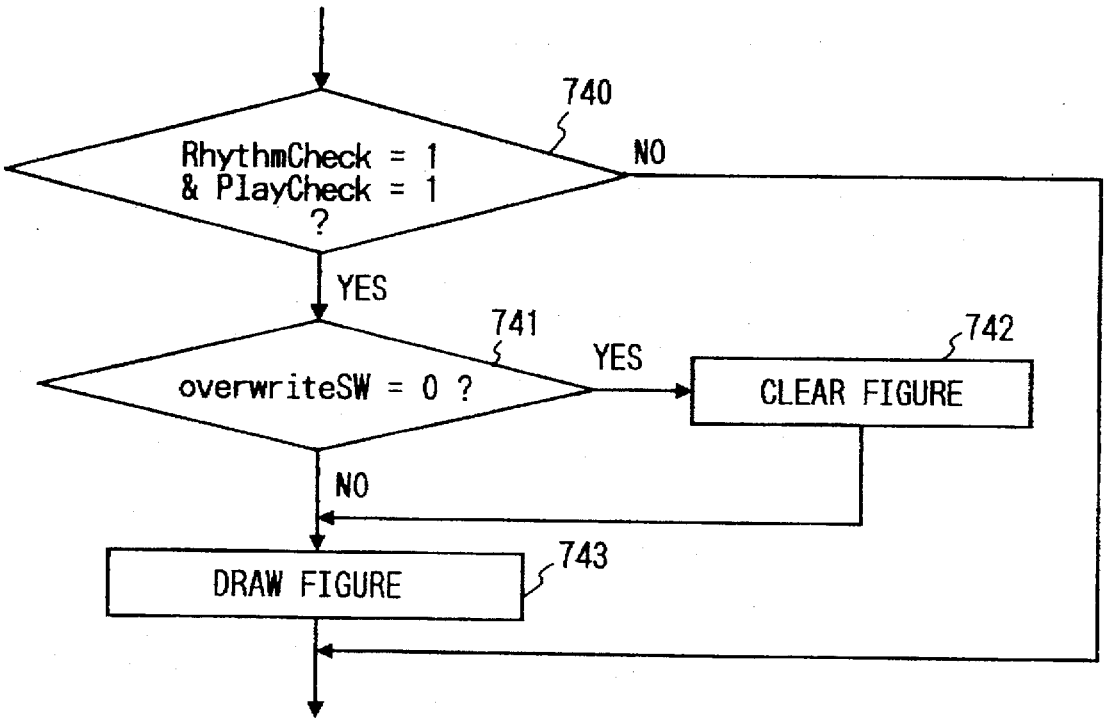
FIG. 20 is a flow chart of a Figure Display routine included in one embodiment of the method of the present invention.
Figure 21A:
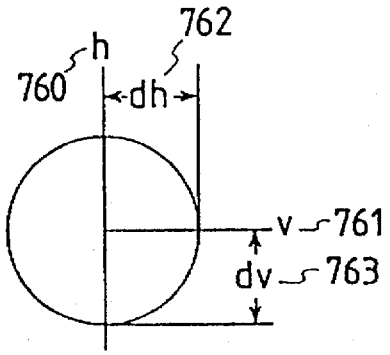
FIG. 21(*a*) is a graphical representation showing how a figure drawing process is performed when the figure is a wire frame and the relevant shape is a circle or ellipse, in accordance with the method of the present invention.
Figure 21B:
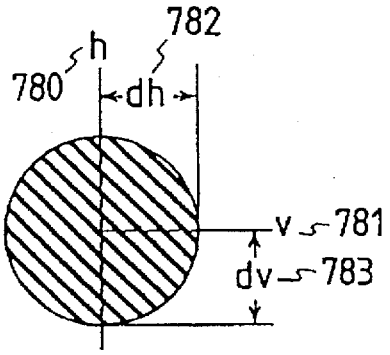
Figure 21C:
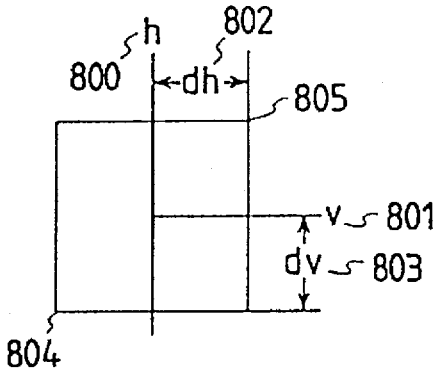
Figure 21D:
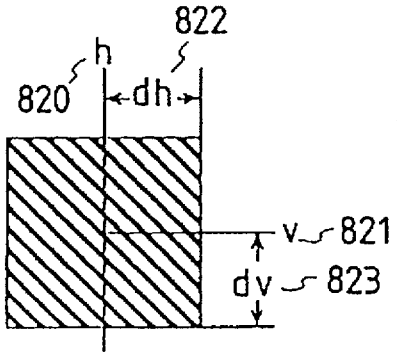
Figure 22A:
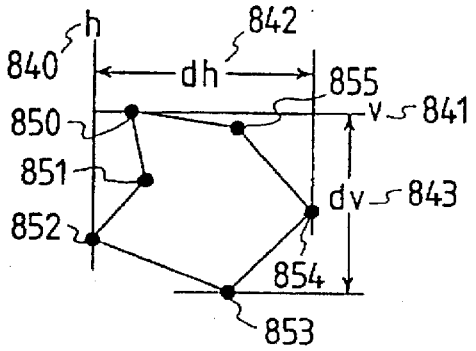
FIG. 22(*a*) is a graphical representation showing how a figure drawing process is performed when the figure is a wire frame and the relevant shape is a two-dimensional polygon, in accordance with the method of the present invention.
Figure 22B:
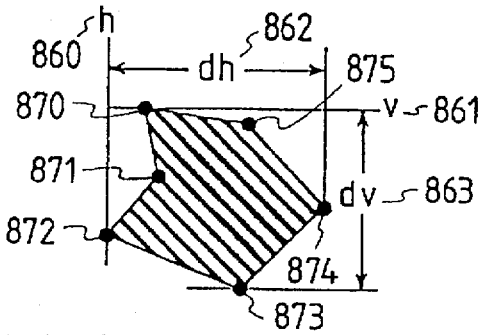
Figure 22C:
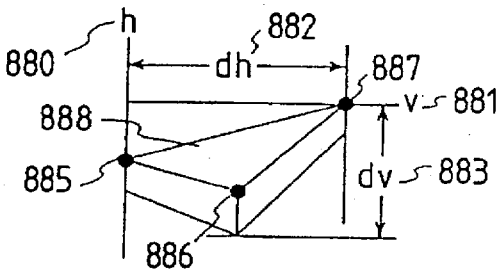
Figure 22D:
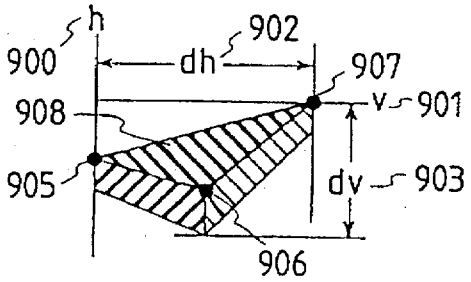
Figure 22E:
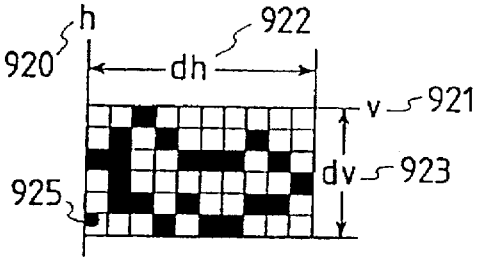

FIG. 20 shows the Figure Display routine 160. The Figure Display routine draws figures on the figure display panel 201. When Step 740 detects that both "RhythmCheck" and "PlayCheck" which are determined by the Rhythm Play routine (FIG. 14) and the Melody Play routine (FIG. 15) are "1", the processing at Step 741 and the subsequent steps is executed. When both the values are not "1", the processing ends. When Test 741 detects that "overwrite" is "0", Step 742 clears the area of the previous display position of the figure to be drawn by overlaying it by the background color or background pixel pattern. Step 743 draws the figure to be drawn in the display position which is newly determined. As a result, if "overwrite" is set to "O" by the user, the figure moves simply. When "overwrite" is not set to "0", the figure is displayed both in the new and old positions, that is, the figure is copied in the new position.

The figure drawing process is illustrated in FIGS. 21(*a*) to 21(*d*) and 22(*a*) to 22(*e*). A figure is drawn on the figure display panel 201 on the basis of the shape, size, and color which are selected by the user.

When the figure is a wire frame and the shape is a circle or ellipse, the horizontal coordinate 760 and vertical coordinate 761 of the center are substituted for "h" and "v", respectively, as shown in FIG. 21(*a*). The horizontal axis radius 762 and vertical axis radius 763 are substituted for "dh" and "dv", respectively. As a result, a wire frame of an ellipse with a horizontal axis radius "dh" and vertical axis radius dv centered at a point (h,v) is drawn in the predetermined color on the figure display panel. When the figure shape is a circle or ellipse and the color is designated, "h" 780, "v" 781, "dh" 782, and "dv" 783 are set in the same way as with a wire frame as shown in FIG. 21(*b*), and an ellipse which is defined by these values is drawn on the figure display panel with the inside colored as designated.

When the figure is a wire frame and the shape is a rectangle, "h" 800, "v" 801, "dh" 802, and "dv" 803 are set in the same way as with an ellipse as shown in FIG. 21(*c*). As a result, a wire frame of a rectangle having the line segment connecting points (h–dh,v–dv) 804 and (h+dh,v+dv) 805 as a diagonal line is drawn on the figure display panel in the predetermined color. When the figure shape is a rectangle and the color is designated, "h" 820, "v" 821, "dh" 822, and "dv" 823 are set in the same way as with a wire frame with reference to FIG. 21(*d*), and a rectangle which is defined by these values is drawn on the figure display panel with the inside colored as designated.

When the figure is a wire frame and the shape is a two-dimensional polygon, a horizontal coordinate 840 at the leftmost of the figure and a vertical coordinate 841 at the uppermost are substituted for "h" and "v", respectively, as shown in FIG. 22(*a*). A horizontal dimension 842 and a vertical dimension 843 are substituted for "dh" and "dv", respectively. The coordinates of every vertex of the polygon are interpolated so that the maximum horizontal coordinate difference and the maximum vertical coordinate difference become "dh" and "dv", respectively, and then the line connecting all the vertexes (850, 851, 852, 853, 854, 855, 850) is drawn on the figure display panel. When the figure shape is a two-dimensional polygon and the color is designated, the coordinates of each vertex of the polygon are interpolated in the same way as with a wire frame as shown in FIG. 22(*b*), and the area enclosed by the line connecting all the vertexes is drawn on the figure display panel in the designated color.

When the figure is a wire frame and the shape is a three-dimensional polyhedron, a horizontal coordinate 880 at the leftmost of the figure and a vertical coordinate 881 at the uppermost are substituted for "h" and "v", respectively, as shown in FIG. 22(*c*). A horizontal dimension 882 of the figure and a vertical dimension 883 are substituted for "dh" and "dv" respectively. The coordinates of each vertex of the polyhedron which can be seen when the polyhedron is projected onto a two-dimensional surface are interpolated so that the maximum horizontal coordinate difference and the maximum vertical coordinate difference become "dh" and "dv", respectively, and then the sides of each face are drawn on the figure display panel. When the figure shape is a three-dimensional polyhedron and the color is designated, the coordinates of each vertex are interpolated in the same way as with a wire frame as shown in FIG. 22(*d*), and the brightness of each face is calculated from the predetermined position of the light source, and then a shaded polyhedron is drawn on the figure display panel.

When the figure is an arbitrary two-dimensional dot pattern, a horizontal coordinate 920 at the leftmost of the figure and a vertical coordinate 921 at the uppermost are substituted for "h" and "v" respectively as shown in FIG. 22(*e*). A horizontal dimension 922 of the figure and a vertical dimension 923 are substituted for "dh" and "dv" respectively. The horizontal dimension and vertical dimension of the dot pattern are enlarged or reduced to "dh" and "dv" respectively, and the obtained figure is drawn on the figure display panel.

Figure 23:
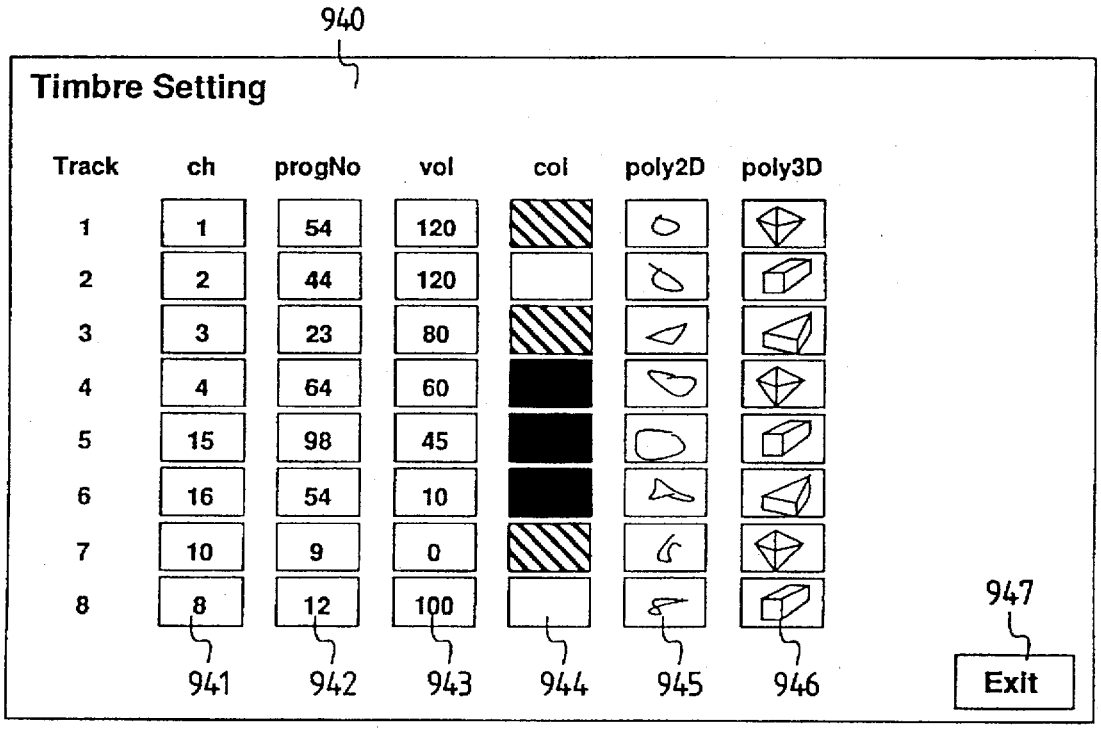
FIG. 23 is a diagram of a timbre setting screen generated in accordance with one embodiment of the method of the present invention.

The Timbre Setting routine 415 will be explained with reference to FIG. 23. In the Timbre Setting routine, parameters such as timbre, standard sound intensity, and others are set. Firstly, a screen 940 as shown in the drawing is displayed on the display 102. Figures are assigned to Tracks 1 to 8 and stored in "Particle[i].track", respectively, in which "i" indicates the identification number of each figure. A column 941 indicates the MIDI channel of each track. The user sets the channel number of each track using the mouse and keyboard, and the channel numbers are stored in "Timbre[t].ch", in which "t" indicates the track number (from 1 to 8). A column 942 indicates the timbre number (program number) of each track. The user sets the program number of each track using the mouse and keyboard, and the program numbers are stored in "Timbre[t].progNo". A column 943 indicates the standard sound intensity (volume) of each track. The user sets the volume of each track using the mouse and keyboard, and the volumes are stored in "Timbre[t].vol". A column 944 indicates the figure color assigned to each track. The user sets a color for each track using the mouse and keyboard, and the colors are stored in "Timbre[t].col". A column 945 indicates the shape of the two-dimensional polygon (inclusive of a circle) assigned to each track. The user sets the shape of a two-dimensional polygon for each track using the mouse and keyboard and the two-dimensional polygons are stored in "Timbre[t].2dPolyNo". A column 946 indicates the shape of the three-dimensional polyhedron assigned to each track. The user sets the shape of a three-dimensional polyhedron for each track using the mouse and keyboard, and the three-dimensional polyhedrons are stored in "Timbre[t].3dPolyNo". A button 947 is an exit button. When this button is selected, the Timber Setting routine ends and the screen returns to the initial screen as shown in FIG. 2.

Figure 24:
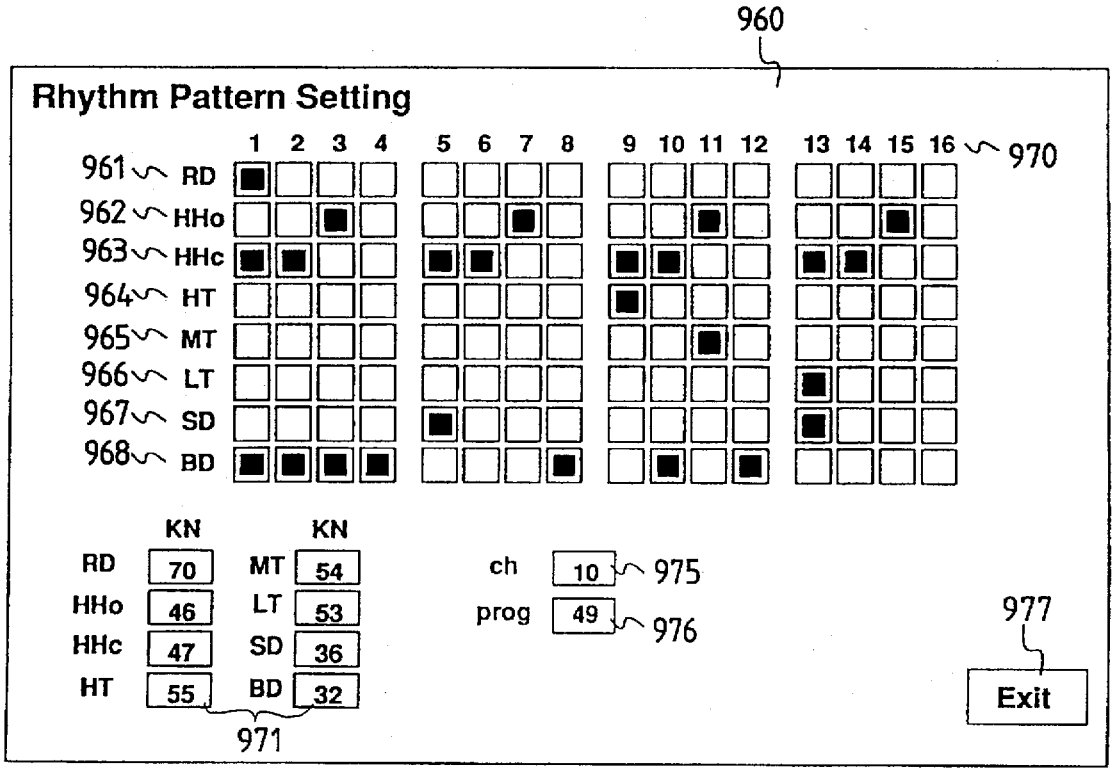
FIG. 24 is a diagram showing a rhythm pattern setting screen generated in accordance with one embodiment of the method of the present invention.
Figure 25A:
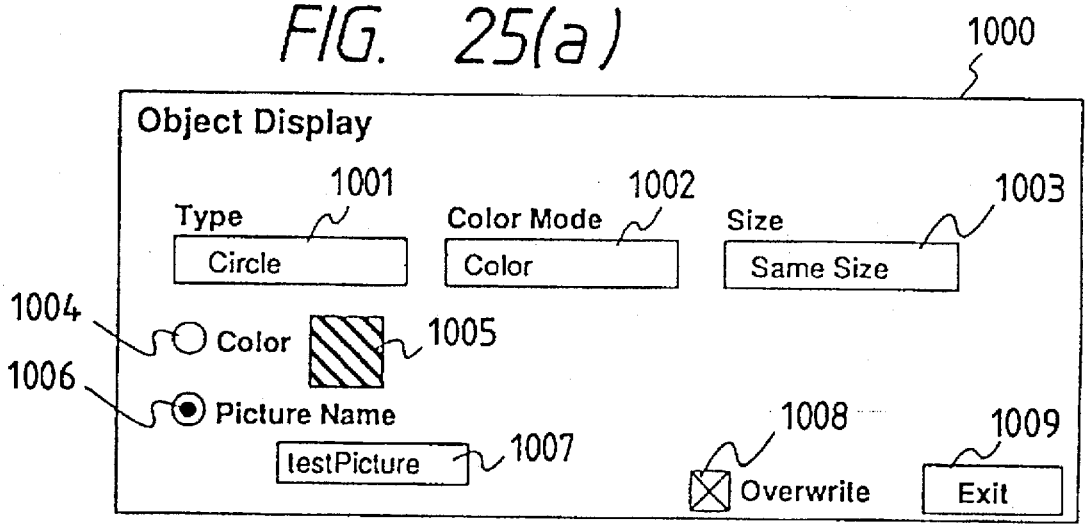
FIG. 25(*a*) is a diagram showing a figure display setting screen generated in accordance with one embodiment of the method of the present invention.
Figure 25B:
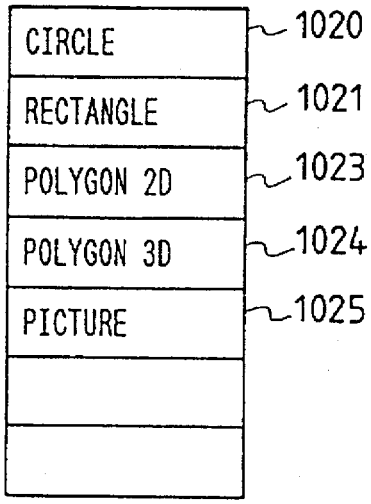
Figure 25C:
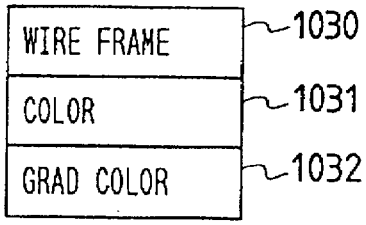
Figure 25D:
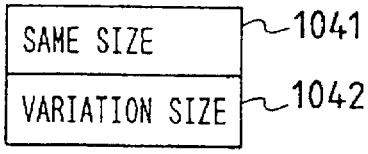

The Rhythm Pattern Setting routine 413 will be explained with reference to FIG. 24. In the Rhythm Pattern Setting routine, the rhythm pattern by the percussion such as a drum and the timbre of each percussion instrument are set. Firstly, a screen 960 as shown in the drawing is displayed on the display 102. The matrix displayed in the upper half of the screen 960 indicates a rhythm score. The line corresponds to the kind of percussion instrument and the column corresponds to the time step "RhY curTime" (970). The kinds of instrument include, for example, ride cymbal 961, hi hat cymbal open 962, hi hat cymbal close 963, hi tom 964, middle tom 965, low tom 966, snare drum 967, and bass drum 968. The user marks the instruments to be played in the timing at each time step on the matrix using the mouse. In the drawing, each black rectangle indicates such a marking. A button row 971 is used to set the key number corresponding to the sound pitch of each instrument and a button 975 is used to set the MIDI channel of the electronic musical instrument 104 in which each instrument is set. The user sets these numerical values using the mouse and keyboard. A button 977 is an exit button. When this button is selected, the Rhythm Pattern Setting routine ends, and the screen returns to the initial screen as shown in FIG. 2.

The Object Display Setting routine 411 will be explained with reference to FIG. 25(*a*) to 25(*d*). In the Object Display Setting Processing routine, parameters relating to figure display are set. Firstly, a screen 1000 as shown in FIG. 25(*a*) is displayed on the screen. A button 1001 is used to select the shape type of a figure to be displayed. When this button is selected by the mouse, a pop-up menu as shown in FIG. 25(*b*) is displayed and the user selects the desired shape type. In this embodiment, CIRCLE 1020, RECTANGLE 1021, POLYGON 2D (2-dimensional polygon) 1023, POLYGON 3D (3dimensional polygon) 1024, or PICTURE (dot pattern picture) 1025 can be selected. The display methods for these figures were explained with reference to FIGS. 21 and 22. A button 1002 is used to select the color mode. When this button is selected by the mouse, a pop-up menu as shown in FIG. 25(*c*) is displayed and the user selects the desired color mode. In this embodiment, the WIRE FRAME 1030, COLOR 1031, or GRAD COLOR (gradating color) 1032 can be selected. A button 1003 is a button for selecting the size mode. When this button is selected by the mouse or others, a pop-up menu as shown in FIG. 25(*d*) is displayed and the user selects the desired size mode. In this embodiment, SAME SIZE mode 1041 in which all figures are equal in size or VARIATION SIZE mode 1042 in which figures are different in size can be selected. Buttons 1004 to 1007 are used to set parameters relating to the display background. Either color 1004 or dot pattern picture 1006 can be selected as a background. In the case of color, a specific color 1005 is designated, and in the case of dot pattern picture, a desired picture file name 1007 is designated. A button 1008 is used to set "overwrite" to "1" or 0'. The relationship between the value of "overwrite" and figure processing was explained with reference to FIG. 20. A button 1009 is an exit button. When this button is selected, the Object Display Setting routine ends and the screen returns to the initial screen as shown in FIG. 2.

Figure 26A:
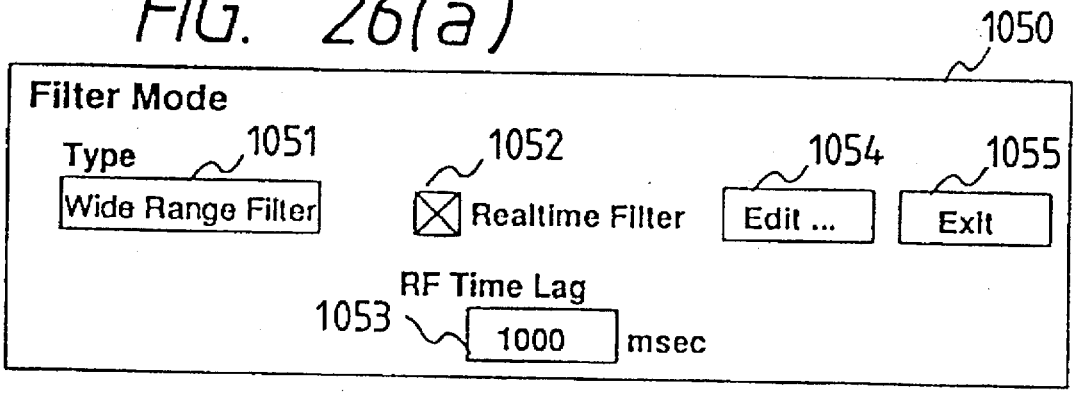
FIG. 26(*a*) is a diagram showing a filter setting screen generated in accordance with one embodiment of the method of the present invention.
Figure 26B:
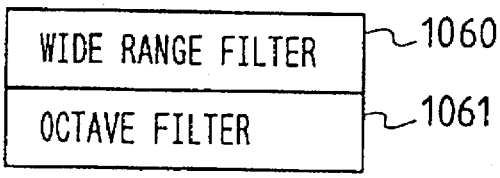

The Filter Setting routine 417 will be explained with reference to FIG. 26(*a*) and 26(*b*). In the Filter Setting routine, parameters relating to the filter are set. Firstly, a screen 1050 as shown in FIG. 26(*a*) is displayed on the display 102. A button 1051 is a filter type setting button. When this button is selected by the mouse, a pop-up menu as shown in FIG. 26(*b*) is displayed and the user selects either WIDE RANGE FILTER 1060 or OCTAVE FILTER 1061. When WIDE RANGE FILTER is selected, "O" is substituted for "FilterType". When OCTAVE FILTER" is selected, "1" is substituted for it. A button 1052 is a real-time filter button. When this button is selected, "1" is substituted for "realtime Filter". A button 1053 is used to set a variable "RFtimeLag" which is effective when the real time filter is used. A button 1054 is used to set the filter more particularly. When this button is selected, a filter setting screen as shown in FIG. 27 is displayed according to the filter type. A button 1055 is an exit button. When this button is selected, the Filter Setting routine ends and the screen returns to the initial screen as shown in FIG. 2.

The Octave Filter Setting routine and Wide Range Filter Setting routine will be explained with reference to FIG. 27(*a*) to 27(*f*). When the button 1054 is selected in FIG. 26(*a*) and "FilterType" is "1", an octave filter setting screen 1070 as shown in FIG. 27(*a*) is displayed on the display 102. A button 1071 is arranged keyboard-like and indicates the state of the octave filter. When an octave filter variable "oFilter[i]" is "1", a reversed small circle is displayed on the image of the corresponding key. A symbol "i" assumes a value between "0" and "11", representing do., do.#, ret, re.#, ml., fat, fa.#, so., so.#, la., la.#, and si, respectively. Buttons 1072 and 1073 are a decrement button and an increment button, respectively. When these buttons are selected, the filter is shifted. When a button 1080 is selected, input from the keyboard of the external electronic music instrument 104 is made possible. Assuming that the key number inputted from the electronic musical instrument is "kn", the remainder when "kn". is divided by "12" is substituted for "i" and "1" is substituted for "oFilter[i]". Buttons 1085 to 1089 are used to input a chord name. The octave filter is set according to this chord name. When the button 1085 is selected by the mouse, a pop-up menu as shown in FIG. 27(*c*) is displayed and the root of chord is selected by the user. When the button 1086 is selected, a pop-up menu as shown in FIG. 27(*d*) is displayed and the type of chord is selected by the user. When an item 1115 is selected, a new definition is given by the user. When the button 1087 is selected, a pop-up menu as shown in FIG. 27(*e*) is displayed and the ornamental information for chord is selected. A button 1090 is used to select a filter by name. When this button is selected, a pop-up menu as shown in FIG. 27(*b*) is displayed and the filter having the name which is selected from this menu is set. A button 1095 is an exit button. When this button is selected, the Octave Filter Setting routine ends, and the screen returns to the screen shown in FIG. 26(*a*). On the other hand, when "FilterType" is "0" and the button 1054 shown in FIG. 26(*a*) is selected, the Wide Range Filter Setting routine operates. Firstly, a wide range filter setting screen 1120 as shown in FIG. 27(*f*) is displayed on the display 102. A button 1121 is arranged keyboard-like and indicates the state of the wide range filter. When a wide range filter variable "wFilter[i]" is "1", a reversed small circle is displayed on the image of the corresponding key. A symbol "i" assumes a value between "0" and "127". Buttons 1123 and 1124 are a decrement button and an increment button, respectively. When these buttons are selected, the filter is shifted. When a button 1125 is selected, input from the keyboard of the external electronic music instrument 104 is made possible. Assuming that the key number inputted from the electronic musical instrument is "kn", "1" is substituted for "wFilter[kn]". Buttons 1126 to 1129 have functions which are similar to those of the buttons 1090 and 1085 to 1087 on the octave filter setting screen (*a*). A button 1130 is a root setting button. For sounds lower than a mark 1122, only "wFilter" for the sound which is selected by the button 1130 is set to "1". For sounds higher than the mark 1122, the sound which is designated by a chord name is used. A button 1135 is an exit button. When this button is selected, the Wide Range Filter Setting routine ends and the screen returns to the screen shown in FIG. 26(*a*).

Figure 28:
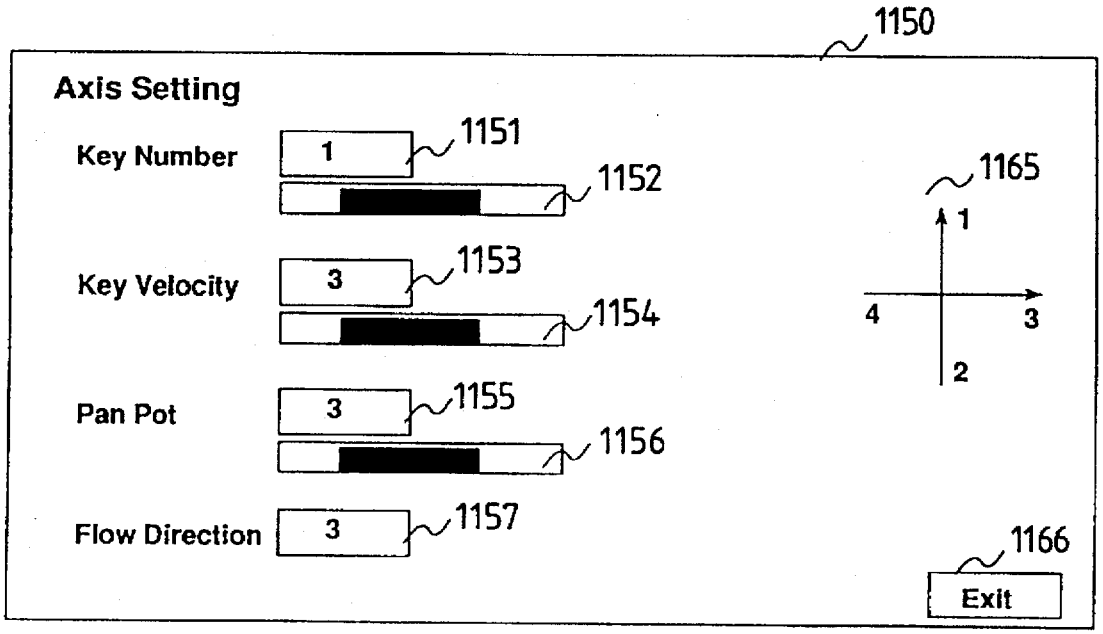
FIG. 28 is a diagram showing an axis direction setting screen generated in accordance with one embodiment of the method of the present invention.

The Axis Setting routine 419 will be explained with reference to FIG. 28. In the Axis Setting routine, parameters relating to the direction of axes for sound pitch, sound intensity, pan pot, and the like are set. Firstly, a screen 1150 as shown in the drawing is displayed on the display 102. A button 1151 is used to set the axis direction "Axis.kn" of sound pitch (particularly key number) and the value is selected from the numbers "1" to "4". The number "1" indicates the upward direction, the number "2" the downward direction, the number "3" the rightward direction, and the number "4" the leftward direction (1165). A button 1152 is used to set the minimum value "Range.kn.min" and maximum value "Range.kn.max" of the key number range. A button 1153 indicates the axis direction "Axis.kv" of sound intensity (particularly key velocity) and the value is selected from the numbers "1" to "4". A button 1154 is used to set the minimum value "Range.kv.min" and maximum value "Range.kv.max" of the key velocity range. A button 1155 indicates the axial direction "Axis.pan" of pan pot and the value is selected from the numbers 1 to 4. A button 1156 is used to set the minimum value "Range.pan.min" and maximum value "Range.pan.max" of the pan pot range. A button 1157 indicates the axis direction "Axis.flow" to be used in the Flow routine which is executed when "AnimMode" is "4". A button 1166 is an exit button. When this button is selected, the Axis Setting routine ends and the screen returns to the initial screen as shown in FIG. 2.

Figure 29:
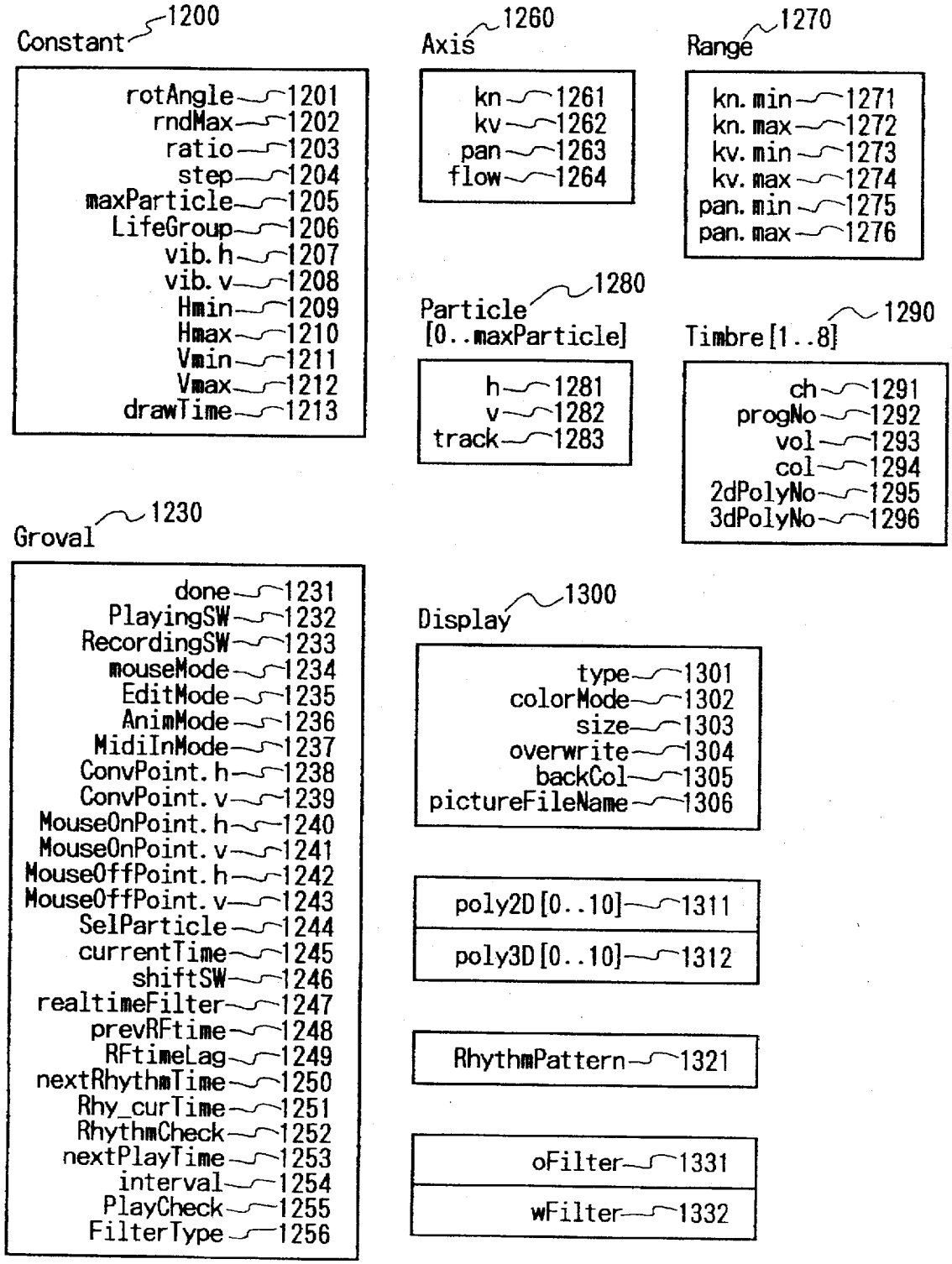
FIG. 29 is a diagram showing the contents of the data table generated in accordance with one embodiment of the method of the present invention.

Next, the data table 130 will be explained with reference to FIG. 29. The data table retains constants and variables which are used in various routines and FIG. 29 shows the main contents of the data table.

A Constant table 1200 is initialized when the program is started and retains constants which will not be updated until the program ends. "RotAngle" 1201 is an integer indicating the rotational angle of a figure, which is used in the Rotate clockwise routine and Rotate counter-clockwise routine which are called in the Figure Move routine. "rndMax" 1202 is the upper limit value of random numbers which are used in the Life routine and Random Walk routine which are called in the Figure Move routine. "ratio" 1203 is a real number which is used in the Convergence routine and Divergence routine which are called in the Figure Move routine. "step" 1204 is an integer which is used in the Flow routine which is called in the Figure Move routine. "maxParticle" 1205 indicates the number of figures. "LifeGroup" 1206 is an integer which is used in the Life routine which is called in the Figure Move routine. "vib.h" 1207 and "vib.v" 1208 are integers which are used in the Vibrate routine which is called in the Figure Move routine. "Hmin" 1209, "Hmax" 1210, "Vmin" 1211, and "Vmax" 1212 are the maximum values and minimum values of horizontal and vertical coordinates on the figure display panel. "drawTime" 1231 indicates the time reserved for drawing figures.

A Global table 1230 retains environmental variables which are necessary when the program is in operation. "done" 1231 is a variable for managing the end of the main loop (FIG. 3). "PlayingSW" 1232 is a variable for managing playing and recording. "RecordingSW" 1233 is a variable for managing recording of play information. "mouseMode" 1234 is a variable for managing the ON, OFF and other states of the mouse button. "EditMode" 1235 is a variable relating to the Figure Edit routine. "AnimMode" 1236 is a variable relating to the Figure Move routine. "MIDIInMode" 1237 is a variable relating to the MIDI-In Processing routine. "ConvPoint.h" 1238 and "ConvPoint.v" 1239 are integers which are used in the Convergence routine and Divergence routine which are called in the Figure Move routine. "MouseOnPoint.h" 1240, "MouseOnPoint.v" 1241, "MouseOffPoint.h" 1242, and "MouseOffPoint.v" 1243 are horizontal and vertical coordinates of the mouse when the mouse button is pressed and released. "SelParticle" 1244 is an integer indicating the figure number which is used in the Figure Move routine and Play routine. "currentTime" 1245 is a variable indicating the current time measured from play start, which is updated in the Time Read In routine. "shiftSW" 1246 is an integer which is used in the Keyboard Event Processing routine. "realtimeFilter" 1247 is an integer for managing whether or not to execute real-time filtering. "prevRFeime" 1248 is an integer for recording the time that the real-time filter is updated. "RFtimeLag" 1249 is an integer which is necessary for real-time filtering. "nextRhythmTime" 1250, "Rhy_curTime" 1251, and "RhythmCheck" 1252 are integers which are used in the Rhythm Play routine. "nextPlayTime" 1253, "interval" 1254, and "PlayCheck" 1255 are integers which are used in the Melody Play routine. "FilterType" 1256 is an integer which is used with respect the real-time filter.

An Axis table 1260 retains variables relating to the axis direction. "kn" 1261 indicates the axis direction of sound pitch (key number), and "kv" 1262 indicates the axis direction of sound intensity (key velocity), "pan" 1263 indicates the axis direction of pan pot, and "flow" 1264 indicates the axis direction which is used in the Flow routine which is called in the Figure Move routine. In the specification, "Axis." is prefixed to each of these variables, as in "Axis.kn".

A Range table 1270 retains variables indicating the ranges of sound intensity, sound pitch, and pan pot. "kn.min" 1271 and "kn.max" 1272 indicate the minimum value and maximum value of sound pitch (key number), respectively, and "kv.min" 1273 and "kv.max" 1274 indicate the minimum value and maximum value of sound intensity (key velocity), respectively, and "pan.min" 1275 and "pan.max" 1276 indicate the minimum value and maximum value of pan pot, respectively. In the specification, "Range." is prefixed to each of these variables, as in "Range.kn.min".

A Particle table 1280 retains arrays of variables relating to figures. The variables for each figure consists of "h" 1281, v 1282, and "track" 1283. "h" and "v" are integers indicating the horizontal and vertical coordinates, respectively, of the display position of a figure, and "track" is an integer indicating the track number to which the figure belongs. "Particle[i]." is prefixed to the variable for the "i"th figure, as in "Particle[i].h", in which "i" assumes an integer between "O" and "maxParticle" (maximum figure number).

A Timbre table 1290 retains arrays of variables relating to tracks. The variable for each track consists of an integer "ch" 1291 indicating the MIDI channel, an integer "progNo" 1292 indicating the timbre number, an integer "vol" 1293 indicating the sound intensity, an integer "col" 1294 indicating the display color, an integer "2dPolyNo" 1295 indicating the two-dimensional polygon number, and an integer "3dPolyNo" indicating the three-dimensional polyhedron number. "Timbre[i]." is prefixed to the variable for the "i"th track, as in "Timbre[i].ch", in which "i" assumes an integer between O and 8.

A Display table 1300 retains variables relating to the display of figures. "type" 1301 indicates the figure display type, and "colorMode" 1302 indicates the display color mode, and "size" 1303 indicates the display size mode, "overwrite" 1304 indicates simple movement or copy, and "backCol" 1305 indicates the background color, and "PictureFilename" 1306 indicates the file name of an image to be used for the background. In the specification, "display." is prefixed to each of these variables except "overwrite", as in "display.type".

"poly2D" 1311 is a variable array indicating the shapes of two-dimensional polygons. "poly3D" 1312 is a variable array indicating the shapes of three dimensional polyhedrons and "RhythmPattern" 1321 is a variable array indicating the rhythm pattern. "oFilter" 1331 indicates an array of 12 variables (from No. 0 to No. 11) indicating the octave filter, and "wFilter" 1332 indicates an array of 128 variables (from No. 0 to No. 127) indicating the wide range filter.

The Figure Edit routine and Figure Move routine will be explained in detail hereunder. In the following, the word "particle" will be used in the same meaning as "figure".

Figure 30A:
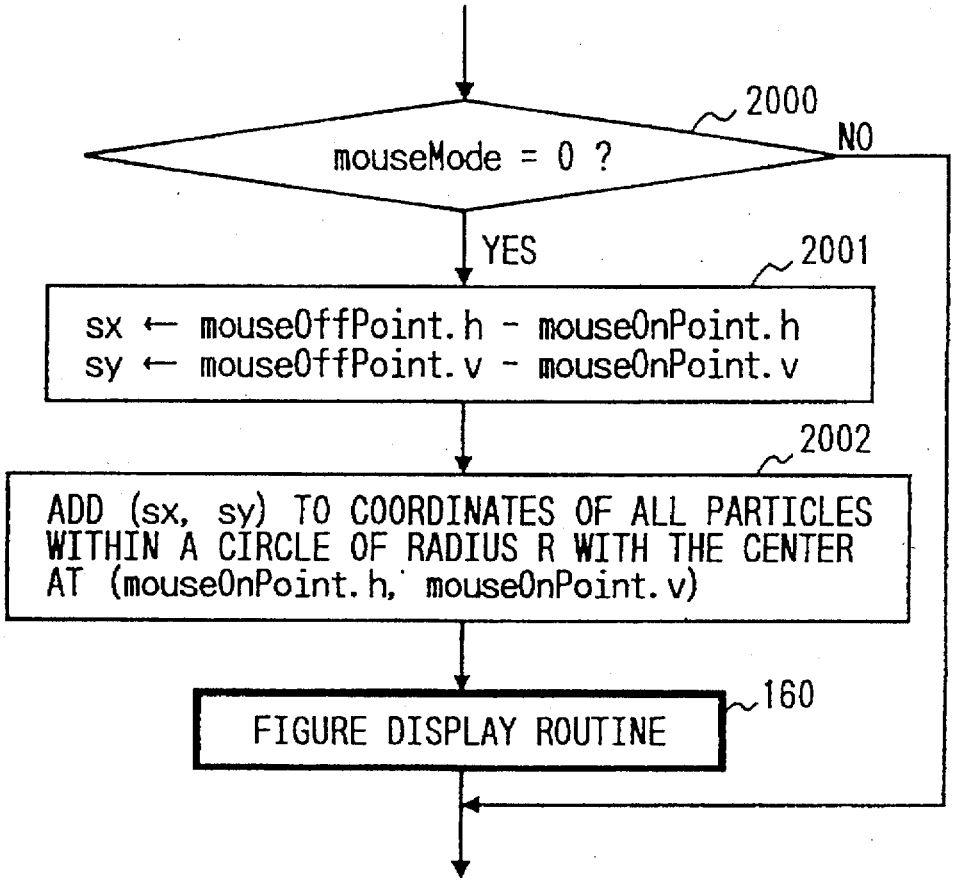
FIG. 30(*a*) is a flow diagram showing a Sweep routine in the Figure Edit routine included in one embodiment of the method of the present invention.
Figure 30B:
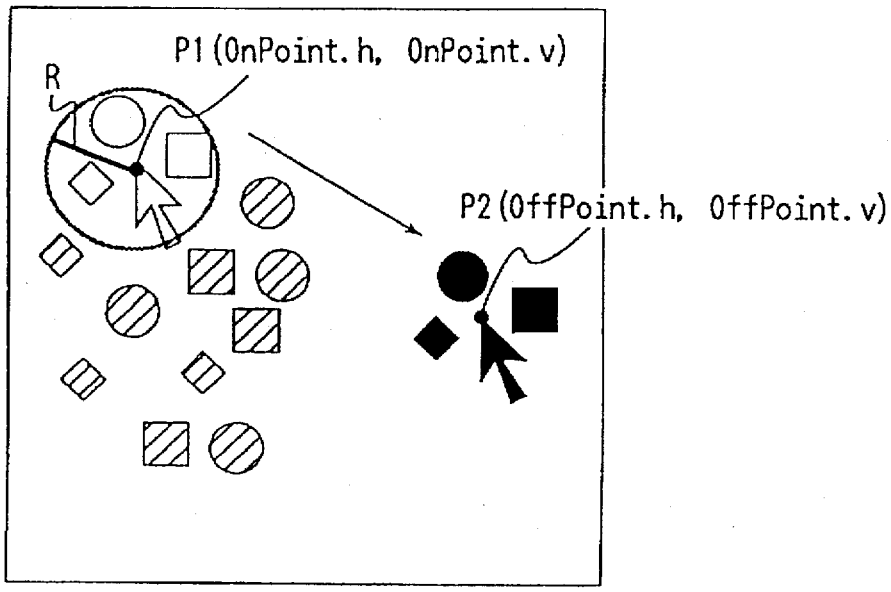

FIG. 30(*a*) shows the Sweep routine 301 which is called in the Figure Edit routine (FIG. 6). In FIG. 30(*b*), the white particles indicate particles before movement, and the black particles indicate particles after movement, and the hatched particles indicate particles which do not take part in movement. The white arrow mark indicates the cursor position (P1) when the button of the mouse is pressed and the black arrow mark indicates the cursor position (P2) when the button of the mouse is released. As shown in FIG. 30(*a*), when Test 2000 detects that "mouseMode" is "0" that is, a mouse OFF event, the processing at Step 2001 and the subsequent steps is executed. When "mouseMode" is not "0", the processing ends. At Step 2001, "mouseOffPoint.h—mouseOnPoint.h" is substituted for "sx" and "mouseOffPoint.v—mouseOnPoint.v" is substituted for "sy". At Step 2002, (sx, sy) is added to the coordinates of all particles within a circle of a radius R with the center at a point P1 (mouseOnPoint.h, mouseOnPoint.v). Then, the Figure Display routine 160 displays the particles.

Figure 31A:
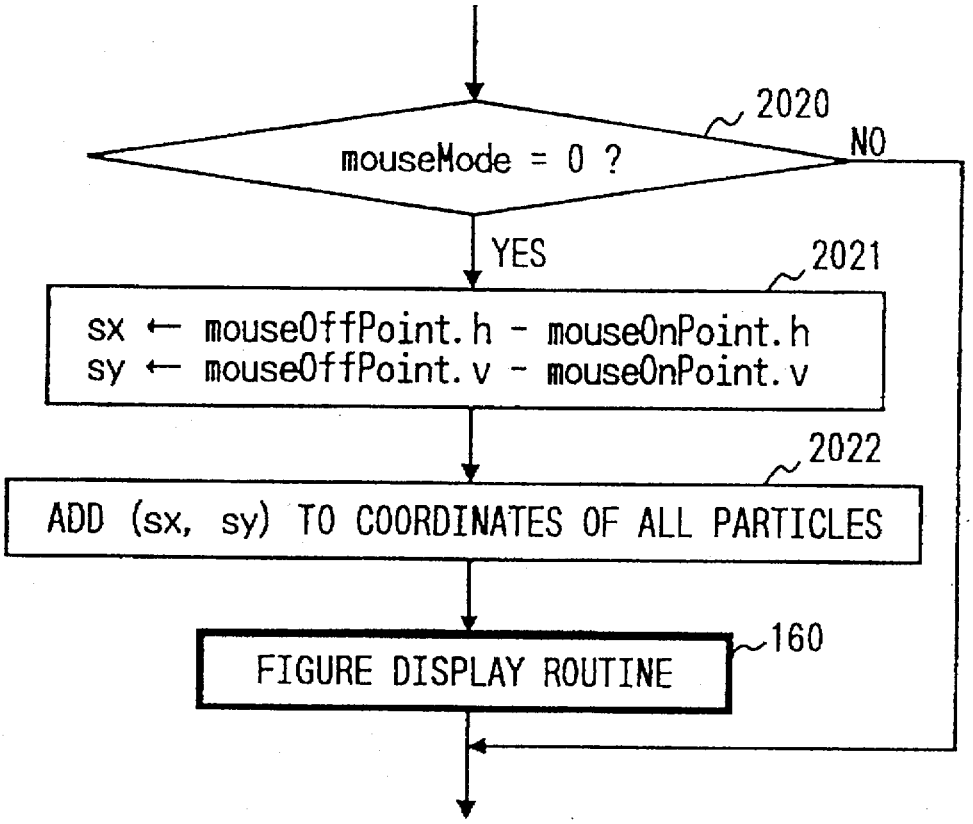
FIG. 31(*a*) is a flow diagram showing a Move routine in the Figure Edit routine included in one embodiment of the method of the present invention.
Figure 31B:
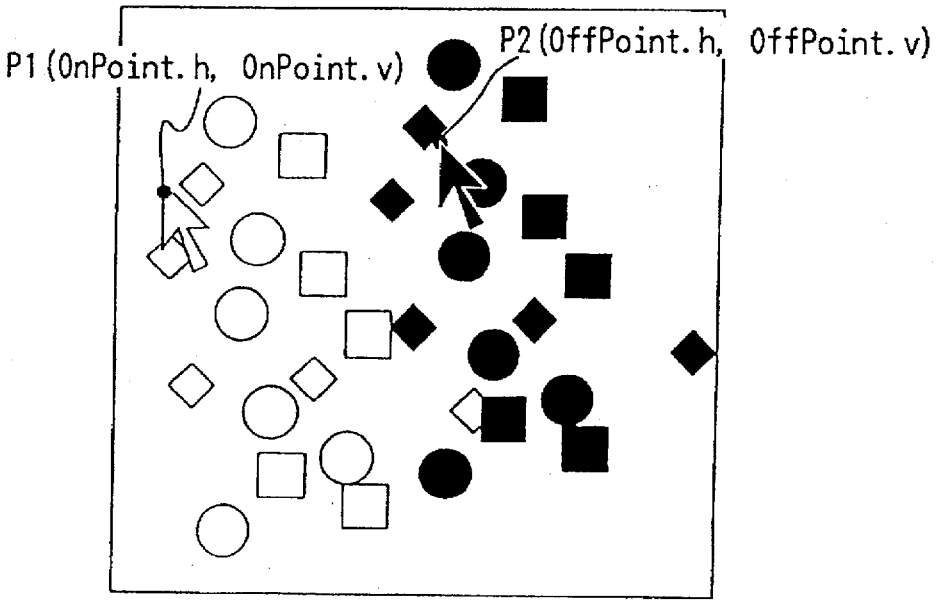

FIG. 31(*a*) shows the Move routine 303 which is called in the Figure Edit routine. In FIG. 31(*b*), the white particles indicate particles before movement and the black particles indicate particles after movement. The white arrow mark indicates the cursor position (P1) when the button is pressed and the black arrow mark indicates the cursor position (P2) when the button is released. As shown in FIG. 31(*a*), when Test 2020 detects that "mouseMode" is "0" the processing at Step 2021 and the subsequent steps is executed. When "mouseMode" is not "0", the processing ends. At Step 2021, "mouseOffPoint.h—mouseOnPoint.h" is substituted for "sx" and "mouseOffPoint.v—mouseOnPoint.v" is substituted for "sy". At Step 2022 (sx, sy) is added to the coordinates of all particles. Then, the Figure Display routine 160 displays the particles.

Figure 32A:
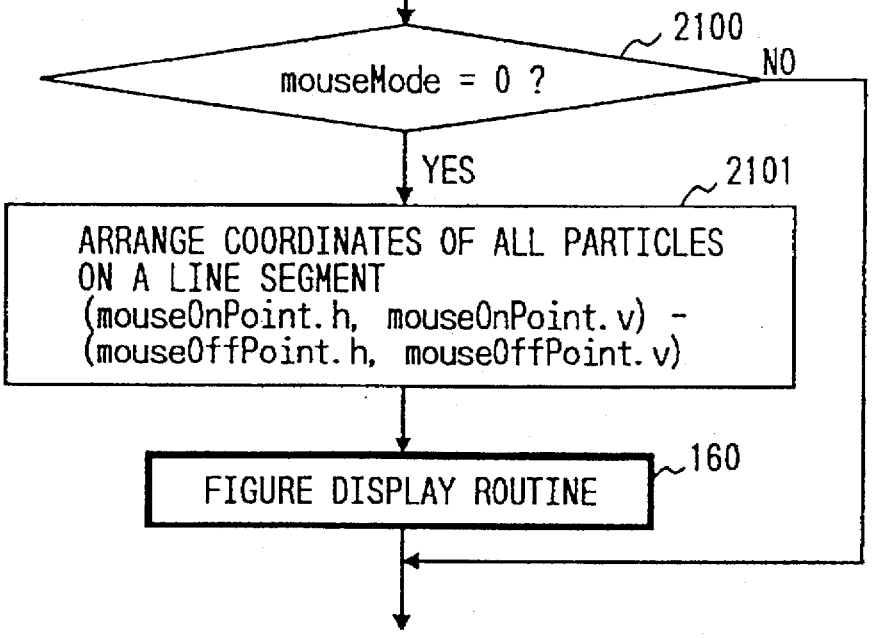
FIG. 32(*a*) is a flow diagram showing a Line routine in the Figure Edit routine included in one embodiment of the method of the present invention.
Figure 32B:
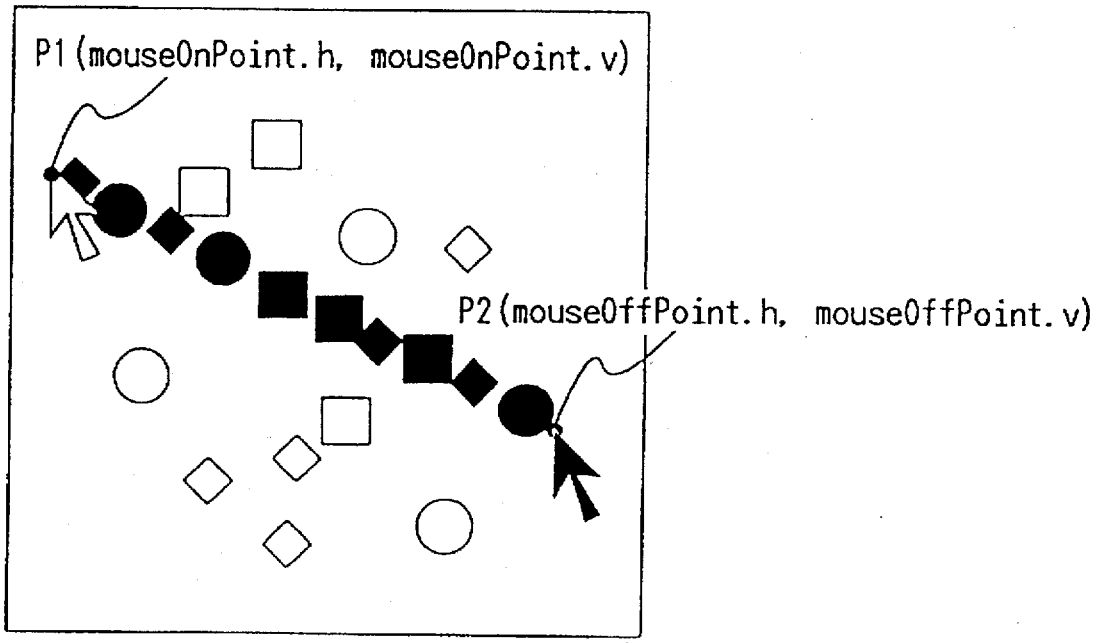

FIG. 32(*a*) shows the Line routine 305 which is called in the Figure Edit routine. In FIG. 32(*b*), the white particles indicate particles before movement and the black particles indicate particles after movement. The white arrow mark indicates the cursor position (P1) when the button is pressed and the black arrow mark indicates the cursor position (P2) when the button is released. As shown in FIG. 32(*a*), when Test 2100 detects that "mouseMode" is "0", the processing at Step 2101 and the subsequent step is executed. When "mouseMode" is not "0", the processing ends. At Step 2101, the coordinates of all particles are arranged on a line segment of P1 (mouseOnPoint.h, mouseOnPoint.v)—P2 (mouseOffPoint.h, mouseOffPoint.v). Then, the Figure Display routine 160 displays the particles.

Figure 33A:
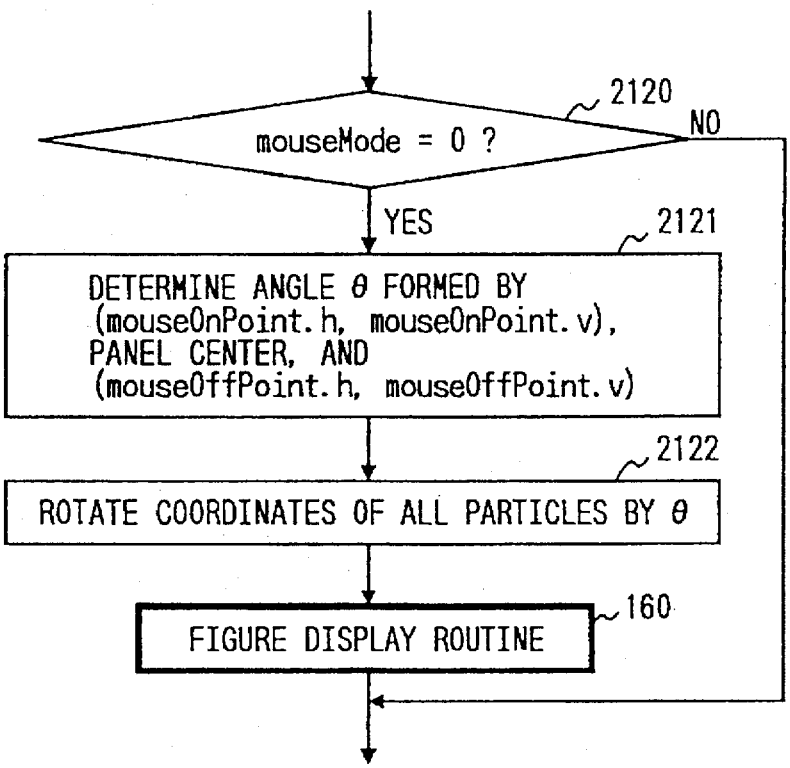
FIG. 33(*a*) is a flow diagram showing a Rotate routine in the Figure Edit routine included in one embodiment of the method of the present invention.
Figure 33B:
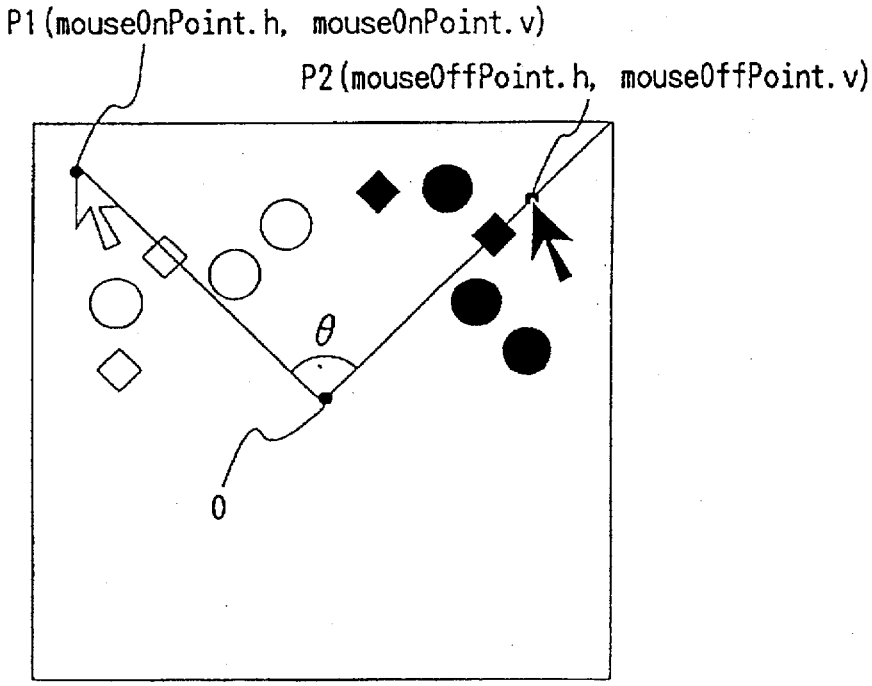

FIG. 33(*a*) shows the Rotate routine 307 which is called in the Figure Edit routine. In FIG. 33(*b*), the white particles indicate particles before movement and the black particles indicate particles after movement. The white arrow mark indicates the cursor position (P1) when the button is pressed and the black arrow mark indicates the cursor position (P2) when the button is released. As shown in FIG. 33(*a*), when Test 2120 detects that "mouseMode" is 0, the processing at Step 2121 and the subsequent steps is executed. When "mouseMode" is not "0", the processing ends. At Step 2121, an angle o which is formed by a point P1 (mouseOnPoint.h, mouseOnPoint.v), the center O of the figure display panel, and a point P2 (mouseOffPoint.h, mouseOffPoint.v) is determined. Step 2122 rotates the 1S coordinates of all particles by o. Then, the Figure Display routine 160 displays the particles.

Figure 34A:
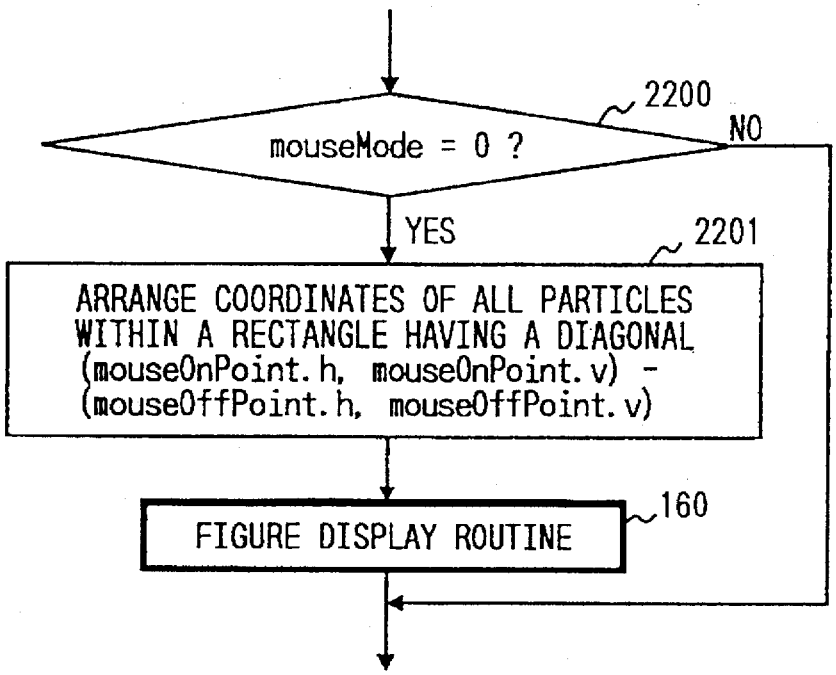
FIG. 34(*a*) is a flow diagram showing a Random Rect routine in the Figure Edit routine included in one embodiment of the method of the present invention.
Figure 34B:
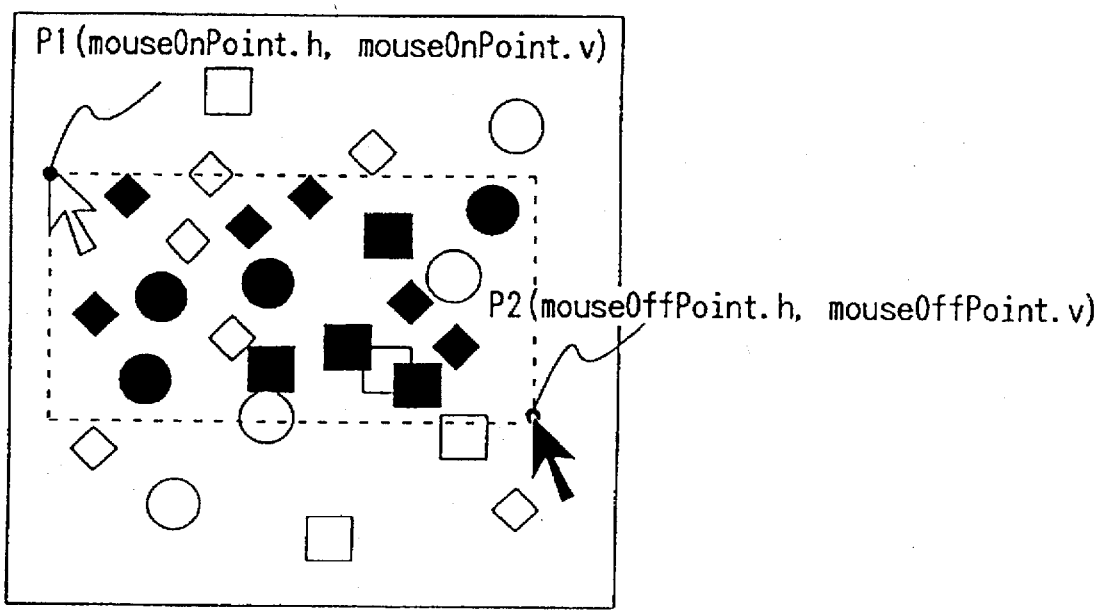

FIG. 34(*a*) shows the Random Rect routine 309 which is called in the Figure Edit routine. In FIG. 34(*b*), the white particles indicate particles before movement and the black particles indicate particles after movement. The white arrow mark indicates the cursor position (P1) when the button is pressed and the black arrow mark indicates the cursor position (P2) when the button is released. As shown in FIG. 34(*a*), when Test 2200 detects that "mouseMode" is "0", the processing at Step 2201 and the subsequent step is executed. When "mouseMode" is not "O", the processing ends. At Step 2201, the coordinates of all particles are arranged within a rectangle having a line segment P1 (mouseOnPoint.h, mouseOnPoint.v)—P2 (mouseOffPoint.h, mouseOffPoint.v) as a diagonal. Then, the Figure Display routine 160 displays the particles.

Figure 35A:
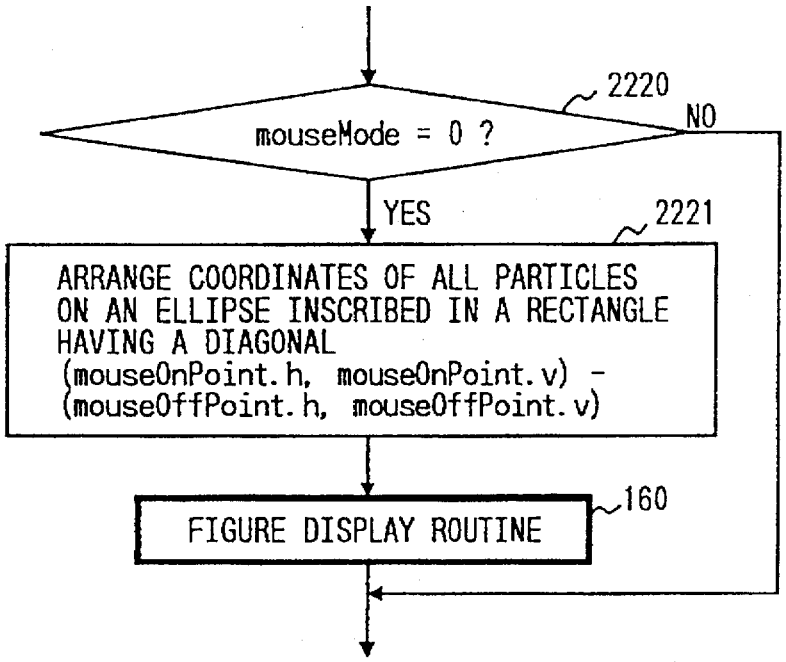
FIG. 35(*a*) is a flow diagram showing a Circle routine in the Figure Edit routine included in one embodiment of the method of the present invention.
Figure 35B:
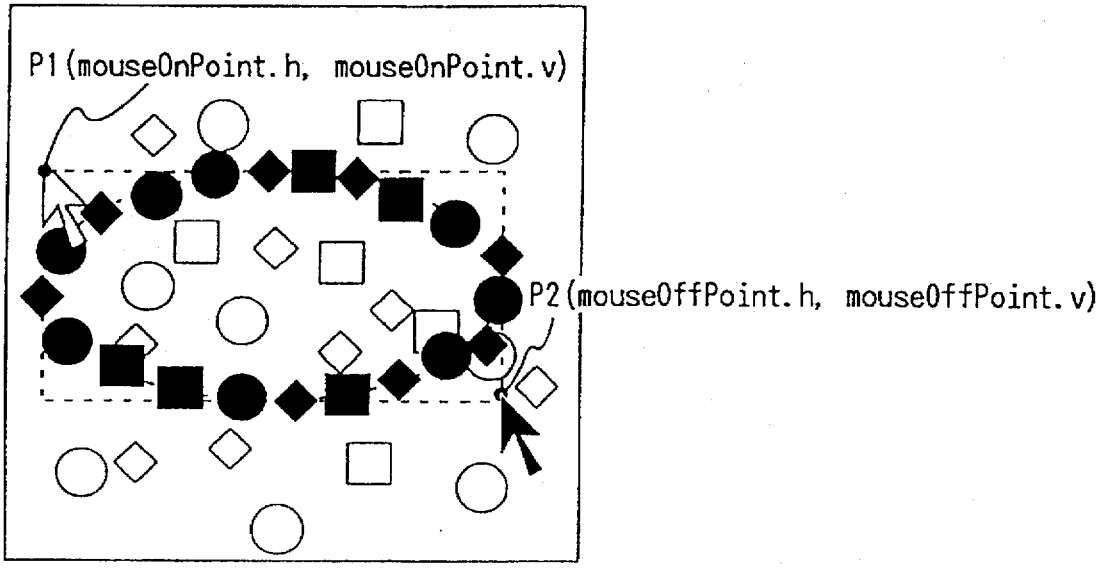

FIG. 35(*a*) shows the Circle routine 311 which is called in the Figure Edit routine. In FIG. 35(*b*), the white particles indicate particles before movement and the black particles indicate particles after movement. The white arrow mark indicates the cursor position (P1) when the button is pressed and the black arrow mark indicates the cursor position (P2) when the button is released. As shown in FIG. 35(*a*), when Test 2220 detects that "mouseMode" is "0", the processing at Step 2211 and the subsequent step is executed. When "mouseMode" is not "0", the processing ends. At Step 2221, the coordinates of all particles are arranged on an ellipse inscribed in a rectangle having a line segment P1 (mouseOnPoint.h, mouseOnPoint.v)—P2 (mouseOffPoint.h, mouseOffPoint.v) as a diagonal. Then, the Figure Display routine 160 displays the particles.

Figure 36A:
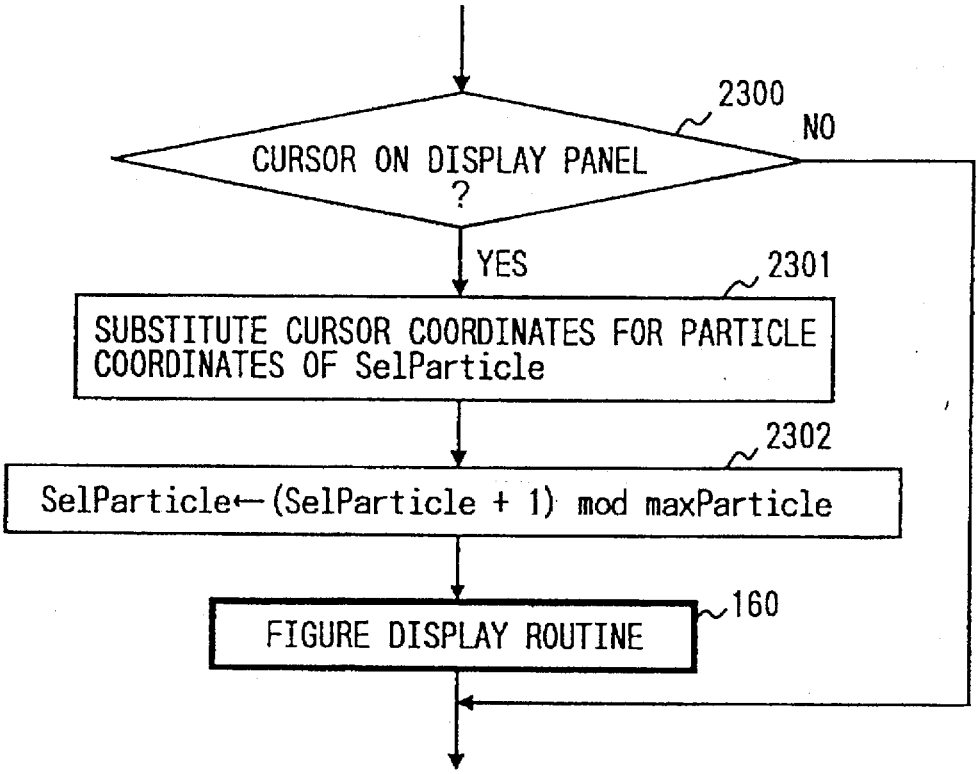
FIG. 36(*a*) is a flow diagram showing a Precise Follow routine in the Figure Edit routine included in one embodiment of the method of the present invention.
Figure 36B:
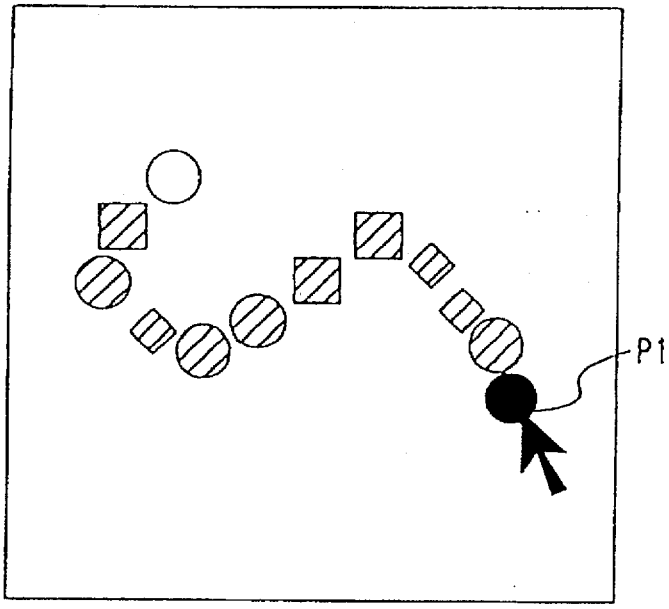

FIG. 36(*a*) shows the Precise Follow routine which is called in the Figure Edit routine. In FIG. 36(*b*), the white particle indicates a particle before movement, and the black particle indicates a particle after movement, and the hatched particles indicate particles which do not take part in movement. The black arrow mark indicates the cursor position (P1). As shown in FIG. 36(*a*), when Step 2300 detects that the mouse cursor is on the figure display panel, the processing at Step 2301 and the subsequent steps is executed. When the mouse cursor is not on the figure display panel, the processing ends. Step 2301 substitutes the cursor coordinates for the particle display position of "SelParticle". Step 2302 substitutes the remainder when "SelParticle+1" is divided by "maxParticle" for "SelParticle". Then, the Figure Display routine 160 displays the particles.

Figure 37A:
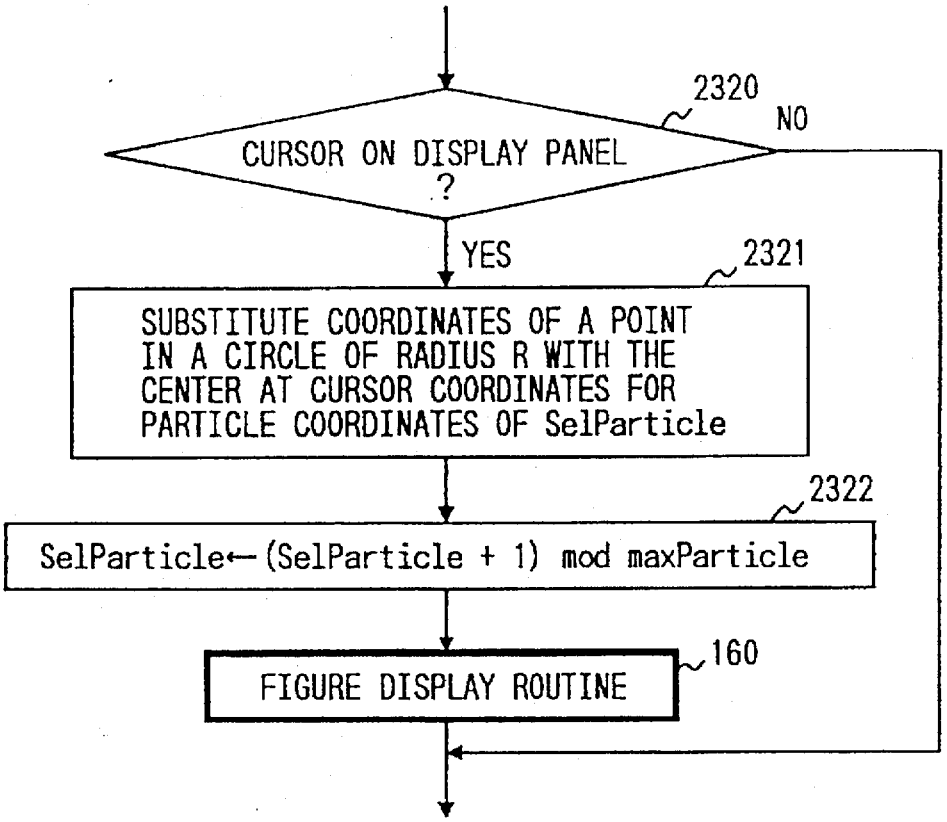
FIG. 37(*a*) is a flow diagram showing a Random Follow routine in the Figure Edit routine included in one embodiment of the method of the present invention.
Figure 37B:
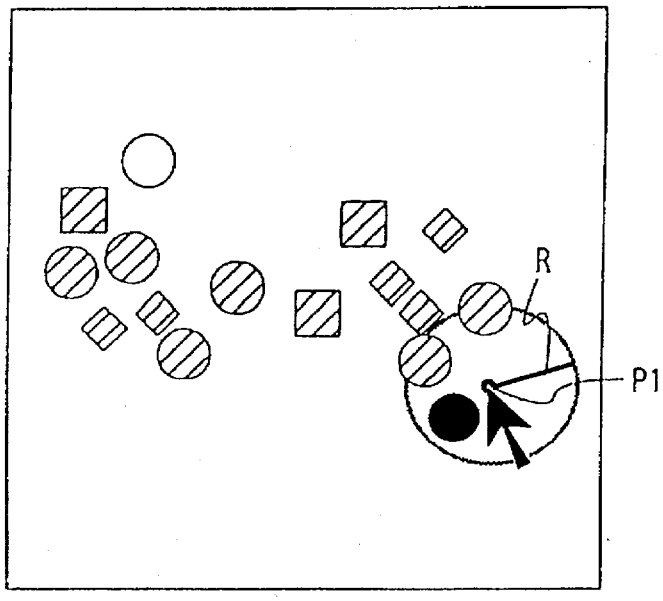

FIG. 37(*a*) shows the Random Follow routine which is called in the Figure Edit routine. In FIG. 37(*b*), the white particle indicates a particle before movement, and the black particle indicates a particle after movement, and the hatched particles indicate particles which do not take part in movement. The black arrow mark indicates the cursor position (P1). Referring to FIG. 37(*a*), when Step 2320 detects that the mouse cursor is on the figure display panel, the processing at Step 2321 and the subsequent steps is executed. When the mouse cursor is not on the figure display panel, the processing ends. Step 2321 substitutes the coordinates of an arbitrary point in a circle of a radius R with the center at the cursor coordinates P1 for the particle coordinates of "SelParticle". Step 2322 substitutes the remainder when "SelParticle+1" is divided by "maxParticle" for "SelParticle". Then, the Figure Display routine 160 displays the particles.

Figure 38A:
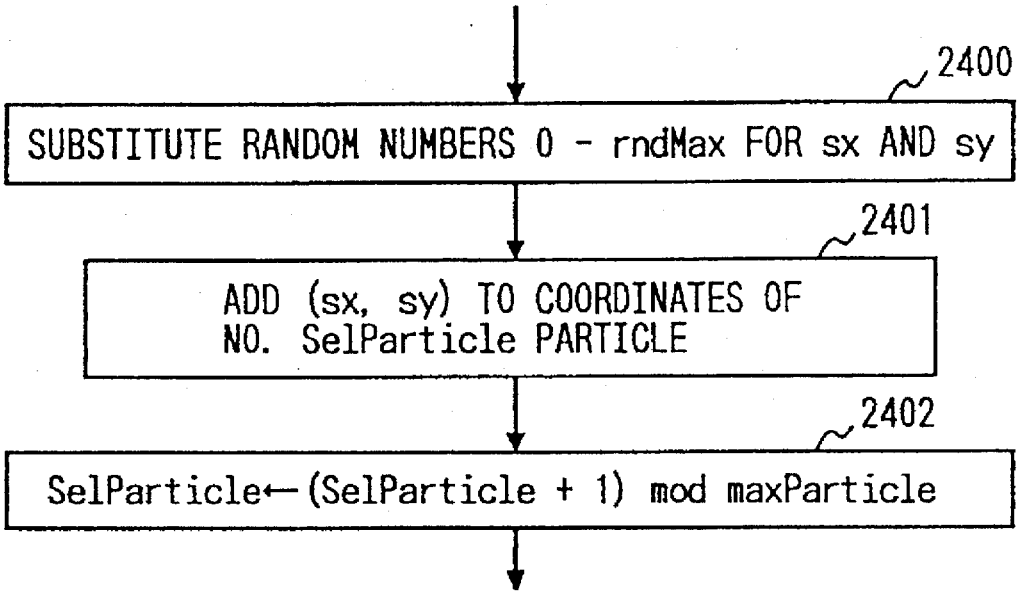
FIG. 38(*a*) is a flow diagram showing a Random Walk routine in the Figure Move routine included in one embodiment of the method of the present invention.
Figure 38B:
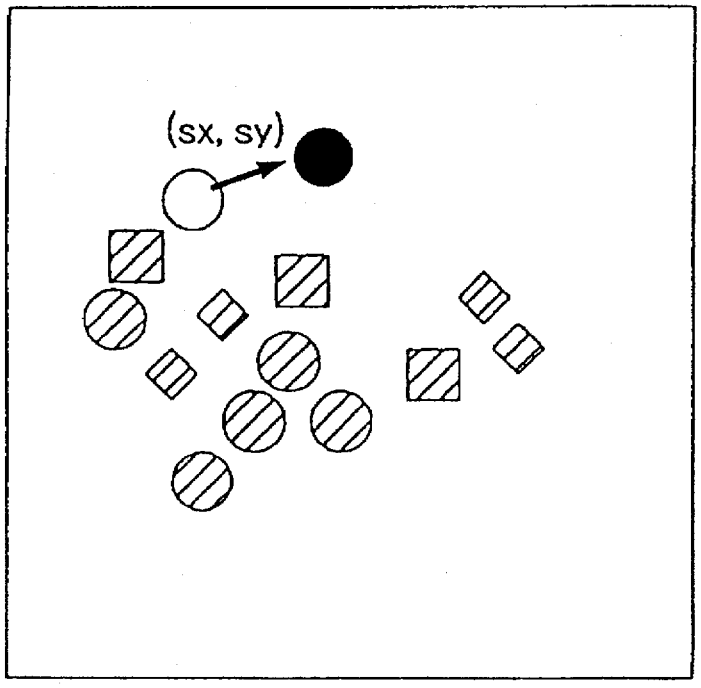

FIG. 38(*a*) shows the Random Walk routine 711 which is called in the Figure Move routine (FIG. 19). In FIG. 38(*b*), the white particle indicates a particle before movement, and the black particle indicates a particle after movement, and the hatched particles indicate particles which do not take part in movement. Referring to FIG. 38(*a*), step 2400 substitutes random numbers from "O" to "rndMax" for "sx" and "sy". Step 2401 adds (sx, sy) to the coordinates of No. SelParticle particle. Step 2402 substitutes the remainder when "SelParticle+1" is divided by "maxParticle" for "SelParticle".

Figure 39A:
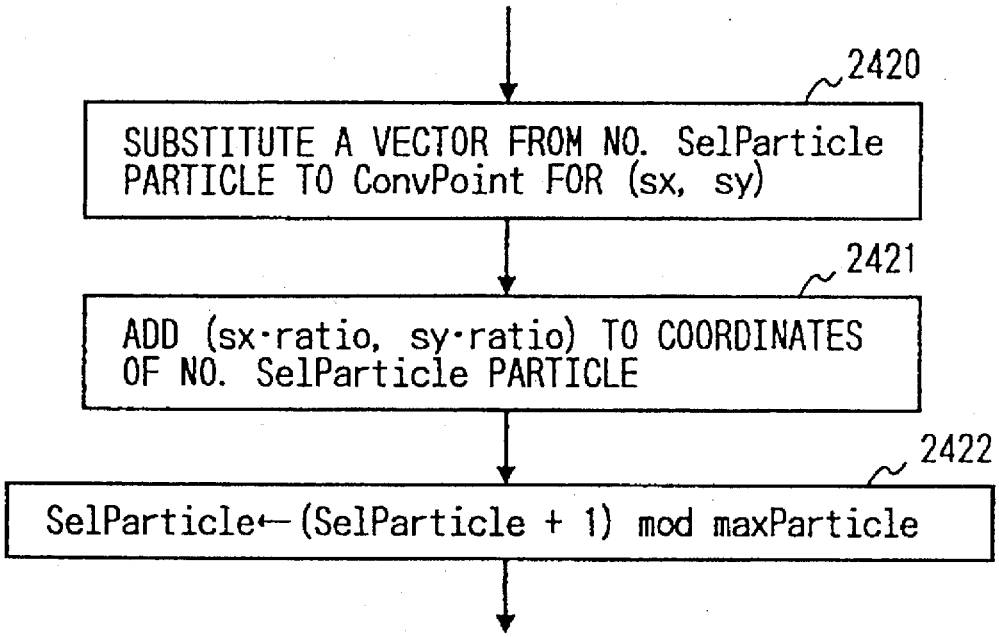
FIG. 39(*a*) is a flow diagram showing a Convergence routine in the Figure Move routine included in one embodiment of the method of the present invention.
Figure 39B:
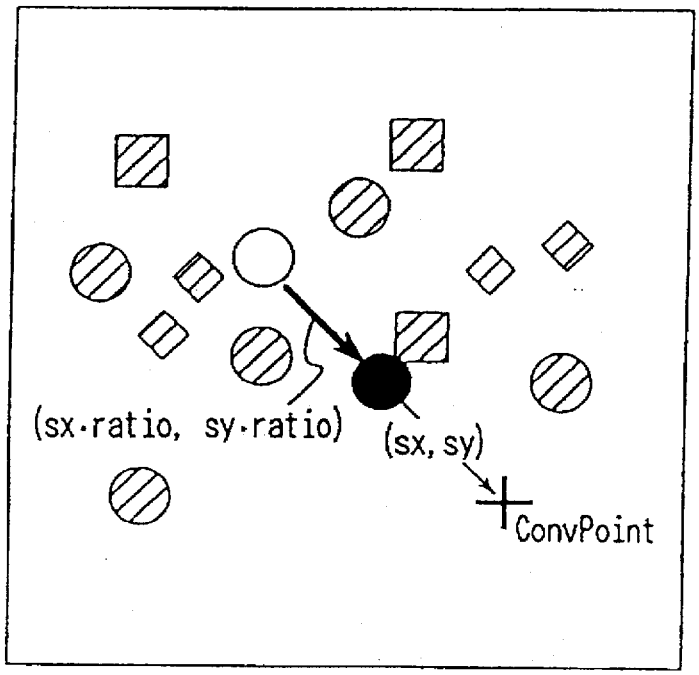

FIG. 39(*a*) shows the Convergence routine 713 which is called in the Figure Move routine. In FIG. 39(*b*), the white particle indicates a particle before movement, and the black particle indicates a particle after movement, and the hatched particles indicate particles which do not take part in movement. A symbol "+" indicates a convergence point ("ConvPoint"). With reference to FIG. 39(*a*), step 2420 substitutes a vector from Particle of "SelParticle" to "ConvPoint" for (sx, sy) as shown in FIG. 39(*a*). Step 2421 adds (sx x ratio, sy x ratio) to the coordinates of No. SelParticle particle. Step 2422 substitutes the remainder when "SelParticle+1" is divided by "maxParticle" for "SelParticle".

Figure 40A:
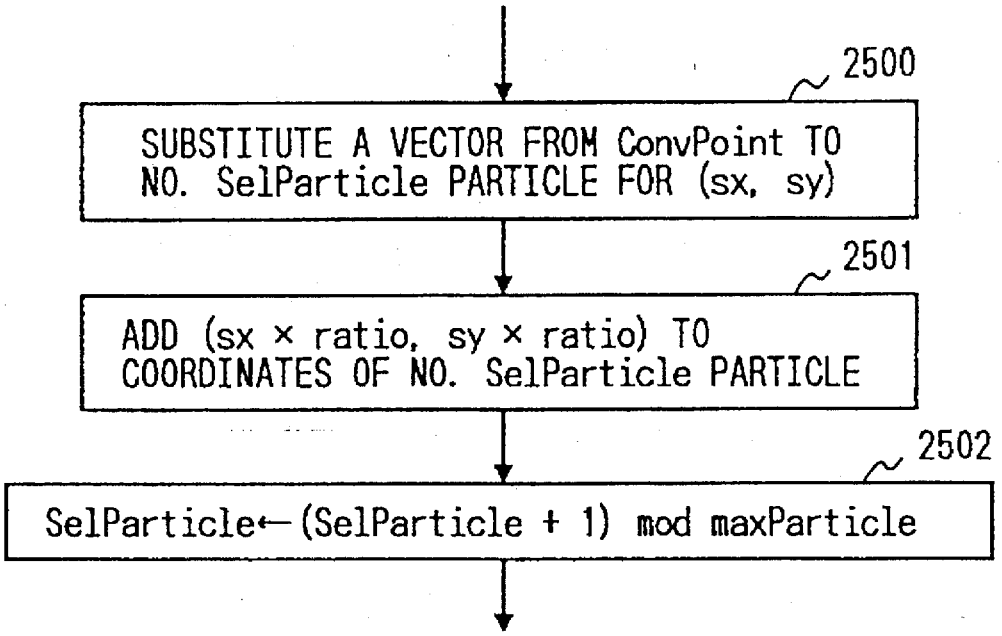
FIG. 40(*a*) is a flow diagram showing a Divergence routine in the Figure Move routine included in one embodiment of the method of the present invention.
Figure 40B:
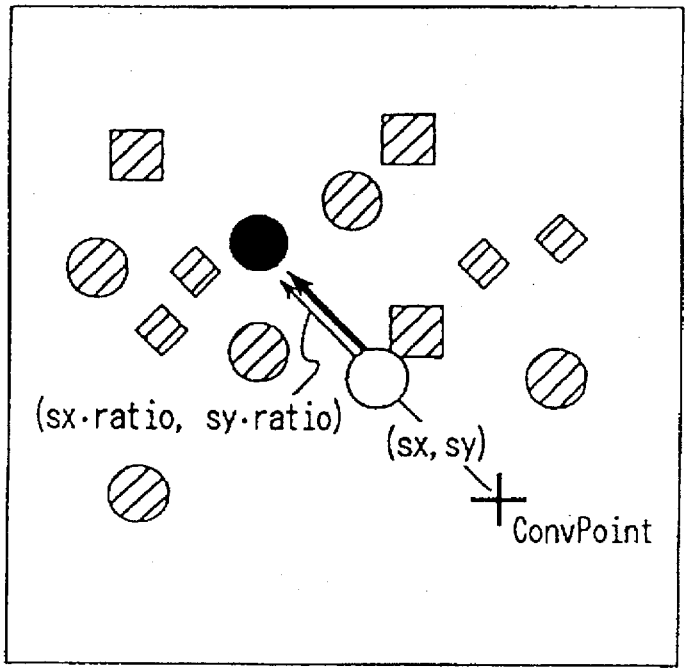

FIG. 40(*a*) shows the Divergence routine 715 which is called in the Figure Move routine. In FIG. 40(*b*), the white particle indicates a particle before movement, and the black particle indicates a particle after movement, and the hatched particles indicate particles which do not take part in movement. A symbol "+" indicates t.ConvPoint". Referring to FIG. 40(*a*), step 2500 substitutes a vector from "ConvPoint" to the coordinates of No. SelParticle particle for (sx, sy). Step 2501 adds (sx x ratio, sy x ratio) to the coordinates of No. SelParticle particle. Step 2502 substitutes the remainder when "SelParticle+1" is divided by "maxParticle" for "SelParticle".

Figure 41A:
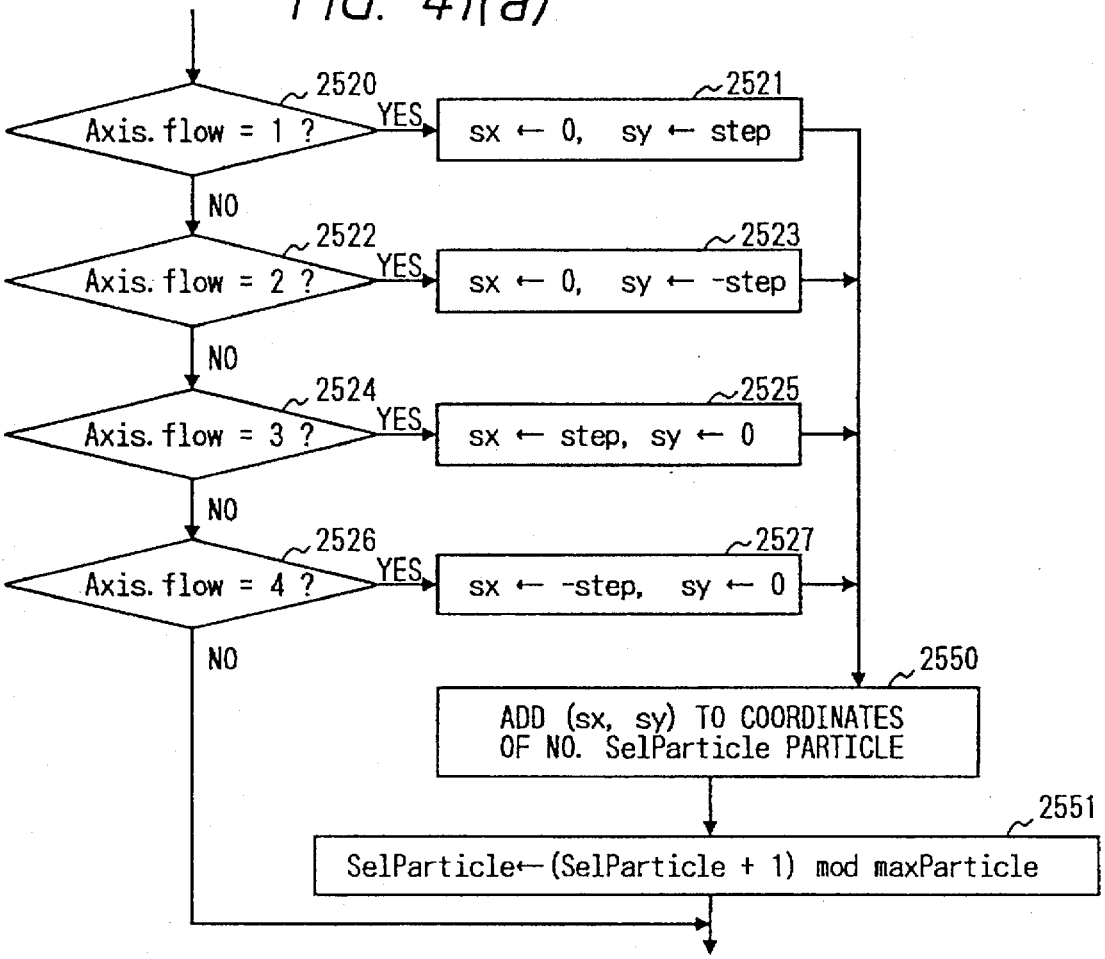
FIG. 41(*a*) is a flow diagram showing a Flow routine in the Figure Move routine included in one embodiment of the method of the present invention.
Figure 41B:
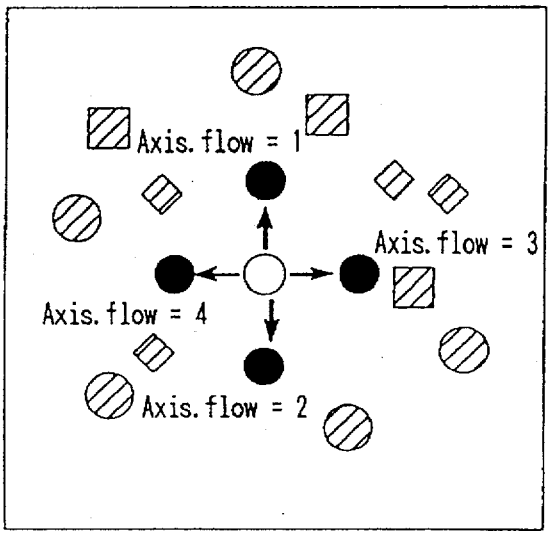

FIG. 41(*a*) shows the Flow routine 717 which is called in the Figure Move routine. In FIG. 41(*b*), the white particle indicates a particle before movement, and the black particles indicate particles after movement, and the hatched particles indicate particles which do not take part in movement. Referring to FIG. 41(*a*), when Test 2520 detects that "Axis-.flow" is "1", Step 2521 substitutes "O" for "sx" and "step" for "sy". When Test 2522 detects that "Axis.flow" is "2", Step 2523 substitutes "0" for "sx" and "-step" for "sy"When Test 2524 detects that "Axis.flow" is "3", Step 2525 substitutes "step" for "sx" and "0" for "sy". When Test 2526 detects that "Axis.flow" is "4", Step 2527 substitutes "-step" for "sx" and "O" for "sy". Step 2550 adds (sx, sy) to the coordinates of No. SelParticle particle. Step 2551 substitutes the remainder when "SelParticle+1" is divided by "maxParticle" for "SelParticle".

Figure 42A:
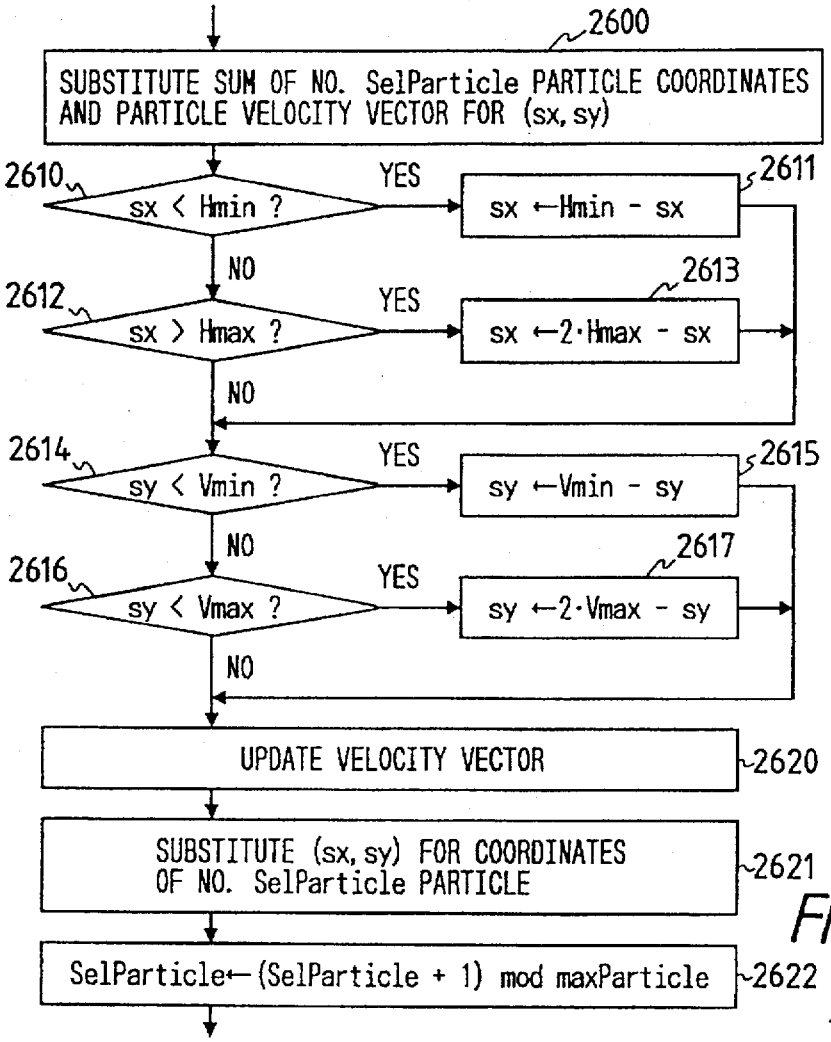
FIGS. 42A(*a*) is a flow diagram of a Bounce routine in the Figure Move routine included in one embodiment of the method of the present invention.
Figure 42A:
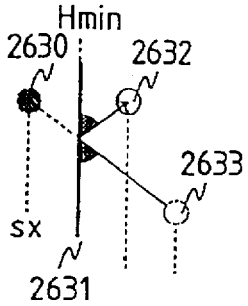
Figure 42A:
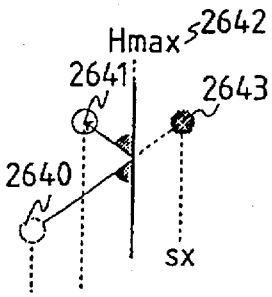
Figure 42A:
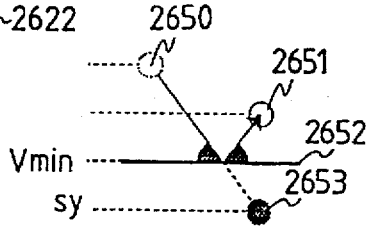
Figure 42A:
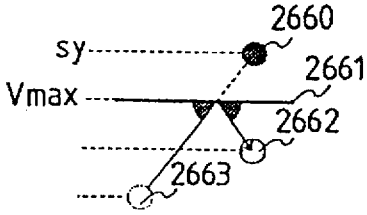
Figure 42B:
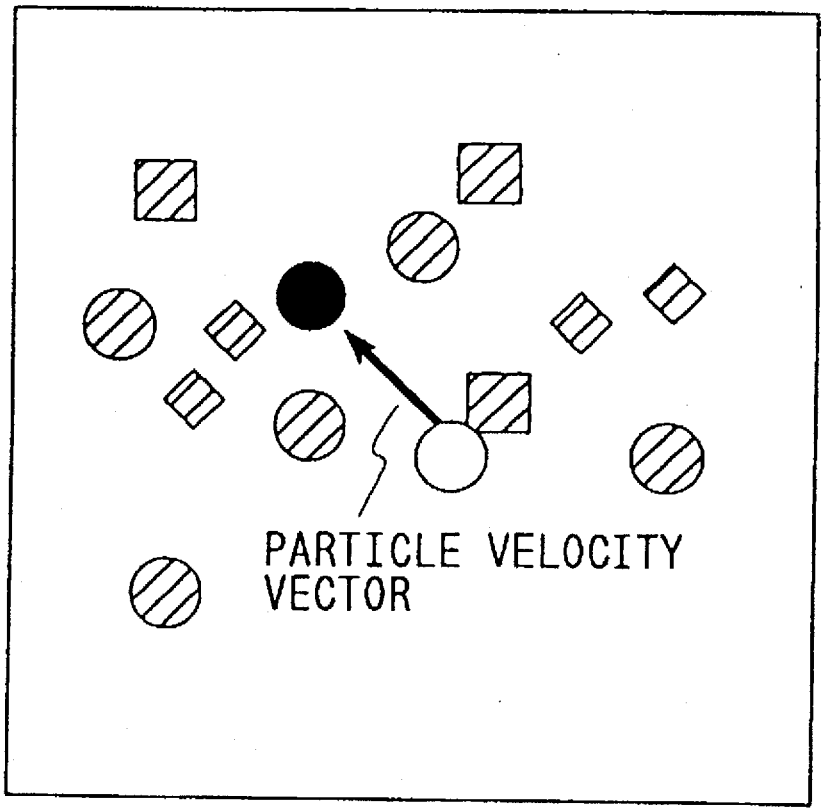
FIG. 42B is a diagram showing the manner in which particles are moved when a Bounce routine is performed in accordance with the method of the present invention.

FIG. 42A and 42B show the Bounce routine 719 which is called in the Figure Move routine. In FIG. 42B, the white particle indicates a particle before movement, and the black particle indicates a particle after movement, and the hatched particles indicate particles which do not take part in movement. Referring to FIG. 42A(*a*), step 2600 substitutes the sum of the coordinates of No. SelParticle particle and the velocity vector of the particle for (sx, sy). When Test 2610 detects that sx<Hmin, Step 2611 substitutes "Hmin-sx" for "sx" (see FIG. 42A(*b*)). When Test 2612 detects that sx>Hmax, Step 2613 substitutes "2Hmax-sx" for "sx" (see FIG. 42A(*c*)). When Test 2614 detects that sy<Vmin, Step 2615 substitutes "Vmin-sy" for "sy" (see FIG. 42A(*d*)). When Test 2616 detects that sy>Vmax, Step 2617 substitutes "2Vmax-sy" for "sy" (see FIG. 42A(*e*)). Step 2620 updates the velocity vector of the particle. Step 2621 substitutes (sx, sy) for the coordinates of No. SelParticle particle. Step 2622 substitutes the remainder when "SelParticle+1" is divided by "maxParticle" for "SelParticle".

Figure 43A:
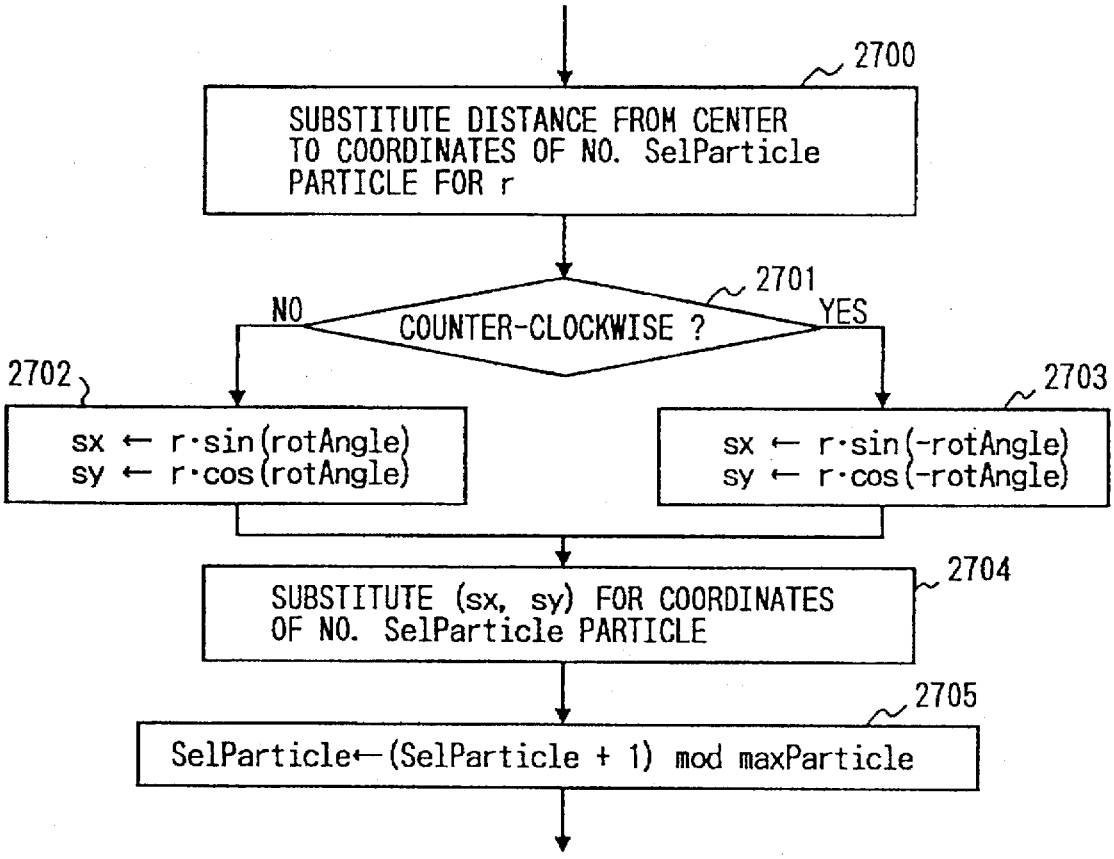
FIG. 43(*a*) is a flow diagram showing a Rotate routine in the Figure Move routine included in one embodiment of the method of the present invention.
Figure 43B:
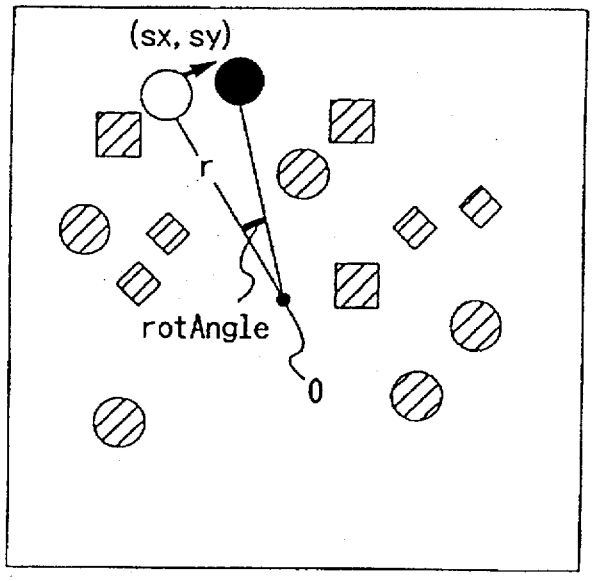

FIG. 43(*a*) shows the Rotate clockwise routine 721 and the Rotate counter-clockwise routine 723 which are called in the Figure Move routine. In FIG. 43(*b*), the white particle indicates a particle before movement, and the black particle indicates a particle after movement, and the hatched particles indicate particles which do not take part in movement. Referring to FIG. 43(*a*), step 2700 substitutes the distance from the center O of the figure display panel to the coordinates of No. SelParticle particle for "r". When Step 2701 detects that "rotate counter-clockwise" is selected, Step 2703 is executed. When "rotate counter-clockwise is not selected, Step 2702 is executed. Step 2702 substitutes "r x sin(rotAngle)" for "sx" and "r x cos(rotAngle)" for "sy". Step 2703 substitutes "r x sin(-rotAngle)" for sx and "r x cos(-rotAngle)" for sy. Step 2704 substitutes (sx, sy) for the coordinates of No. SelParticle particle. Step 2705 substitutes the remainder when "SelParticle+1" is divided by "maxParticle" for "SelParticle".

Figure 44A:
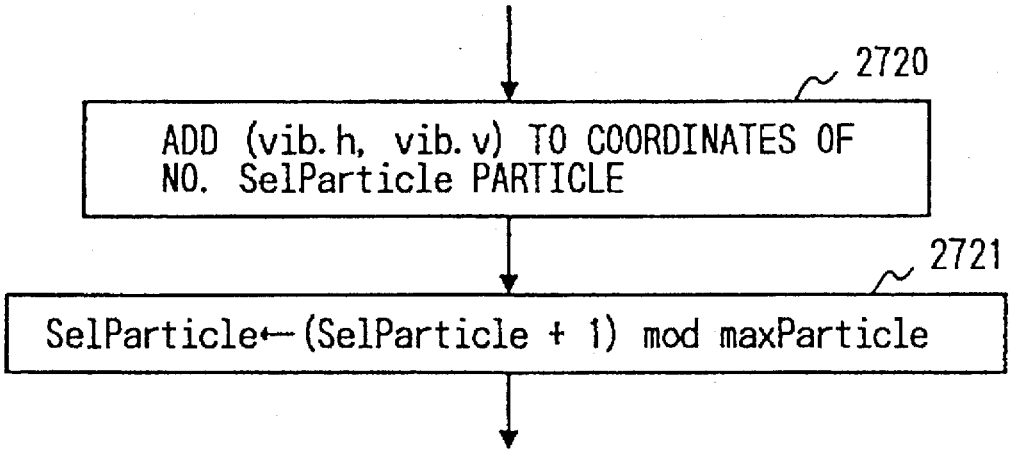
FIG. 44(*a*) is a diagram showing a Vibrate routine in the Figure Move routine included in one embodiment of the method of the present invention.
Figure 44B:
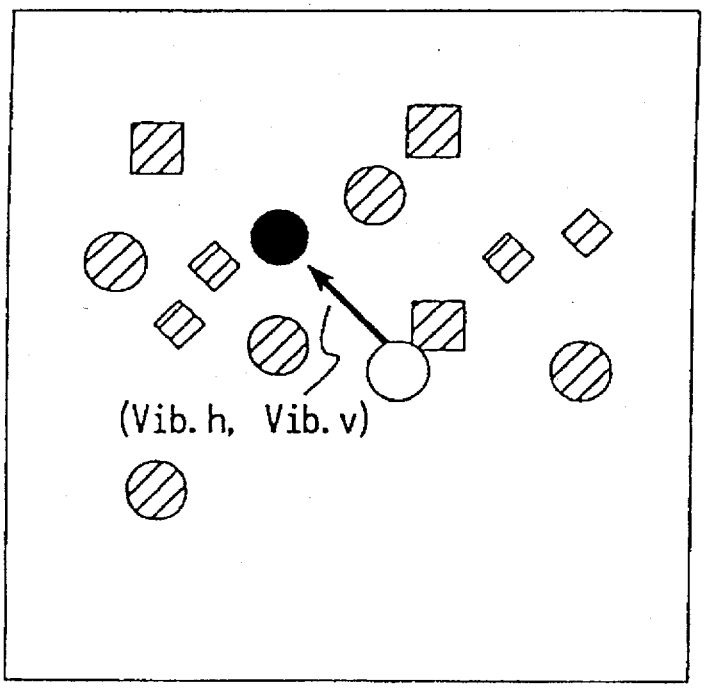

FIG. 44(*a*) shows the vibrate routine 725 which is called in the Figure Move routine. In FIG. 44(*b*), the white particle indicates a particle before movement, and the black particle indicates a particle after movement, and the hatched particles indicate particles which do not take part in movement. As shown in FIG. 44(*a*), step 2720 adds (vib.h, rib.v) to the coordinates of No. SelParticle particle. Step 2721 substitutes the remainder when "SelParticle+1" is divided by "maxParticle" for "SelParticle".

Figure 45A:
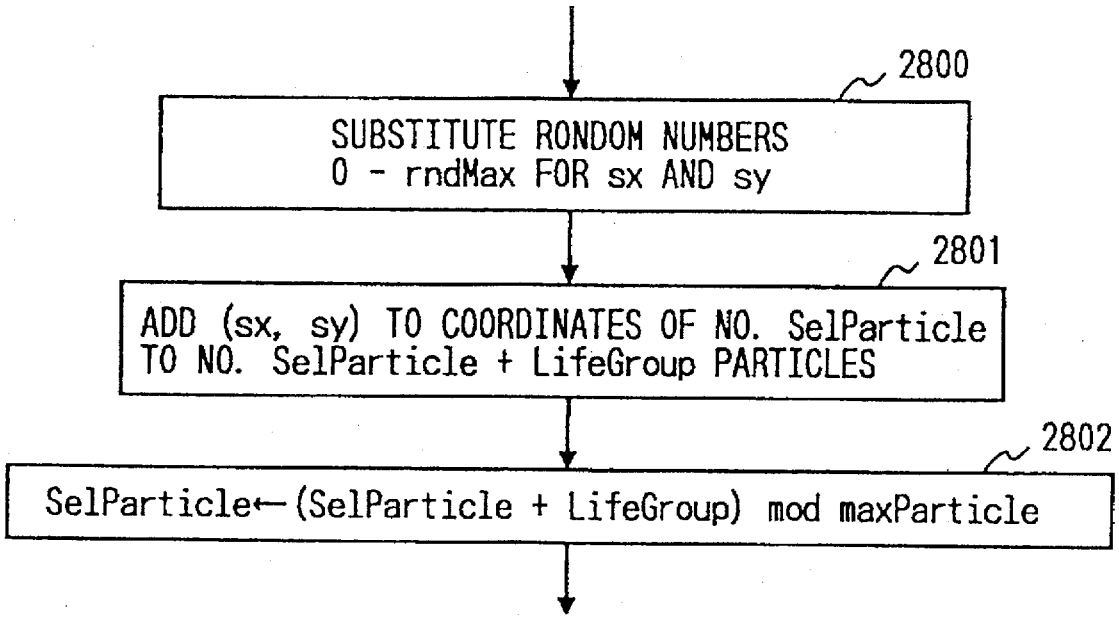
FIG. 45(*a*) is a diagram showing a Life routine in the Figure Move routine included in one embodiment of the method of the present invention.
Figure 45B:
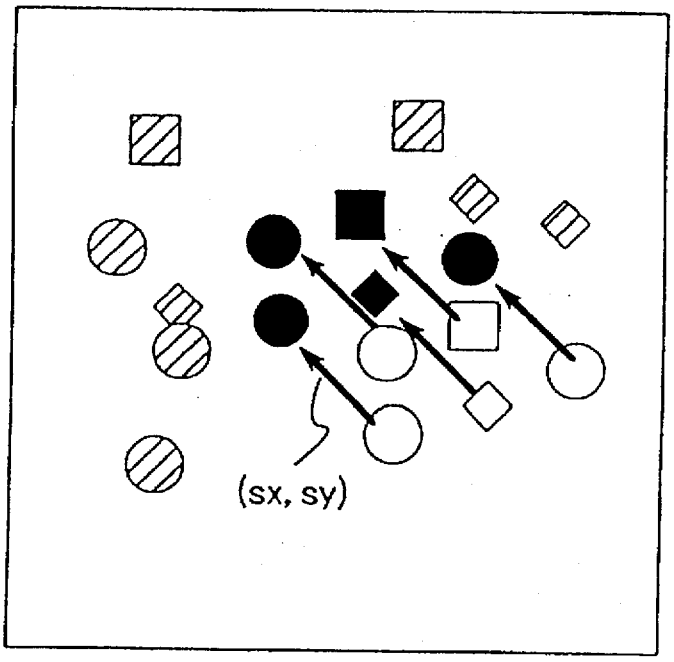

FIG. 45(*a*) shows the Life routine 727 which is called in the Figure Move routine. In FIG. 45(*b*), the white particles indicate particles before movement, and the black particles indicate particles after movement, and the hatched particles indicate particles which do not take part in movement. As shown in FIG. 45(*a*), step 2800 substitutes random numbers from "O" to "rndMax" for "sx" and "sy". Step 2801 adds (sx, sy) to the coordinates of No. SelParticle to No. SelParticle+LifeGroup particles. Step 2802 substitutes the remainder when "SelParticle+LifeGroup" is divided by "maxParticle" for "SelParticle".

Figure 46A:
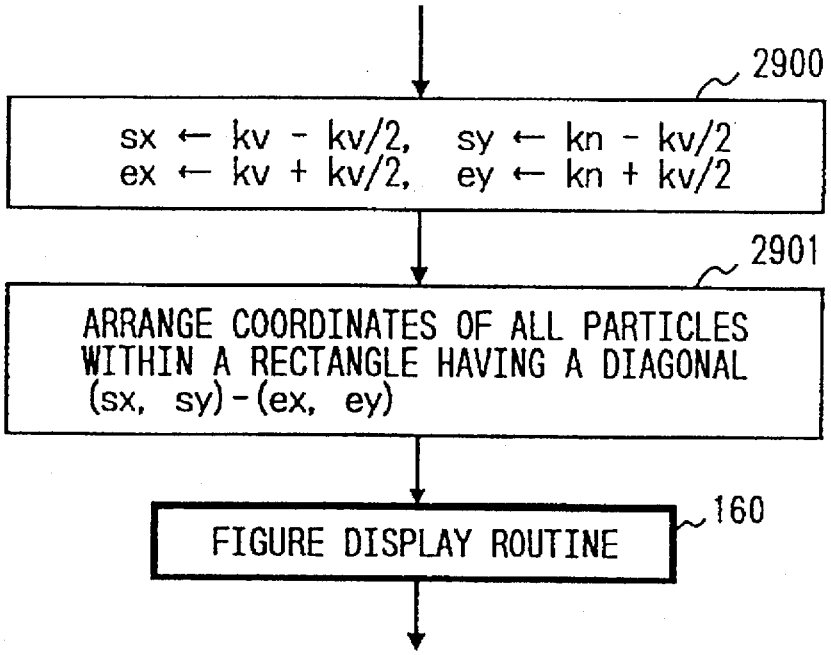
FIG. 46(*a*) is a diagram showing a MIDI In Random Rect routine included in one embodiment of the method of the present invention.
Figure 46B:
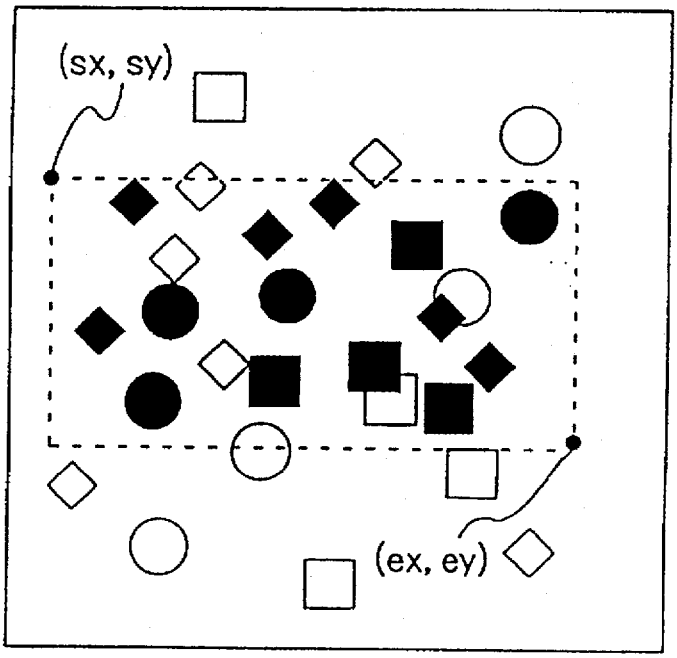

FIG. 46(*a*) shows the MIDI-In Random Rect routine 511 which is called in the MIDI-In Processing routine (FIG. 11). In FIG. 46(*b*), the white particles indicate particles before movement and the black particles indicate particles after movement. Referring to FIG. 46(*a*), step 2900 substitutes "kv-kv/2" for "sx", "kn-kv/2~' for "sy", "kv+kv/2" for ex, and "kn+kv/2" for "ey". Step 2901 arranges the coordinates of all particles within a rectangle having a line segment (sx, sy) - (ex, ey) as a diagonal. Then, the figure display routine 160 displays the particles on the figure display panel.

Figure 47A:
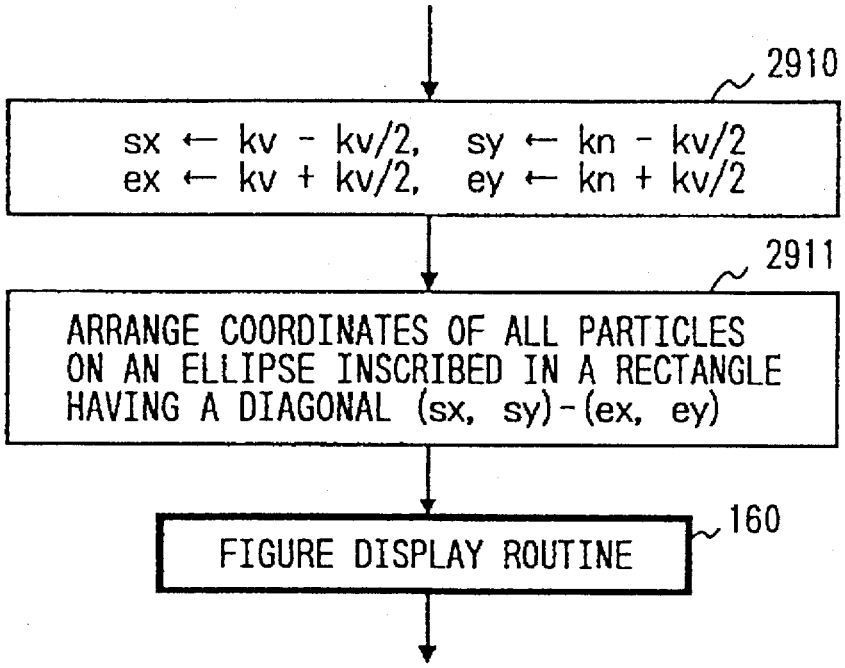
FIG. 47(*a*) is a diagram showing a MIDI-In Circle routine included in one embodiment of the method of the present invention.
Figure 47B:
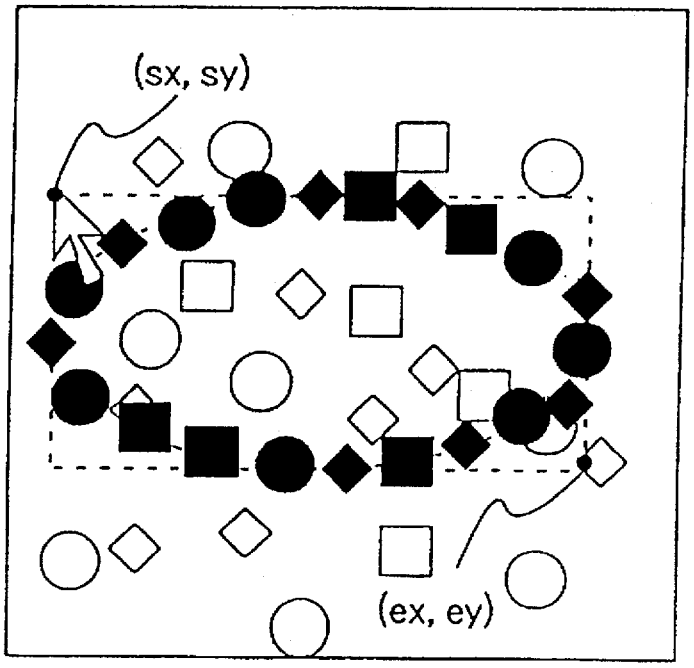

FIG. 47(*a*) shows the MIDI-In Circle routine 513 which is called in the MIDI-In Processing routine. In FIG. 47(*b*), the white particles indicate particles before movement and the black particles indicate particles after movement. As shown in FIG. 47(*a*), step 2910 substitutes "kv-kv/2" for "sx", "kn-kv/2" for "sy", "kv+kv/2" for "ex", and "kn+kv/2" for "ey". Step 2911 arranges the coordinates of all particles on an ellipse inscribed in a rectangle having a line segment (sx, sy) - (ex, ey) as a diagonal. Then, the figure display routine 160 displays the particles on the figure display panel.

In the above embodiment, figures move in a two-dimensional space and the horizontal and vertical coordinates (display position) of each figure determine the sound intensity (key velocity), sound pitch (key number), and other main sound attributes. As a result, a melody which can be synthesized is limited. More particularly, the two-dimensional space has only two axes of coordinates, so that only two sound attributes can be controlled independently. For example, referring to FIG. 28, both the key velocity and pan pot are determined by the coordinates on the horizontal axis "3", so that the key velocity and pan pot depend on each other. Even if the axis "2" or "4" is assigned to the pan pot, the pan pot cannot be independent of the key number or key velocity, respectively. Furthermore, figures only move on the same plane, resulting in restrictions on changes in the picture.

In another embodiment, each figure has three-dimensional coordinates. More particularly, each figure has a position in the depth direction in addition to a horizontal and a vertical positions. As a result, the three attributes of sound (for example, key number, key velocity, and pan pot) can be controlled perfectly independently. Figures can move in a logical three-dimensional space and projections of those figures onto a two-dimensional space are displayed. Furthermore, each figure can rotate round an axis that is parallel with the screen surface. Therefore, changes in the picture are more complicated and attractive. Rotation of a picture round an axis parallel with the screen surface may be converted to sound information. Such three-dimensional processing of each figure can be implemented easily by the well-known three-dimensional computer graphics technique.

What is claimed is:

1. A method for synthesizing a melody using a computer, said computer connected to a display device, an input device, and a sound generating device, said method comprising the steps of:

displaying a plurality of figures on said display device;

establishing a figure-to-sound conversion rule in response to directions designated by said input device, said figure-to-sound conversion rule specifying relationships between attributes of each figure, including attributes of position on said display device, and attributes of sound corresponding to each figure;

establishing at least one figure-position change rule in response to directions designated by said input device, said figure-position change rule specifying a manner in which positions of said figures change;

selecting, in turn, successive ones of the displayed plurality of figures automatically;

changing, each time a figure is selected, a position of at least the selected figure in accordance with the figure-position change rule; and outputting, each time a figure is selected, through said sound generating device, a sound having attributes which correspond to attributes of the selected figure determined in accordance with the figure-to-sound conversion rule, to thereby generate a melody which corresponds to the attributes of the selected figures and which changes in accordance with changes in position of said figures.

2. The method of claim 1, wherein said figure-position change rule is a rule specifying a mode in which automatic figure moving takes place in a predetermined manner.

3. The method of claim 2, wherein said changing step comprises the steps of:

determining a horizontal displacement and a vertical displacement of said selected figure using random numbers; and changing the position of the selected figure by said determined displacements.

4. The method of claim 2, wherein said changing step comprises the steps of:

computing a vector whose length is a predetermined integer multiple of a unit vector pointing in a direction towards a predetermined reference point; and moving the selected figure by a distance direction indicated by said computed vector.

5. The method of claim 2, wherein said changing step comprises the step of changing the position of the selected figure by predetermined horizontal and vertical displacements.

6. The method of claim 2, wherein said changing step comprises the steps of:

moving the selected figure in a rectilinear motion with uniform velocity; and changing a direction of a velocity vector of the motion of the selected figure when that figure arrives at a boundary of a display area of said display device.

7. The method of claim 2, wherein said changing step comprises the step of rotating the position of the selected figure around a predetermined point.

8. The method of claim 2, wherein said changing step comprises the steps of:

selecting a predetermined number of figures, which includes the selected figure;

determining a vector using random numbers; and moving said predetermined number of figures by a distance and in a direction indicated by said vector.

9. The method of claim 1, wherein said input device includes a pointing device with a button, and said figure-position change rule is a rule specifying a manner in which figure moving is partly directed by a user through use of said pointing device.

10. The method of claim 9, wherein said changing step comprises steps of:

computing a vector from a first point, at which said button on said pointing device is pressed, to a second point, at which said button is released; and moving figures, residing within a circle of a predetermined size with its center at said first point, by a distance and in a direction indicated by said vector.

11. The method of claim 9, wherein said changing step comprises the steps of:

computing a vector from a first point, at which said button is pressed, to a second point, at which said button is released; and moving said plurality of figures by a distance and in a direction indicated by said vector.

12. The method of claim 9, wherein said changing step comprises the step of:

rearranging said plurality of figures on a line segment connecting a point at which said button is pressed and a point at which said button is released.

13. The method of claim 9, wherein said changing step comprises the steps of:

computing an angle formed by a point at which said button is pressed, a predetermined reference point, and a point at which said button is released; and rotating positions of said plurality of figures around said reference point by said angle.

14. The method of claim 9, wherein said changing step comprises the step of:

moving said plurality of figures to a position inside a rectangle having a diagonal formed by a line segment connecting a point at which said button is pressed and a point at which said button is released.

15. The method of claim 9, wherein said changing step comprises the step of:

moving said plurality of figures to a position inside an ellipse inscribed in a rectangle that has as a diagonal a line segment connecting a point at which said button is pressed and a point at which said button is released.

16. The method of claim 9, wherein said changing step comprises the step of:

moving the selected figure to a point indicated by said pointing device.

17. The method of claim 9, wherein said changing step comprises:

moving the selected figure to a position within a circle of a predetermined size with its center at a point indicated by said pointing device.

18. The method of claim 1, wherein said outputting step includes the step of:

outputting automatically a percussion rhythm specified by a rhythm play rule included within said figure-to-sound conversion rule.

19. The method of claim 1, further comprising the steps of:

expressing the position of each of said plurality of figures in three-dimensional coordinates;

displaying, during said displaying step, a projection of said plurality of figures having three-dimensional positions onto a two-dimensional plane; and moving, during said changing step, said plurality of figures in a three-dimensional space.

20. A method for synthesizing a melody using a computer connected to a display device, an input device, and a sound generating device, said method comprising the steps of:

displaying a plurality of figures on said display device;

establishing a figure-to-sound conversion rule in response to directions designated by said input device, said figure-to-sound conversion rule specifying relationships between attributes of each figure, including attributes of position on said display device, and attributes of a sound corresponding to each figure;

establishing at least one figure-position change rule in response to directions designated by said input device, said figure-position change rule specifying a manner in which positions of said figures change;

selecting, in turn, successive ones of the displayed plurality of figures automatically;

changing, each time a figure is selected, a position of at least the selected figure in accordance with the figure-position change rule;

outputting, each time a figure is selected, through said sound generating device, a sound having attributes which correspond to attributes of the selected figure determined in accordance with the figure-to-sound conversion rule, to thereby generate a melody which corresponds to the attributes of the selected figures and which changes in accordance with changes in position of said figures;

assigning different tonalities to different pitch ranges using a filter within said figure-to-sound conversion rule; and adjusting pitch of said sound in conformity with a tonality assigned by said filter.

21. The method of claim 20, further comprising the steps of:

updating said filter in response to play information input from an external electronic musical instrument; p1 turning on a filter portion for defining a pitch that corresponds to a key selected by a user; and turning off a filter portion when a predetermined time has elapsed after previous filtering.

22. A method for synthesizing a melody using a computer connected to a display device, an input device, and an electronic musical instrument, said method comprising the steps of:

displaying a plurality of figures on said display device;

establishing a figure-to-sound conversion rule in response to directions designated by said input device, said figure-to-sound conversion rule specifying relationships between attributes of position of each figure, including attributes on said display device, and attributes of a sound corresponding to each figure;

establishing at least a first figure-position change rule in response to directions designated by said input device, said first figure-position change rule specifying a manner in which positions of said figures change;

establishing at least a second figure-position change rule in response to directions designated by said input device, said second figure-position change rule specifying a manner in which figure positions change in response to sound information derived from said electronic musical instrument;

selecting, in turn, successive ones of the displayed plurality of figures automatically;

changing, each time a figure is selected, a position of at least the selected figure in accordance with said first figure-position change rule;

changing, in response to sound information derived from said electronic musical instrument, a position of at least one of said plurality of figures in accordance with said second figure-position change rule; and outputting, each time a figure is selected, through said electronic musical instrument, a sound whose attributes correspond to attributes of the selected figure in accordance with the figure-to-sound conversion rule, to thereby generate a melody which corresponds to the attributes of the selected figures and which changes in accordance with changes in position of said figures.

23. A system for synthesizing a melody using a computer connected to an input device, comprising:

means for displaying a plurality of figures;

means for establishing a figure-to-sound conversion rule in response to directions designated by said input device, said figure-to-sound conversion rule specifying relationships between attributes of each figure, including attributes of position of said figures on said display means, and attributes of sound corresponding to each figure;

means for establishing at least one figure-position change rule in response to directions designated by said input means, said figure-position change rules specifying a manner in which positions of said figures change;

means for selecting, in turn, successive ones of said displayed plurality of figures automatically;

means for changing, each time a figure is selected, a position of at least the selected figure in accordance with the figure-position change rule;

means for generating a sound; and means for outputting, each time a figure is selected, through said sound generating means, a sound having attributes which correspond to attributes of the selected figure determined in accordance with the figure-to-sound conversion rule, to thereby generate a melody which corresponds to the attributes of the selected figures and which changes in accordance with changes in position of said figures.

24. The system of claim 23, wherein said figure-position change rule is a rule specifying a manner in which automatic figure moving takes place in a predetermined manner.

25. The system of claim 24, wherein said changing means includes:

means for determining a horizontal displacement and a vertical displacement of said selected figure using random numbers; and means for changing the position of the selected figure by said determined displacements.

26. The system of claim 24, wherein said changing means includes:

means for computing a vector having a length which is a predetermined integer multiple of a unit vector pointing in a direction towards a predetermined reference point; and means for moving the selected figure by a distance and in a direction indicated by said computed vector.

27. The system of claim 24, wherein said changing means includes:

means for changing the position of the selected figure by predetermined horizontal and vertical displacements.

28. The system of claim 24, wherein said changing means includes:

means for moving the selected figure in a rectilinear motion with uniform velocity; and means for changing a direction of a velocity vector of the motion of the selected figure when that figure arrives at a boundary of a display area in said display means.

29. The system of claim 24, wherein said changing means includes:

means for rotating the position of the selected figure around a predetermined point.

30. The system of claim 24, wherein said changing means includes:

means for selecting a predetermined number of figures, which includes the selected figure;

means for determining a vector using random numbers; and means for moving said predetermined number of figures by a distance and in a direction indicated by said vector.

31. The system of claim 23, wherein said input means includes a pointing means with a button, and wherein said figure-position change rule is a rule specifying a manner in which figure moving is partly directed by a user through use of said pointing means.

32. The system of claim 31, wherein said changing means includes:

means for computing a vector from a first point, at which said button on said pointing means is pressed, to a second point, at which said button is released; and means for moving figures, residing within a circle of a predetermined size with its center at said first point, by a distance and in a direction indicated by said vector.

33. The system of claim 31, wherein said changing means includes:

means for computing a vector from a first point, at which said button is pressed, to a second point, at which button is released; and means for moving said plurality of figures by a distance and in a direction indicated by said vector.

34. The system of claim 31, wherein said changing means includes:

means for re-arranging said plurality of figures on a line segment connecting a point at which said button is pressed and a point at which said button is released.

35. The system of claim 31, wherein said changing means includes:

means for computing an angle formed by a point at which said button is pressed, a predetermined reference point, and a point at which said button is released; and means for rotating positions of said plurality of figures around said reference point by said angle.

36. The system of claim 31, wherein said changing means includes:

means for moving said plurality of figures to a position inside a rectangle having a diagonal formed by a line segment connecting a point at which said button is pressed and a point at which said button is released.

37. The system of claim 31, wherein said changing means includes:

means for moving said plurality of figures to a position inside an ellipse inscribed in a rectangle that has as a diagonal a line segment connecting a point at which said button is pressed and a point at which said button is released.

38. The system of claim 31, wherein said changing means includes:

means for moving the selected figure to a point indicating by said pointing means.

39. The system of claim 31, wherein said changing means includes:

means for moving the selected figure to a position within a circle of a predetermined size with its center at a point indicated by said pointing device.

40. The system of claim 23, wherein said outputting means includes:

means for outputting automatically a percussion rhythm specified by a rhythm play rule included within said figure-to-sound conversion rule.

41. The system of claim 23, further comprising:

means for expressing the position of each of said plurality of figures in three-dimensional coordinates; and wherein said display means displays a projection of said plurality of figures having three-dimensional positions onto a two-dimensional plane, and wherein said changing means moves said plurality of figures in a three-dimensional space.

42. The system of claim 23, further comprising:

filtering means, within said figure-to-sound conversion rule, for assigning different tonalities to different pitch ranges for said generated melody.

43. The system of claim 42, further comprising:

means for adjusting pitch of sounds corresponding to said figures in conformity with a tonality assigned by said filter.

44. A system for synthesizing a melody using a computer connected to an input device, comprising:

means for displaying a plurality of figures;

means for establishing a figure-to-sound conversion rule in response to directions designated by said input device, said figure-to-sound conversion rule specifying relationships between attributes of each figure, including attributes of position of said figures on said display device, and attributes of a sound corresponding to each figure;

means for establishing a first figure-position change rule in response to directions designated by said input device, said first figure-position change rule specifying a manner in which figure-positions change;

means for establishing a second figure-position change rule in response to directions designated by said input device, said second figure-position change rule specifying a manner in which figure-positions change in response to sound information derived from an external source;

means for selecting, in turn, successive ones of the displayed plurality of figures automatically;

means for changing, each time a figure is selected, a position of at least the selected figure in accordance with said first figure-position change rule;

means for changing, in response to sound information derived from said external source, a position of at least one of said plurality of figures in accordance with said second figure-position change rule; and means for outputting, each time a figure is selected, through said external source, a sound whose attributes correspond to attributes of the selected figure in accordance with the figure-to-sound conversion rule, to thereby generate a melody which corresponds to the attributes of the selected figures and which changes in accordance with changes in position of said figures.

45. The system of claim 44, wherein said external source is an electronic musical instrument.

46. The system of claim 23, wherein said attributes of each figure also include shape, color, and size of said figures as displayed on said display means.

47. The system of claim 42, wherein said attributes of each figure also include shape, color, and size of each figure as displayed on said display means.

48. The system of claim 44, wherein said attributes of each figure also include shape, color, and size of each figure as displayed on said display means.

49. The system of claim 23, wherein said attributes of each figure also include pitch, timbre, intensity, and sound length.

50. The system of claim 42, wherein said attributes of said sound include pitch, timbre, intensity, and sound length.

51. The system of claim 44, wherein said attributes of said sound include pitch, timbre, intensity, and sound length.

52. A computer program product for use with a computer having a display device, comprising: a computer readable medium with a computer program recorded thereon, the program including:

a first code section for causing the computer to display a plurality of figures on a display device;

a second code section for causing the computer to establish a figure-to-sound conversion rule in response to directions designated by an input device, in such a manner that said figure-to-sound conversion rule specifies relationships between attributes of each figure including attributes of position on a display means, and attributes of sound corresponding to each figure;

a third code section for causing the computer to establish at least one figure-position change rule in response to directions designated by said input device, said figure-position change rule specifying a manner in which figure positions change;

a fourth code section for causing the computer to select, in turn, successive ones of the displayed plurality of figures automatically;

a fifth code section for causing the computer to change, each time a figure is selected, a position of at least the selected figure in accordance with the figure-position change rule; and a sixth code section for causing the computer to output, each time a figure is selected, through a sound generating means, a sound having attributes which correspond to attributes of the selected figure determined in accordance with the figure-to-sound conversion rule, to thereby generate a melody which corresponds to the attributes of the selected figures and which changes in accordance with changes in position of said figures.

53. The computer program product of claim 52, further comprising:

a seventh code section for causing the computer to assign different tonalities to different pitch ranges in accordance with a filter within said figure-to-sound conversion rule.

54. The computer program product of claim 52, further comprising:

an eighth code section for causing the computer to adjust pitch of said sound in conformity with a tonality assigned by said filter.

* * * * *